US008926405B2

(12) United States Patent
Lynn

(10) Patent No.: US 8,926,405 B2
(45) Date of Patent: Jan. 6, 2015

(54) SURFACE TREATMENT SYSTEM AND METHOD FOR ACHIEVING A SUBSTANTIALLY UNIFORM SURFACE PROFILE FOR A TREATED SURFACE

(71) Applicant: William R Lynn, Isle of Palms, SC (US)

(72) Inventor: William R Lynn, Isle of Palms, SC (US)

( * ) Notice: Subject to any disclaimer, the term of this patent is extended or adjusted under 35 U.S.C. 154(b) by 0 days.

(21) Appl. No.: 14/054,101

(22) Filed: Oct. 15, 2013

(65) Prior Publication Data

US 2014/0038497 A1 Feb. 6, 2014

Related U.S. Application Data

(63) Continuation of application No. 12/618,339, filed on Nov. 13, 2009, now Pat. No. 8,556,683.

(60) Provisional application No. 61/114,257, filed on Nov. 13, 2008.

(51) Int. Cl.

| | |
|---|---|
| ***B24C 3/04*** | (2006.01) |
| ***B24C 9/00*** | (2006.01) |
| ***B24C 3/02*** | (2006.01) |

(52) U.S. Cl.

CPC . *B24C 9/003* (2013.01); *B24C 3/02* (2013.01); *B24C 3/04* (2013.01); *B24C 9/00* (2013.01)

USPC ..... 451/89; 451/2

(58) Field of Classification Search

CPC ..... B24C 7/0092; B24C 9/00; B24C 11/00; B24C 11/005; B24C 3/065; B24C 5/06; B24C 9/003

USPC ..... 451/80, 81, 83, 87, 88, 89, 90, 2

See application file for complete search history.

(56) References Cited

U.S. PATENT DOCUMENTS

| | | | | |
|---|---|---|---|---|
| 2,495,269 A | | 1/1950 | Lindmark | |
| 2,953,876 A | * | 9/1960 | Zieber et al. | 451/2 |
| 4,300,318 A | | 11/1981 | Brown | |

(Continued)

FOREIGN PATENT DOCUMENTS

| | | |
|---|---|---|
| DE | 44 07 956 A1 | 9/1995 |
| DE | 198 02 308 A1 | 7/1998 |
| DE | 100 07 831 C1 | 8/2001 |
| EP | 0 365 707 A1 | 5/1990 |

OTHER PUBLICATIONS

European Search Report Corresponding to EP 10 00 5029 mailed Jul. 11, 2012.

*Primary Examiner* — Robert Rose

(74) *Attorney, Agent, or Firm* — Davis & Bujold, PLLC; Michael J. Bujold

(57) ABSTRACT

A treatment system for achieving a substantially uniform surface profile of a surface to be treated. The treatment system comprises a support panel which supports a rotatable orb, and the rotatable orb has an access aperture extending therethrough which facilitates receiving a desired surface treatment equipment. The access aperture is sized so as to permit the desired surface treatment equipment to pass therethrough and move relative thereto the access aperture, during surface treatment. The treatment system comprises a monitoring system for monitoring at least one of a spacing of a remote end of the surface treatment equipment from the surface to be treated and a treatment angle of the surface treatment equipment in order to control the surface treatment of the surface to be treated and achieve a substantially uniform surface profile, of the surface to be treated, following treatment.

20 Claims, 36 Drawing Sheets

(56) References Cited

U.S. PATENT DOCUMENTS

| | | | | |
|---|---|---|---|---|
| 4,503,577 | A | 3/1985 | Fowler | |
| 4,603,515 | A * | 8/1986 | Gilmore et al. | 451/87 |
| 4,825,598 | A * | 5/1989 | Schlick | 451/87 |
| 4,960,143 | A | 10/1990 | Dore, Jr. et al. | |
| 5,209,028 | A * | 5/1993 | McDermott et al. | 451/89 |
| 5,316,588 | A | 5/1994 | Dyla | |
| 6,250,996 | B1 | 6/2001 | Metcalf et al. | |
| 6,273,154 | B1 | 8/2001 | Laug | |
| 6,705,921 | B1 * | 3/2004 | Shepherd | 451/2 |

* cited by examiner

F

SURFACE TREATMENT SYSTEM AND METHOD FOR ACHIEVING A SUBSTANTIALLY UNIFORM SURFACE PROFILE FOR A TREATED SURFACE

This application is a continuation-in-part of U.S. application Ser. No. 12/618,339 filed Nov. 13, 2009, now U.S. Pat. No. 8,556,683 issued Oct. 15, 2013, which claims the benefit of U.S. provisional application Ser. No. 61/114,257 filed Nov. 13, 2008.

FIELD OF THE INVENTION

The present invention relates to a stationary and/or a portable containment system or barrier in general and, more particularly, to a stationary and/or a portable containment system or barrier for completely separating an operator from the blasting media, and any contaminant(s), debris, etc., being removed from the surface being treated, during treatment of the desired work surface, while providing improved visibility and access within the defined enclosed treatment area and still facilitating containment of removed debris and collection of utilized blasting media.

BACKGROUND OF THE INVENTION

It is known in the art to apply or propel various substances, materials and/or media, e.g., both abrasive and non-abrasive, against a desired surface in order to "treat" the surface, e.g., polish, clean, abrade, prepare a surface for painting, remove rust, grease or oil, etc. The blasting media may consist of dry or liquid material or a combination thereof with or without a variety of abrasive or non-abrasive constituents added thereto. In many applications, the blasting media is a composite media comprising a combination of two or more components which are mixed or blended together with one another, in the desired proportion, to achieve the desired amount surface treatment, e.g., polishing, cleaning, abrading, remove rust, surface preparation, etc. Application of the blasting media by means of a pressurized applicator generally results in a substantial quantity of media and contaminants becoming airborne and rebounding off of the surface being treated. This rebounding media must be adequately contained within an enclosed treatment area in order to prevent contamination to the surrounding environment with the media and/or removed contaminants and/or debris from the surface being treated. This is especially true if hazardous materials are being removed from the surface being treated.

Containment systems, currently known in the art, are used in the treatment of objects or surfaces are to be treated including beams, pipes, fixtures, wall, ceilings panels or some other structure. These systems contain the blasting media and other material, contaminant, debris and hazardous material and suppress the harmful affects to a confined area. However, to treat these objects or surfaces, generally an operator would be required to be located inside the containment area and thus subjected to such hazardous conditions.

As is conventional in the art, after being treated it is often times desirable to refinish, resurface, seal, overlay, or apply a desired coating to the treated surface. In such cases, coatings may be applied directly to the treated surfaces or it may be necessary to apply an adhesive to the treated surface in order for an overlay or other type of coating to be applied. It is sometimes required that a treated surface have a certain profile or texture, e.g., "anchor or surface profile" to enable the coating to properly adhere to the treated surface. In some cases, surfaces are required to have a specific anchor or surface profile in order for the manufacturer's warranty to be valid.

There are a number of drawbacks associated with the prior art in relation to treating a surface with blasting media in such a manner that the texture and/or anchor or surface profile of the treated surface is uniform across the entirety of the desired work surface. It is known that there are a variety of blasting media which are used in treating different surfaces. The different blasting media have a number of characteristics which can affect the treatment of the surface. The texture and/or anchor or surface profile of a surface at least somewhat depends on the weight and size of the particle of the blasting media as well as its abrasiveness, e.g., the grit of the blasting media. Generally, a blasting media having a lower grit (higher weight and larger size particles) is more aggressive in treating a surface than a blasting media with a higher grit (lower weight and smaller size particles). In other words, a blasting media having a lower grit will tend to remove a larger amount of material from the surface being treated when compared to treating the same surface with a blasting media having a larger grit. Also, after being treated with a low grit blasting media, the texture and/or the anchor or surface profile of the treated surface will generally be somewhat "rougher" than that of a surface treated with a higher grit blasting media which tends to be smoother.

It is to be appreciated that the characteristics, e.g., the grit of the blasting media, changes during use of media, due to the impact of the blasting media against the surface being treated, the texture and/or the anchor or surface profile of the treated surface can gradually change over time, e.g., the media tends to less aggressive. This is especially true when treating larger surfaces. A number of methods have been developed to compensate for the changes in blasting media during use. These known methods include the separation and removal of used blasting media, such as by filtering, and the replacement of used blasting media with new blasting media. The removal and replacement of blasting media have been shown to enhance, to some extent, the consistency or uniformity of the surface over the course of treatment.

Another drawback associated with prior art methods and systems of treating a surface with blasting media relates to the effort required to support and operate conventional blasting equipment. Prior art blasting equipment is generally manually supported and operated. Typically, the blasting nozzle is supported by an operator who aims/controls the blasting nozzle in order to direct a flow of blasting media at the surface being treated. Due to the weight of the blasting nozzle and the pressures usually associated with propelling the blasting media from the discharge nozzle, an operator can easily become fatigued which often results in a reduce work hours as well as quality, e.g., uniformity of the surface treatment being achieved.

SUMMARY OF THE INVENTION

Wherefore it is an object of the present invention to overcome the noted problems and drawbacks associated with the prior art containment systems and equipment.

Another object of the invention is to form a containment system, located in close proximity to a surface to be treated while still allowing the operator to be located completely outside the enclosed treatment area so that the operator is not directly exposed to the blasting media, any contaminant(s) and/or any debris removed from the object or surface to be treated and/or suspended in the air.

Yet another object of the invention is to provide a containment system that can be readily erected at remote sites and has at least one sealable opening in an end surface of the containment system barrier to accommodate various parts, items, components, etc., such as pipes, walls, ceilings, beams, rods, shafts, etc.

Still another object of the invention is to effectively seal the entire perimeter of a surface to be treated so as to prevent any media, material, contaminant(s), debris, etc., from escaping the defined enclosed treatment area to facilitate collection, recycling and/or regeneration of the blasting media as well as facilitate collection and disposal of all of the removed material(s), contaminant(s), debris, hazardous material(s), etc., from the surface being treated.

Another object of the invention is to provide a containment system that is easy to assemble at remote locations and completely encloses the desired surface to be treated while also being easily to move to another section of the surface to be treated and is also easily disassembled following treatment of the surface.

A still further object of the invention is to provide a containment system that creates negative pressure within enclosed treatment area, during use of the system, to facilitate removal of any airborne media, dust, substance(s), material(s), contaminant(s), debris, hazardous material(s), etc., from enclosed treatment area to minimize the possibility of any blasting media and/or removed material(s), contaminant(s), debris, hazardous material(s), etc., escaping from enclosed treatment area into the surrounding area.

Yet another object of the invention is to provide a containment system that facilitates collecting of the discharged blasting media and also facilitates collection, recycling and/or regeneration of the blasting media into a new blasting media for reuse with the containment system.

A further another object of the invention is to provide the operator of the blasting equipment with up to 180 degree range of motion in a first direction, e.g., a horizontal direction, and up to 180 degree range of motion in a second direction normal to the first direction, e.g., a vertical direction, and well as having a range of motion for all locations therebetween to assist with adequate treatment of the object to be treated.

A still further another object of the invention is to utilize moisture, during the surface treatment process, in order to control and minimize the creation of dust, e.g., apply vapor or moisture to the blasting media immediately before or as the blasting media is discharged by the surface treatment equipment.

Yet another object of the invention is to at least partially define, with the rigid support panel, a relatively small enclosed treatment area in which a negative pressure can be generated during the surface treatment process to minimize the possibility of any blasting media and/or removed material(s), contaminant(s), debris, hazardous material(s), etc., from escaping the enclosed treatment area into the surrounding area.

Another object of the invention is to provide a flexible tarp or barrier which is at least partially translucent so as to permit light, from outside the enclosed treatment area, to pass through the flexible barrier and illuminate the object to be treated and thereby minimize the problems associated with adequately illuminating the object to be treated during the surface treatment process.

The term "air tight seal", as generally used within this patent application, is intended to mean that the seal may allow some air to flow into the enclosed treatment area of the portable containment system but generally prevents any media, contaminant(s), dust and/or debris from flowing out of or escaping the enclosed treatment area past the seal into the surrounding environment.

Another object of the invention is to provide the operator of the blasting equipment with a system and method that enhances the treatment of a surface so as to maintain a desired, consistent and uniform surface texture and/or anchor or surface profile over the entire surface to be treated by controlling the weight and the size of the particles of blasting media, during use, and controlling the distance or spacing between the surface to be treated and the blasting nozzle as well as controlling the angle at which the blasting media impacts against the surface being treated. Better control of these parameters result in an improved texture and/or anchor or surface profile of the treated surface.

Yet another object of the invention is to provide the blasting equipment with a support or retaining mechanism which assists supporting the blasting nozzle so as to minimize back pressure, experienced by the operator during surface treatment, and thereby reduce the effort exerted by the operator in order properly and effectively operate the blasting equipment.

The present invention also relates to a treatment system for achieving a substantially uniform surface profile of a surface to be treated, the treatment system comprising a support panel supporting at least one rotatable orb, and the at least one rotatable orb being rotatable with respect to the support panel over a limited range of movement, the at least one rotatable orb having an access aperture extending therethrough which facilitates receiving a desired surface treatment equipment, and the access aperture being sized so as to permit the desired surface treatment equipment to pass therethrough and move relative to the access aperture, during surface treatment, for adjusting a position of the desired surface treatment equipment relative to the surface of the object to be treated, wherein the treatment system comprises a monitoring system for monitoring at least one of a spacing of a discharge end of the surface treatment equipment from the surface to be treated and a treatment angle of the surface treatment equipment with respect to the support panel in order to control the surface treatment of the surface to be treated and achieve a substantially uniform surface profile, of the surface to be treated, following treatment.

The present invention also relates to a method of achieving a substantially uniform surface profile of a surface to be treated, the method system comprising the steps of supporting at least one rotatable orb via a support panel with the at least one rotatable orb being rotatable with respect to the support panel over a limited range of movement, providing an access aperture in the at least one rotatable orb which extends therethrough and facilitates receiving a desired surface treatment equipment, and the access aperture being sized so as to permit the desired surface treatment equipment to pass therethrough and move relative to the access aperture, during surface treatment, for controlling a position of the desired surface treatment equipment relative to the surface or the object to be treated, and monitoring at least one of a spacing of a discharge end of the surface treatment equipment from the surface to be treated and a treatment angle of the surface treatment equipment relative to the support panel in order to control the surface treatment of the surface to be treated and achieve a substantially uniform surface profile, of the surface to be treated, following treatment.

BRIEF DESCRIPTION OF THE DRAWINGS

The invention will now be described, by way of example, with reference to the accompanying drawings in which.

DETAILED DESCRIPTION OF THE INVENTION

Figure 1:
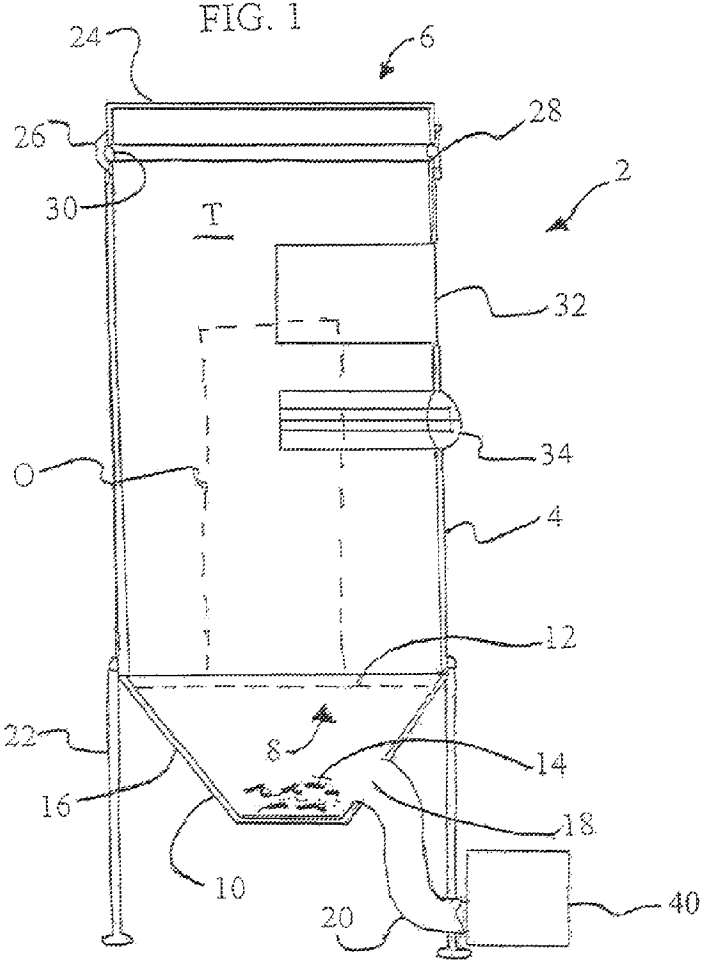
FIG. 1 is a diagrammatic view of a first embodiment of the portable containment system according to the present invention.

Turning now to FIG. 1, a brief description concerning the various components of the present invention will now be briefly discussed. As can be seen in this embodiment, the portable containment system 2 generally comprises an upright standing generally cylindrical housing 4 which is open at both the top and the bottom opposed ends 6, 8 thereof. It is to be appreciated that the cylindrical housing 4 may have any desired shape and/or size as long as the housing is adequately sized and shaped to accommodate the desired the object and/or surface to be treated. A base cover 10 is generally fixedly or permanently connected to the bottom open end 8 of the cylindrical housing 4 to provide support for the object to be treated into the portable containment system 2 as well as allow collection, within the base cover 10, of the discharged blasting media as well as any removed substance(s), material(s), contaminant(s), debris 14, etc., from the object or surfacing being treated. Typically either the lower portion of the cylindrical housing 4 or the top portion of the base cover 10 is provided with a support of some type, e.g., a screen, a shelf, a grate 12, etc., which adequately supports the desired object or surface to be treated O while allowing the discharged blasting media as well as any removed substance(s), material(s), contaminant(s), debris 14, etc., to readily pass therethrough and be collected by the base cover 10. Preferably, the base cover 10 is tapered, conical, funnel shaped 16 or otherwise shaped so at to facilitate funneling, channeling, directing and/or collecting of the discharged blasting media as well as any removed substance(s), material(s), contaminant(s), debris 14, etc., into a lower most portion of the base cover 10. If desired a removal opening or outlet 18 may be provided in the base cover 10 and a suction hose 20 connected thereto to facilitate conveying the collected blasting media, substance(s), material(s), contaminant(s), debris 14, etc., to a separating and regeneration apparatus, discussed below in further detail. Either the exterior surface of the base cover 10 and/or the cylindrical housing 4 is provided with one or more conventional legs, or some other support stand or staging or a frame 22, for supporting the portable containment system 2 on a desired surface. Suitable staging for supporting the portable containment system 2 is manufactured by RDS of North Charleston, S.C.

A top cover 24 is pivotally connected to the top open end of the cylindrical housing 4 to allow the operator access to the interior of the cylindrical housing 4 for inserting a desired item or object to be treated O into the portable containment system 2 as well as facilitate removal of the desired item or object O therefrom once the same has been adequately treated. Typically at least one conventional hinge 26 is provided to facilitate the desired pivotally connected of the top cover 24 to the top open end of the cylindrical housing 4. In addition, a conventional latching mechanism 28 typically is provided, opposite the pivotally connection of the top cover 24 to the cylindrical housing 4, to facilitate retaining the top cover 24 in a closed position while blasting in occurring. Generally either the top cover 24 and/or the top open end 6 of the cylindrical housing 4 is provided with an annular seal, such as an O-ring, a gasket, an inflatable seal, a brush seal 30, etc., to ensure an air or fluid tight seal and thereby prevent the escape of blasting media, contaminants, dust and/or debris 14 between those components when the top cover 24 in its closed position. This annular seal 30 also facilitates application of a negative pressure within the portable containment system 2 via a suction device 40 while surface treatment is occurring.

To facilitating viewing of the object or surface to be treated O, a viewing opening or some other transparent viewing aperture 32 is provided in the exterior surface of the portable containment system 2. It is to be appreciated the viewing opening or some other transparent viewing aperture 32 may be provided in either the top or base cover 10, if desired. The viewing opening 32 is typically a shatter resistant glass, a transparent plastic or plexiglass, etc. One aspect of the viewing opening 32 is that it is movable, relative to a remainder of the portable containment system 2 as discussed below, while still providing an adequate and unobstructed line of sight between the operator and the object or surface to be treated O during surface treatment.

To facilitating control and manipulation of the blasting nozzle or other blasting equipment during the surface treatment process, an access port 34 is provided in the exterior surface of the portable containment system 2. The access port 34 may be as simple as a couple of heavy duty rubber gloves located in a slot opening provide in the exterior surface of the cylindrical housing 4 and extending into the interior of the enclosed treatment area T of the cylindrical housing 4 and sealed with respect to the cylindrical housing 4 to facilitate operation of a blasting nozzle located within the portable containment system 2 to allow manually control of the blasting nozzle during discharge of the blasting media. Alternatively, the blasting nozzle may only partially project though the cylindrical housing 4 and may be closely associated with the viewing opening 32 and be simultaneously movable with the viewing opening 32 to assist with control and manipulation of the surface treatment process. Preferably, the operator is able to pivot the blasting nozzle up and down within the access port 34, relative to the portable containment system 2, over an angle of about at least 45 degrees or so, more preferably over an angle of about at least 70 degrees or so and most preferably over an angle of about at least 130 degrees or so. In addition, the operator is able to either slide or move the blasting nozzle to and fro horizontally at least a few inches or so and/or pivot horizontally, relative to the portable containment system 2, over an angle of about at least 90 degrees or so, more preferably over an angle of about at least 180 degrees or so and most preferably over an angle of about 360 degrees so as to minimize the amount of times the object or surface to be treated O must be rotated or flipped in order to ensure adequate treatment to the entire object or surface to be treated O.

Figure 1A:
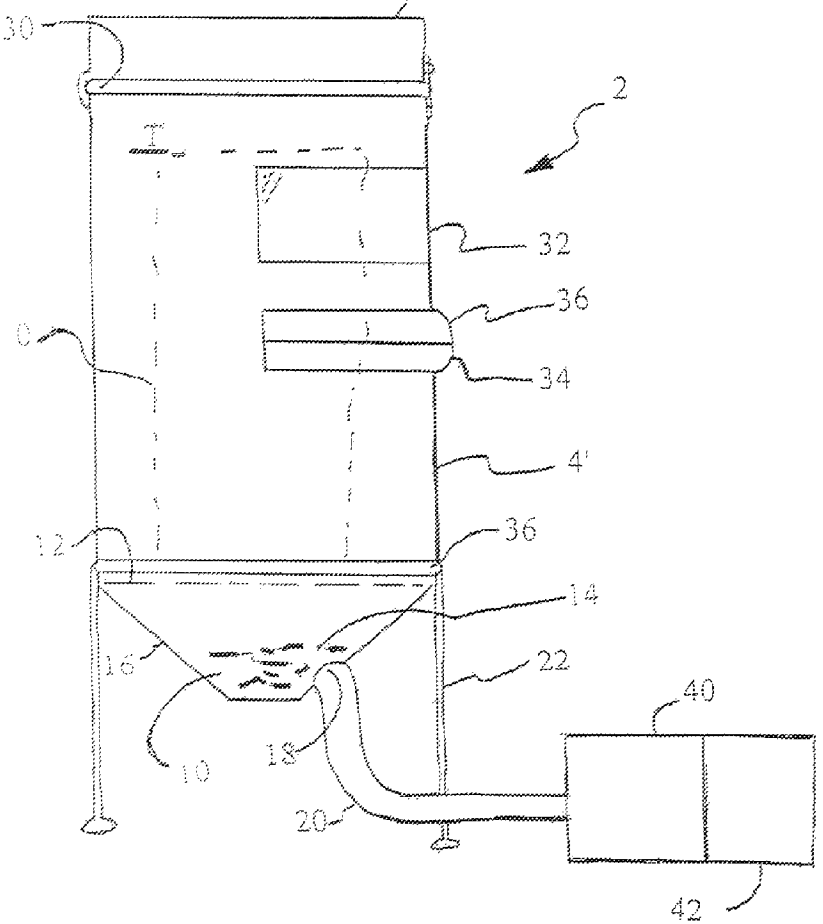
FIG. 1A is a diagrammatic view of a variation of the first embodiment shown in FIG. 1.
Figure 2A:
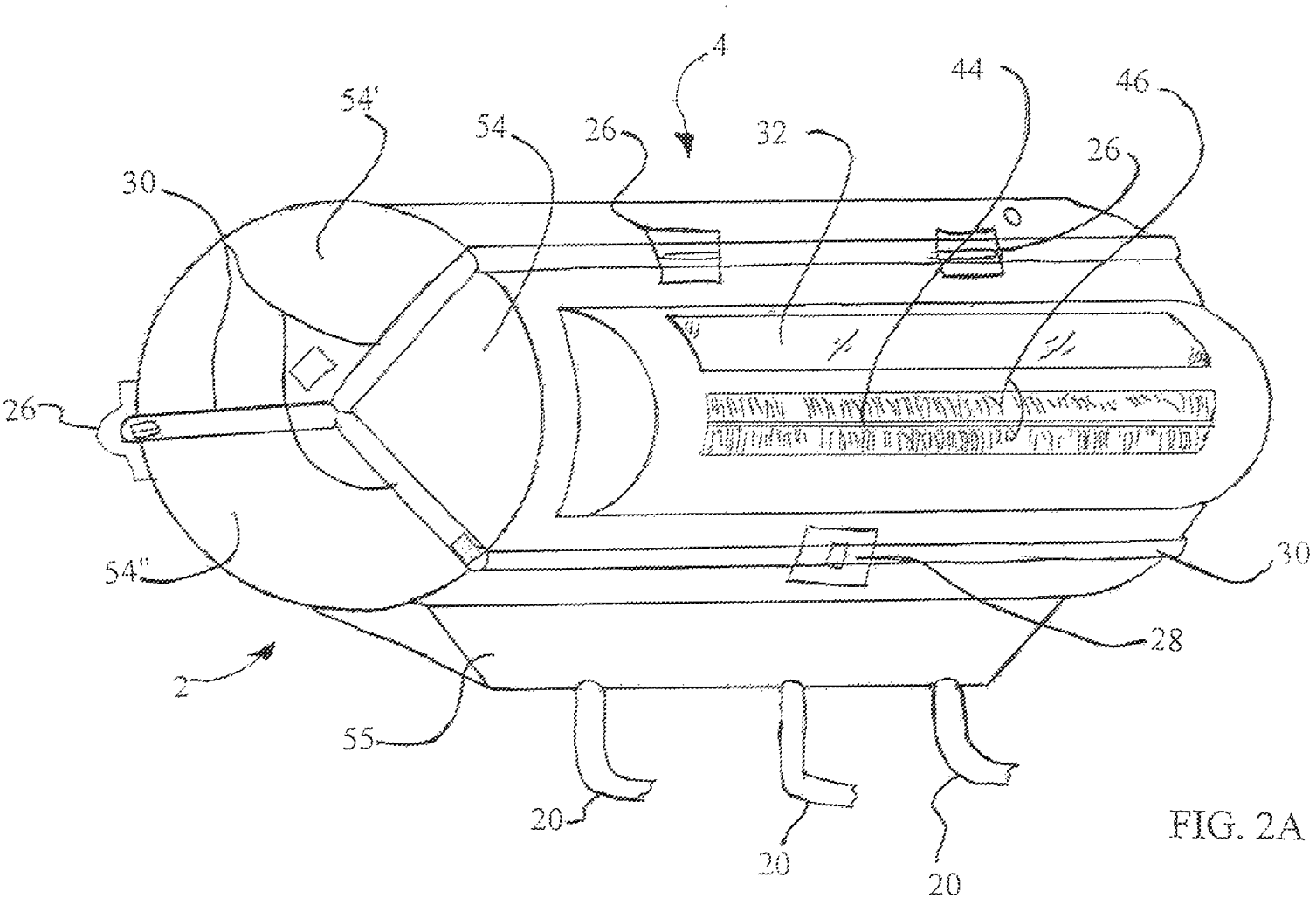
FIG. 2A is a diagrammatic view of a second embodiment of the portable containment system according to the present invention.
Figure 2B:
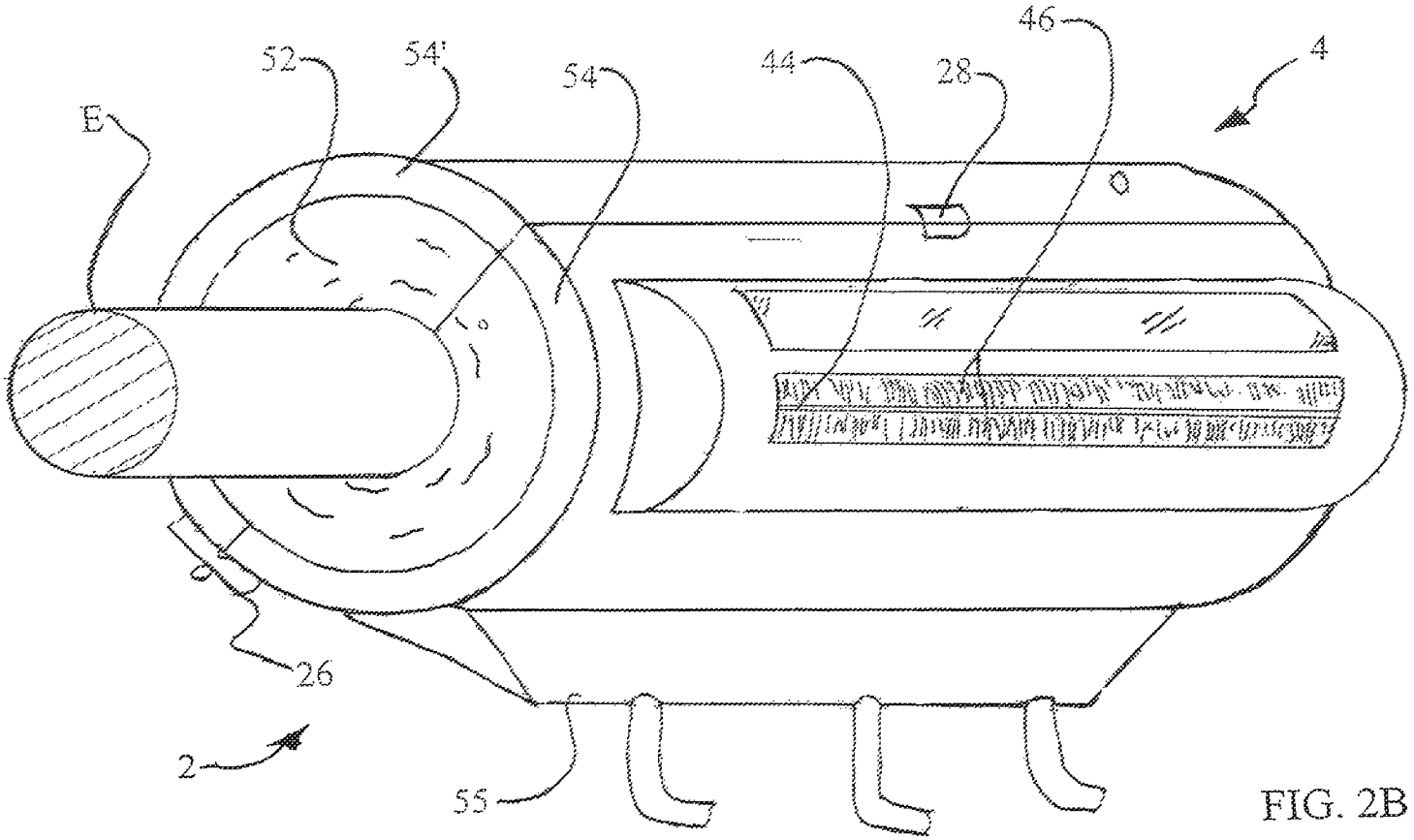
FIG. 2B is a diagrammatic view of a first variation of the second embodiment shown in FIG. 2A.
Figure 2C:
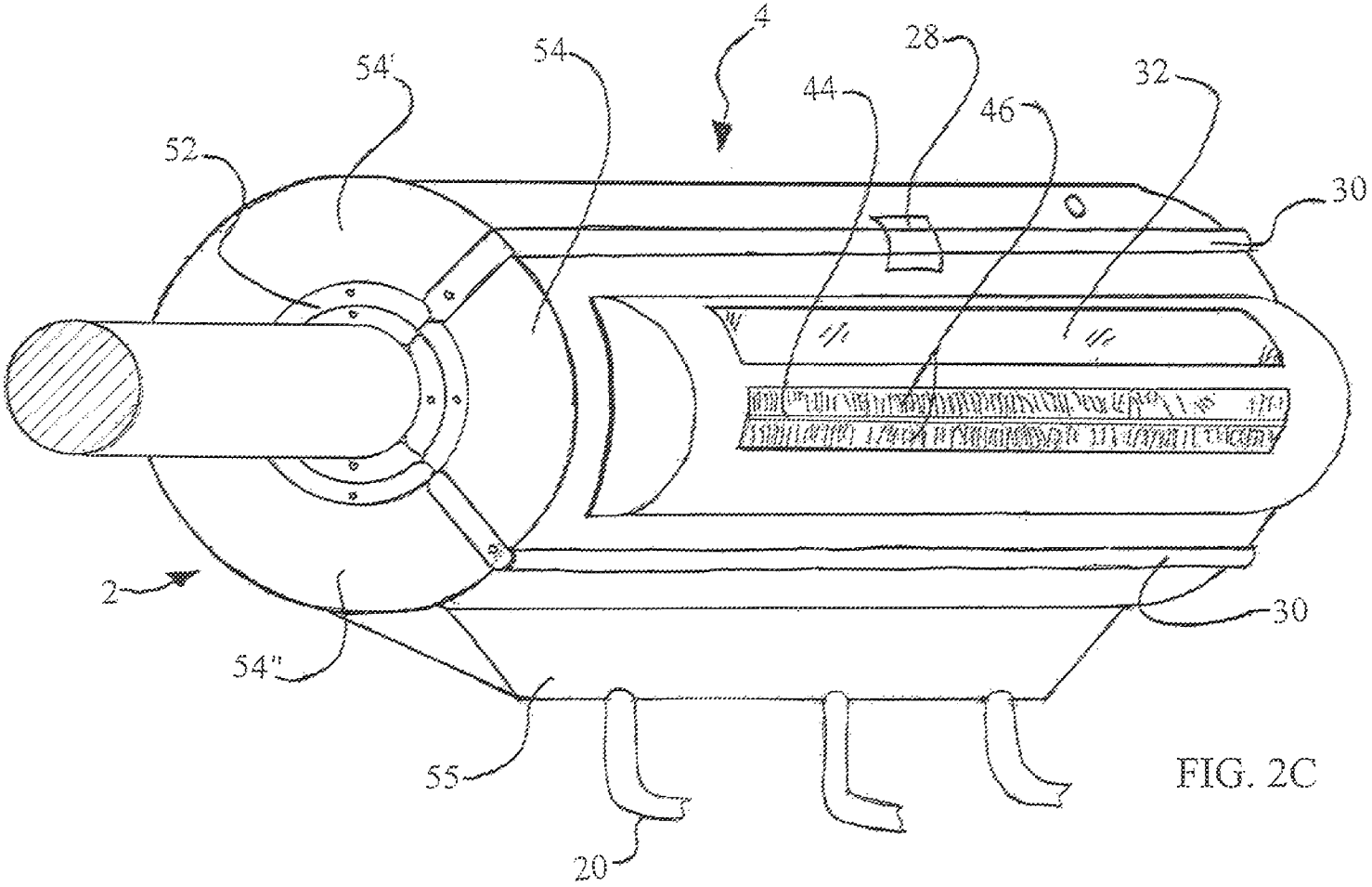
FIG. 2C is a diagrammatic view of a second variation of the second embodiment shown in FIG. 2A.
Figure 2D:
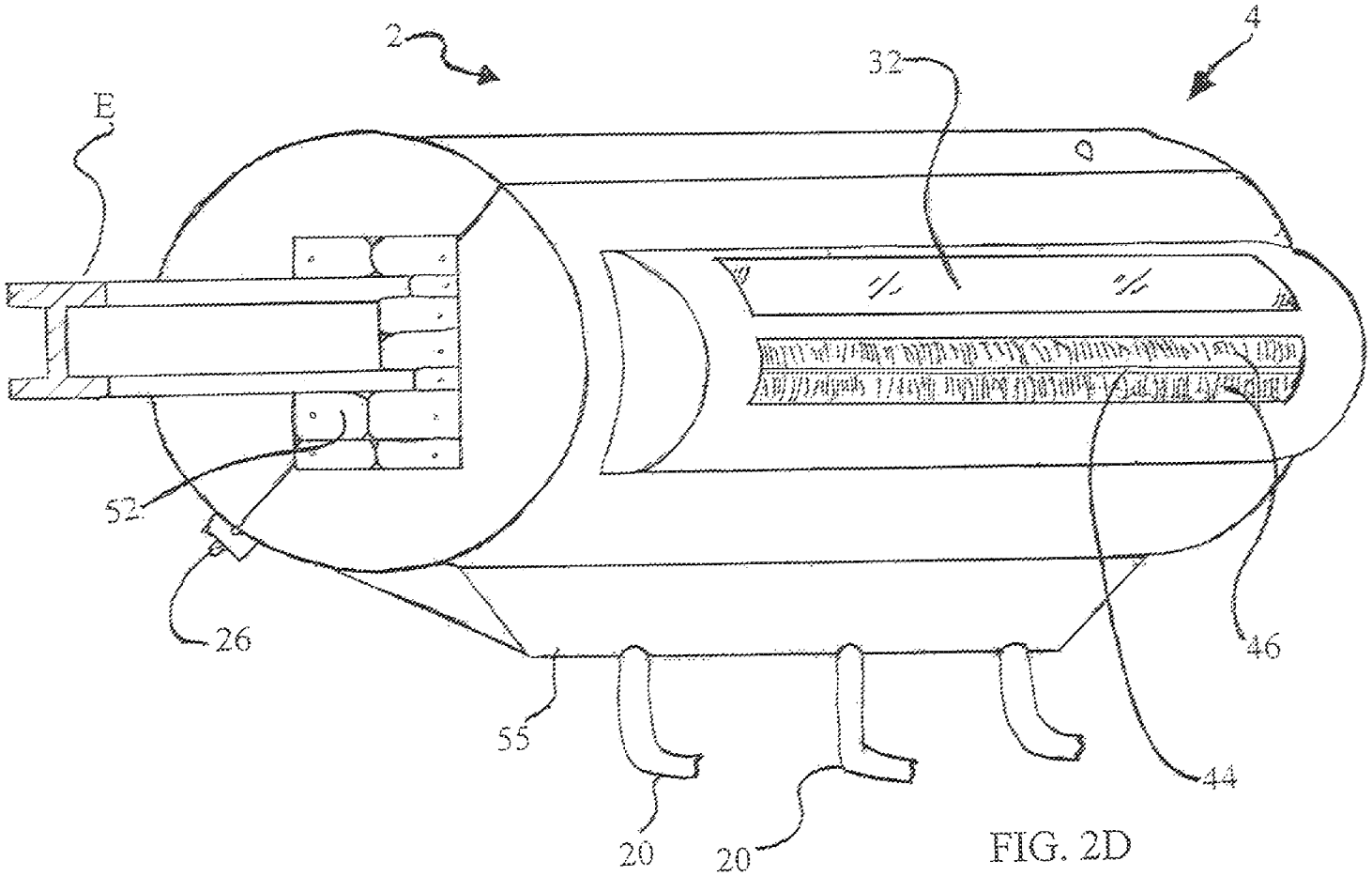
FIG. 2D is a diagrammatic view of a third variation of the second embodiment shown in FIG. 2A.
Figure 2E:
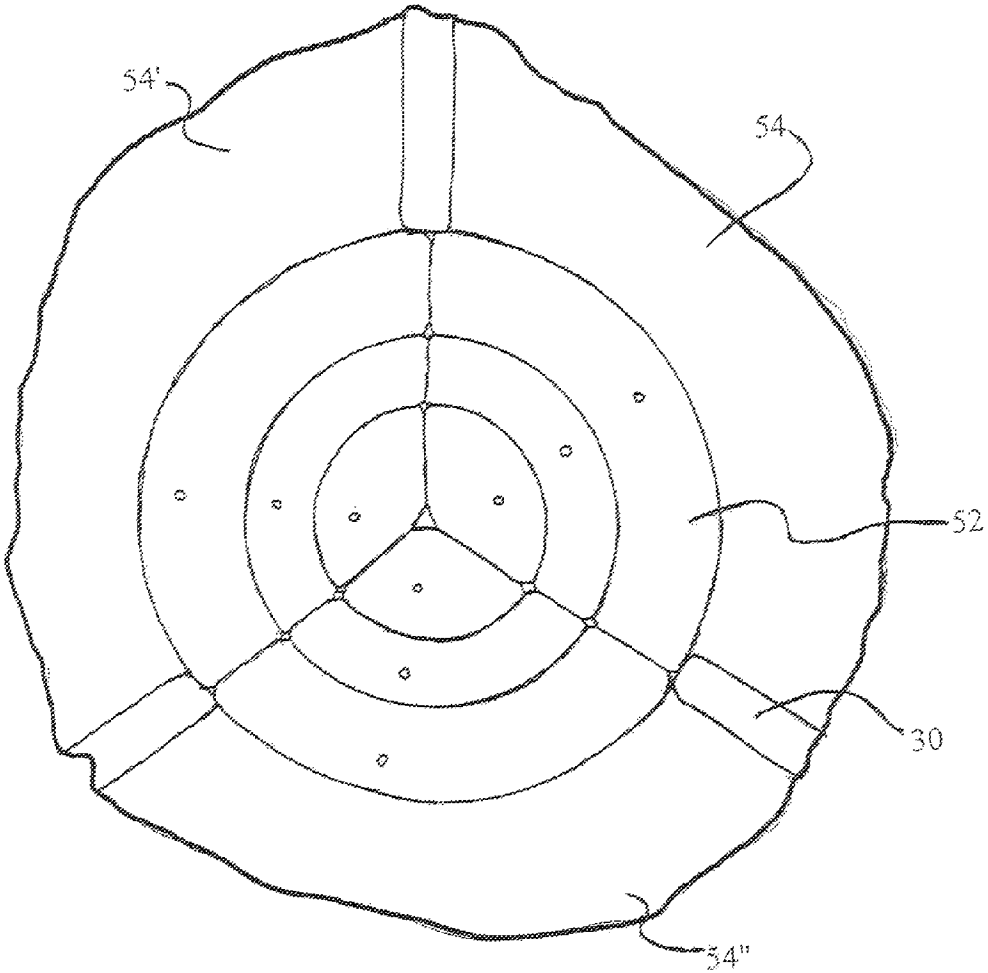
FIG. 2E is a diagrammatic view of an end of a larger version of the portable containment system according to FIG. 2C.

FIG. 1A shows a variation of the portable containment system 2. According to this embodiment, the cylindrical housing 4 is formed as three separate components, namely, a top cover 24, a central housing 4' and a base cover 10 which are all aligned with one another to form an integral cylindrical housing 4. The central housing 4' along with the top cover 42 are movable or rotatable relative to at least the base cover 10 which remains stationary during surface treatment via a rotatable seal 36 is provided between a lower portion of the central housing 4' and a top portion of the base cover 10. A conventional slidable seal is provided between the lower end of the central housing 4' and the mating top end of the base cover 10 to prevent the escape of blasting media, contaminants, dust and/or debris 14 between those components during surface treatment. Both the viewing opening 32 and the access port 34 are provided adjacent one another in the central housing 4' to facilitate control of the blasting process from the exterior of the portable containment system 2 while allowing the operator to spin or rotate the central housing 4' and walk around the base cover 10 of the portable containment system 2 and treatment of the entire object or surface to be treated O, i.e., 360 degrees around the object being treated, and minimize the number of times that the operator may be required to interrupt the surface treatment process to either rotate, flip over, or otherwise change or alter the position and/or orientation of the object or surface to be treated O.

According to this embodiment, the access port 34 is sealed, e.g., by a conventional flexible rubber shroud or barrier 36, for example, with respect to the remainder of the portable containment system 2 and merely allowed to pivot both up and down and left and right while slide or move with the central housing 360 degrees around the portable containment system 2.

In order to create a negative pressure within the portable containment system 2, during operation of the system, a conventional suction device 40 is connected, via at least one exhaust or suction hose 20, to an outlet provided in the portable containment system 2, e.g., in the base cover 10, and the suction device 40 draws air from inside of the portable containment system 2 and thereby creates a negative pressure therein. Such withdrawal of air from an interior of the portable containment system 2 assists with removing airborne blasting media, contaminants, dust, removed substance(s), material(s), contaminant(s), and/or debris 14, etc., from the enclosed treatment area T and reduces the opportunity for any fines or the like from escaping the enclosed treatment area T into the surrounding environment via any small crack(s) and/or other void(s) in the containment system. As a result, the only available exhaust flow path from the portable containment system 2 is via suction device 40. It is to be appreciated that at least one of the seals 36, formed in the portable containment system 2, is designed to permit some air to leak into the enclosed treatment area T of the portable containment system 2 while still facilitating the creation of a negative pressure within the portable containment system 2.

All of the matter removed from the enclosed treatment area T, by the suction device 40, is first collected by a separating and regeneration apparatus 42. The separating and regeneration apparatus 42 (only diagrammatically shown in the drawings) then separates, e.g., by a screening process, all of the larger pieces of blasting media, contaminants and/or debris 14 from the smaller particles and fines of the blasting media, contaminants and/or debris 14 which are then properly disposed of in accordance with generally accepted practices. The larger pieces of blasting media, contaminants and/or debris 14 are then further separated, classified, etc., to assist with separating the recyclable blasting media from the removed substance(s), material(s), contaminant(s), hazardous material(s) and/or debris 14. The recyclable blasting media may then be regenerated and/or mixed with virgin blasting media and reused while the separated substance(s), material(s), contaminant(s), hazardous material(s) and/or debris 14 are then properly disposed of in accordance with generally accepted practices.

Turning now to FIGS. 2A through 2E, a variations of a second embodiment of the invention will now be discussed which is suitable for treating large items or objects, such as elongate pipes, beams, conduits, polls, etc., which can not be placed completely inside the portable containment system 2. According to these embodiments, the cylindrical housing 4 is formed as at least two separate mating housing sections or components 54, 54' which, when mated together with one another, form a (cylindrical) housing 4 which completely surrounds an elongate portion or section of a object or surface to be treated. The (cylindrical) housing 4 has a desired diameter and length and is cut longitudinally along its length to form at least first and second separate housing sections or components 54, 54' which together generally form the (cylindrical) housing 4. That is, the (cylindrical) housing 4 may be longitudinally cut along its length into first and second generally 180 degree housing sections, may be longitudinally cut along its length into first, second and third generally 120 degree housing sections or components 54, 54', 54", or possibly smaller housing sections or components 54, 54', 54" . . . At least one and preferably a plurality of conventional hinges 26 are secured to outer surfaces of the at least two housing sections or components 54, 54', 54" to facilitate pivotally connection and opening and closing of the first and second housing sections or components 54, 54', 54" to one another about a desired section of the object or surface to be treated. As with the prior embodiments, conventional legs, staging and/or a framework (not shown) may be provided for supporting the portable containment system 2 during surface treatment. Alternatively, if the object to be treated is adequately supported, the portable containment system 2 can be supported by the object to be treated O.

At least one conventional latching mechanism 28 is provided on adjacent mating surfaces of the (cylindrical) housing 4 to facilitate retaining the first and second housing sections or components 54, 54', 54" in their closed position surrounding a desired portion or section of the object to be treated O during surface treatment. In addition, both opposed ends of the cylindrical housing 4, e.g., the opposed ends of the first and second housing sections or components 54, 54', 54", when in their closed positions, are provided with a suitable seal 52, such as an inflatable seal, for example, which, when inflated, adequately seals the entire periphery of the elongate the object to be treated so as to prevent the escape of blasting media, contaminants, dust and/or debris 14 between those components during surface treatment. In addition, each mating longitudinal edge of the first and/or second housings is provided with a suitable seal, such as an O-ring seal, a gasket seal, an inflatable seal, a brush seal 30, etc., to ensure that an air or fluid tight seal is formed therebetween to prevent the escape of blasting media, contaminants, dust and/or debris 14 between those mating components. Such seal 30 also facilitates creation of a negative pressure to the portable containment system 2 during the blasting process.

In addition, at least one of the first and second housing sections or components 54, 54', 54" has a tapered section, a conical section, a funnel section 55, etc., so as to facilitate funneling, channeling directing and/or collecting of the discharged blasting media as well as any removed substance(s), material(s), contaminant(s), hazardous material(s), debris 14, etc., into a lower most portion thereof to facilitate collection and removal thereof. One or more collection/removal opening(s) or outlet(s) are provided in the tapered, conical and/or funnel section 55 of the first or the second housing and a suction hose(s) 20 is connected thereto to facilitate conveying of the collected blasting media and/or the removed substance(s), material(s), contaminant(s), hazardous material(s), debris 14, etc., to suitable separation and regeneration equipment for regenerating the blasting media and disposal of the removed substance(s), material(s), contaminant(s), hazardous material(s), debris 14, etc.

At least one of the first and the second housing sections or components 54, 54' is provided with an elongate slot 44, for accommodating a blasting nozzle, and the viewing opening 32. The blasting nozzle is supported by a conventional pivot mechanism 48 which allows up and down as well as left and right pivoting movement of the blasting nozzle and this pivot mechanism 48 is supported by a pair of parallel longitudinal guides or tracks 50, one located on either side of the slot 44, to facilitate sliding and guiding the pivot mechanism 48 and the blasting nozzle along the entire length of the slot 44. The viewing opening 32 also generally extends along the entire length of the slot 44 to facilitate manipulation and control of the blasting nozzle.

Once a desired portion of the object or surface to be treated E has been treated, the portable containment system 2 is slide or moved axially along the elongate object to another section of the object or surface to be treated. If the resilient seal 52 is deflated in order to assist with moving the portable containment system 2 along the elongate object E, the resilient seal 52 is then reinflated prior to commencing further treatment of the object or surface to be treated E so as to adequately seal both opposed ends of the cylindrical housing 4. This process is repeated until the entire length of the elongate object E to be treated is adequately treated.

Figure 3A:
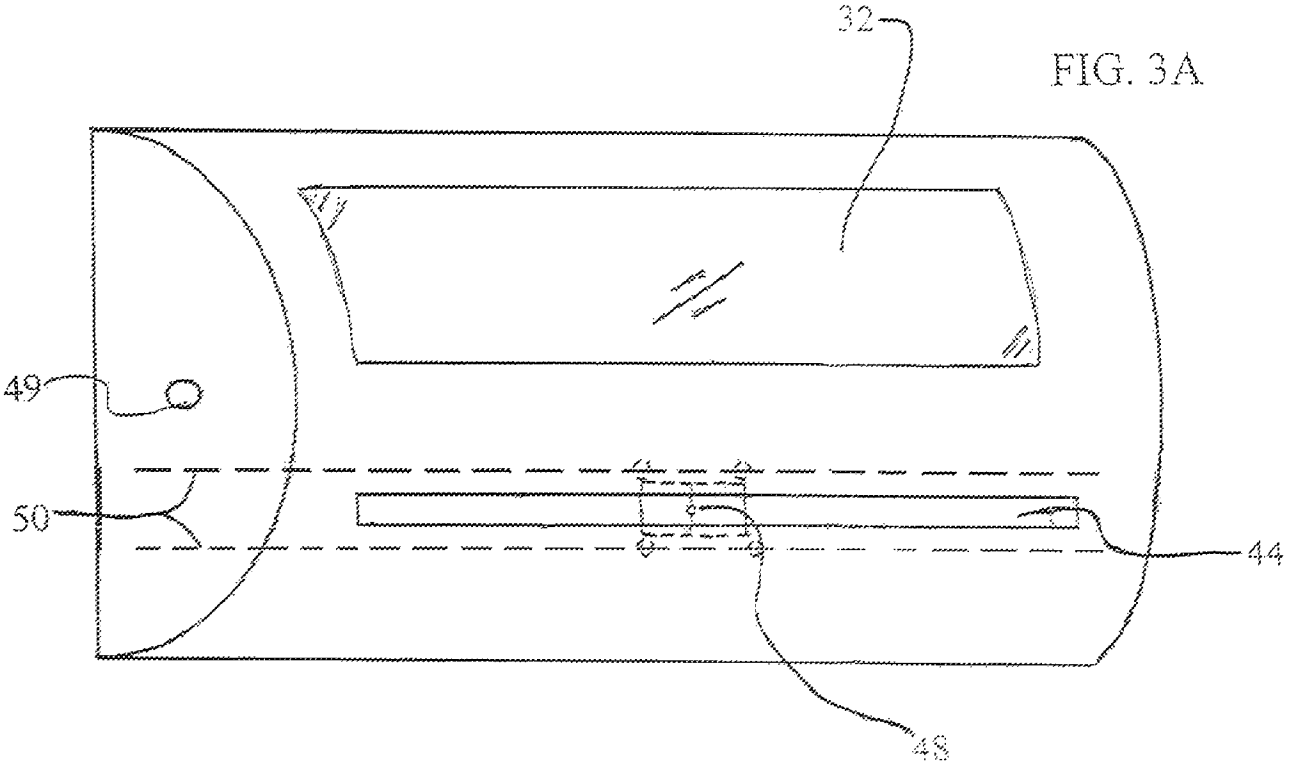
FIG. 3A is a diagrammatic end view showing a dome housing which is pivotal to housing component.
Figure 3B:
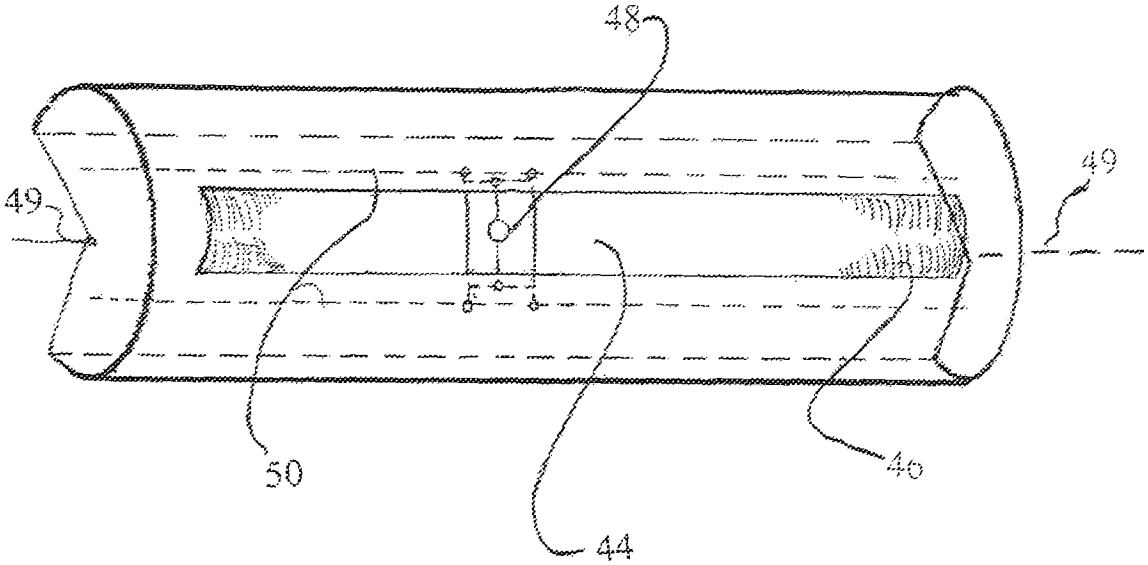
FIG. 3B is a diagrammatic view of a variation of the pivotal dome housing shown in FIG. 3A.
Figure 3C:
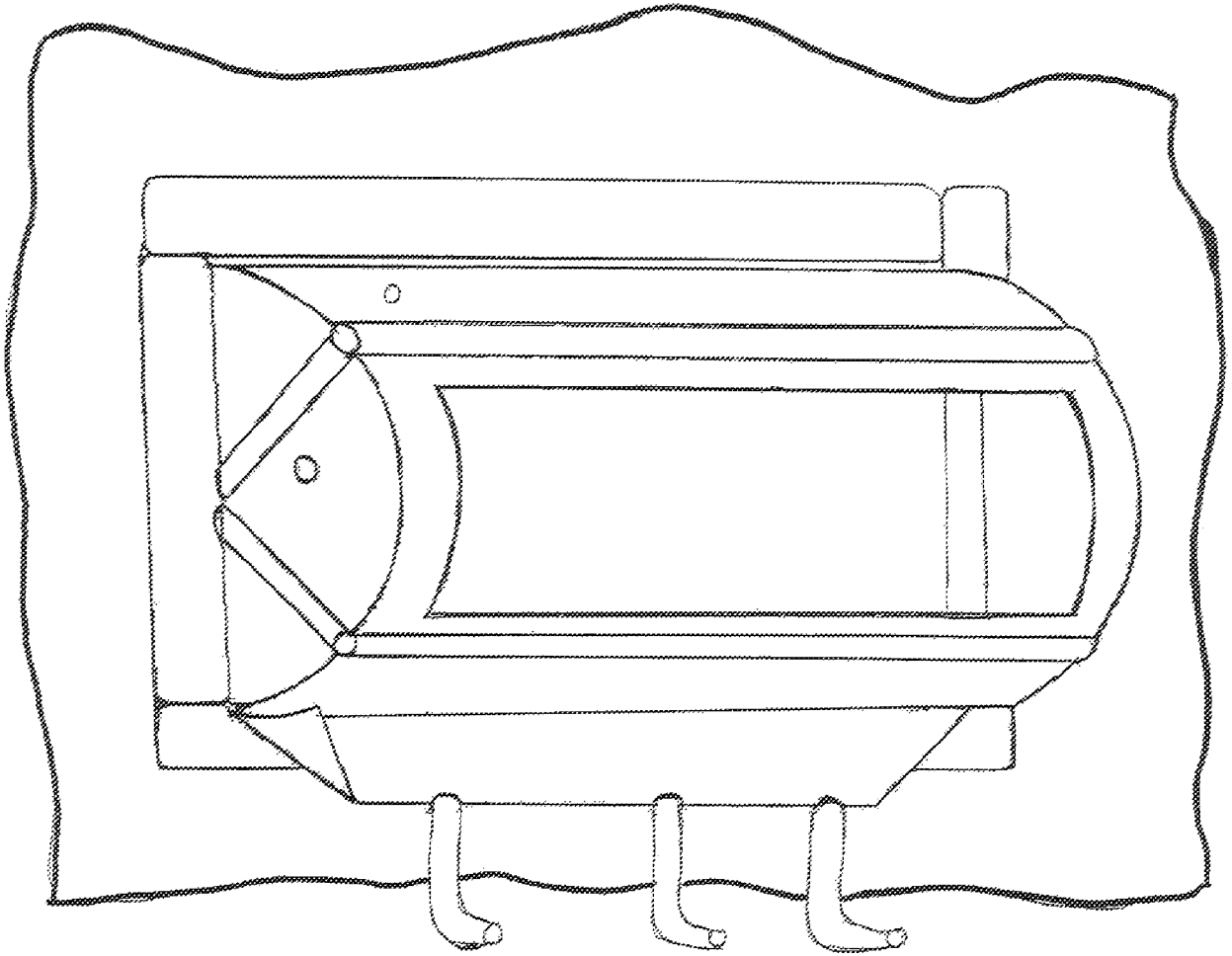
FIG. 3C is a diagrammatic view of a further variation of the pivotal dome housing shown in FIG. 3A.

As seen in FIG. 3A, both the elongate slot 44 and the viewing opening 32 are provided in a dome housing which is pivotable relative to at least one of the first and the second housing sections or components 54, 54' about a pivot 49. Such pivot 49 provides improved manipulation and control of the blasting nozzle during surface treatment. FIG. 3B shows a slight variation of the pivot arrangement of FIG. 3A in which both the elongate slot 44 and the viewing opening 32 are able pivotable about a pivot 49 with respect to one of the first and the second housing sections or components 54, 54' to improve the manipulation and control of the blasting nozzle during surface treatment. The exterior surface of the dome housing is seal with respect to the inwardly facing surface of the first and the second housing sections or components 54, 54 by a conventional seal. For both embodiments, a pair of parallel guides or tracks 50, one located on either side of the slot 44, to facilitate guiding the pivot mechanism 48 and the blasting nozzle along the entire length of the slot 44.

Figure 4:
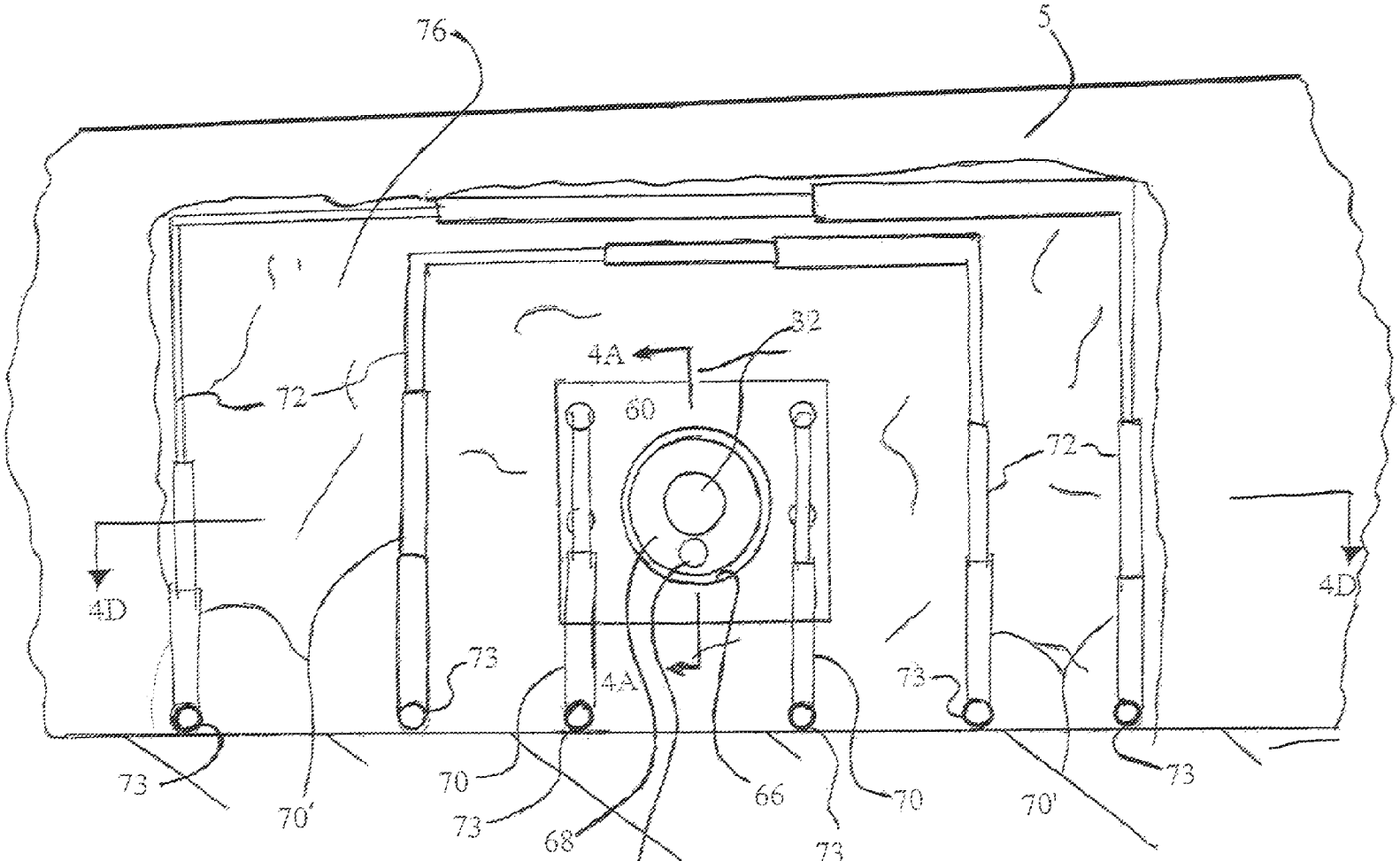
FIG. 4 is a diagrammatic rear elevational view of an embodiment of the containment barrier which incorporates a rigid support panel.
Figure 4B:
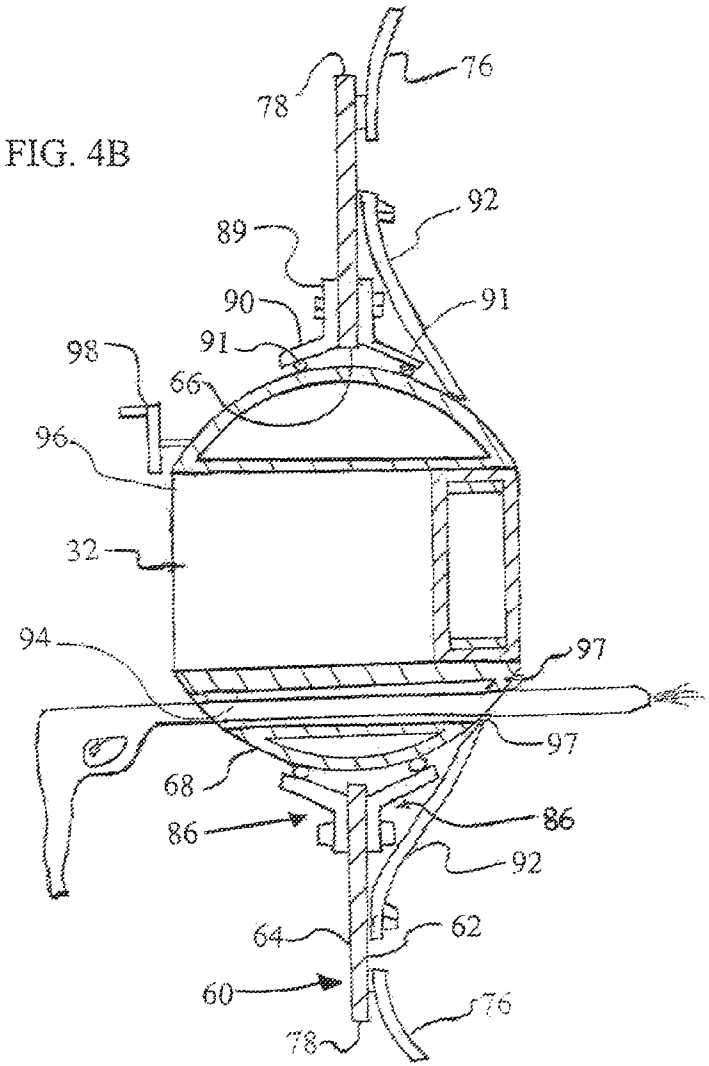
FIG. 4B is a diagrammatic cross sectional view, similar to FIG. 4A, for a hollow solid spherical orb.
Figure 4A:
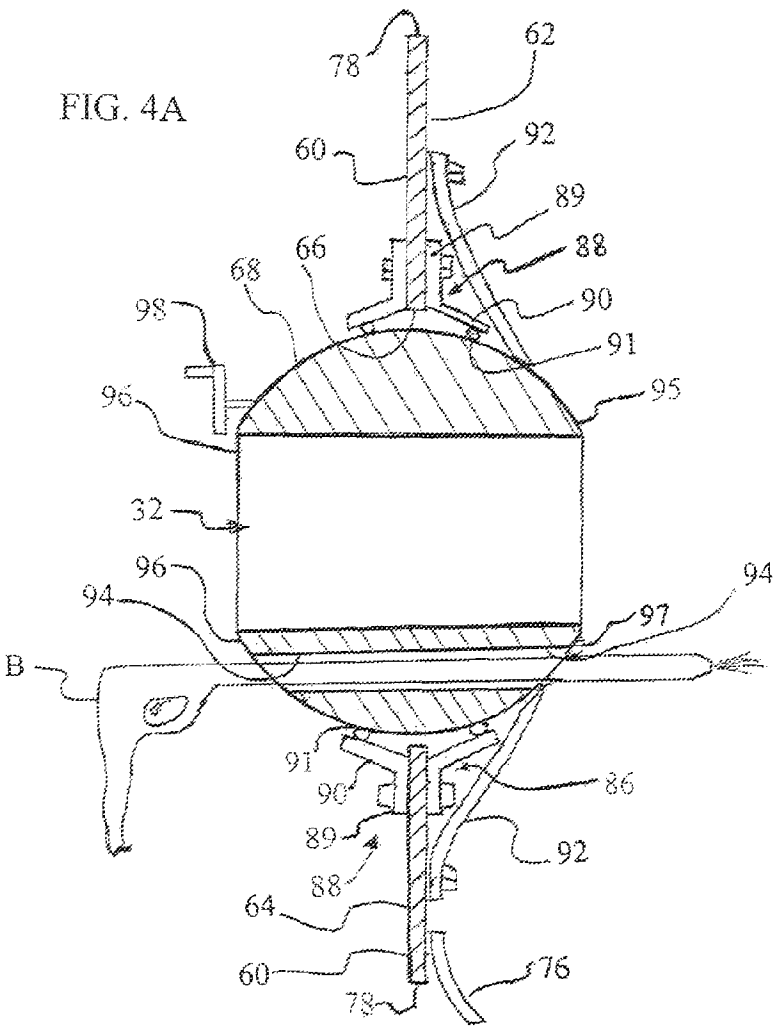
FIG. 4A is a diagrammatic cross sectional view of the containment barrier of FIG. 4 along section line 4A-4A of FIG. 4 having a solid spherical orb.
Figure 4E:
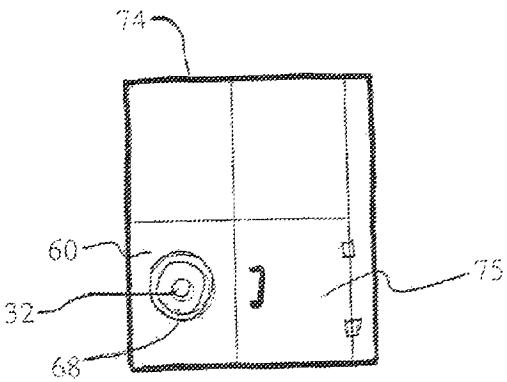
FIG. 4E is a diagrammatic view showing the rigid support panel incorporated into a rigid structure.
Figure 4C:
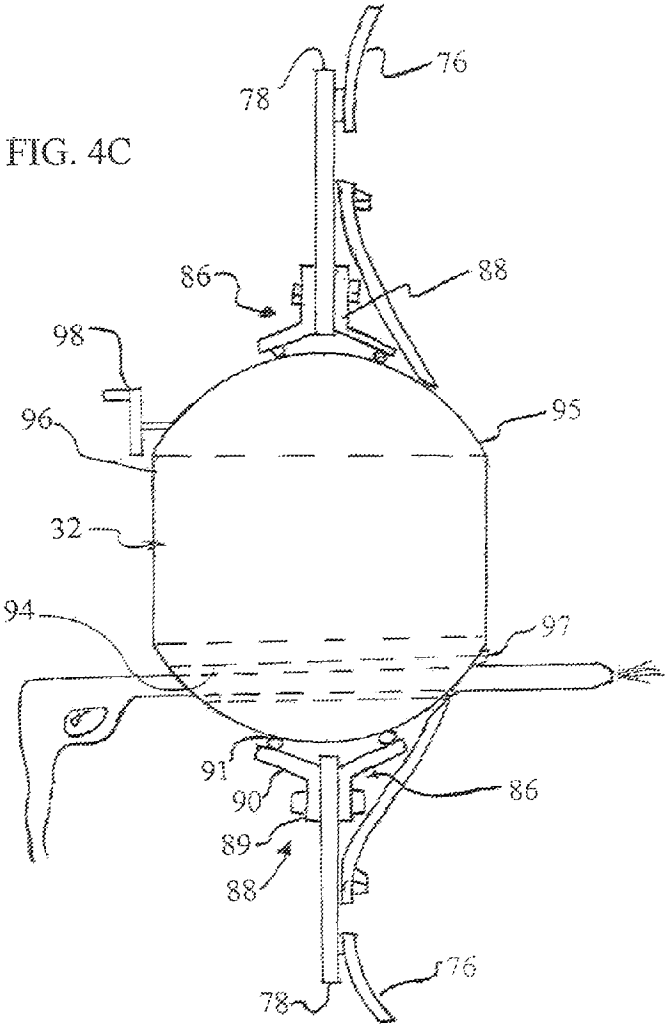
FIG. 4C is a diagrammatic side elevational view, similar to FIG. 4A, of the containment barrier of FIG. 4.
Figure 4D:
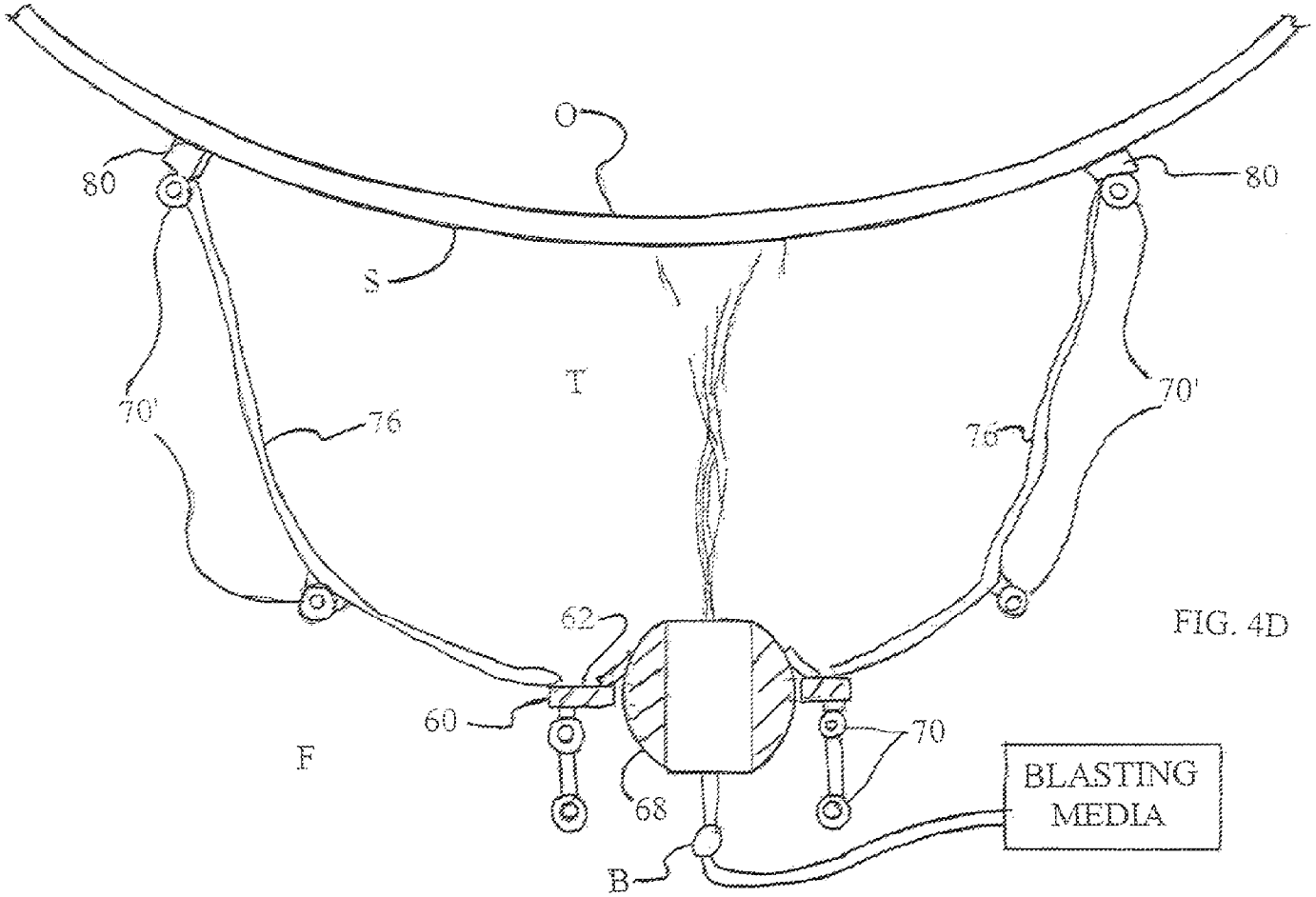
FIG. 4D is a diagrammatic cross sectional view of the containment barrier of FIG. 4 along section line 4D-4D of FIG. 4.

With reference now to FIGS. 4 through 4D, another embodiment of the containment barrier, which incorporates a rigid support panel 60, will now be discussed. According to this embodiment, the rigid support panel 60 may be generally planar or may have a curvature or some other desired shape or contour and includes a first inwardly facing surface 62 and a second outwardly facing surface 64. The rigid support panel 60 may be manufactured from metal or plastic, for example, and has a wall thickness of between about 1/32 inches and 3/8 about inches. The important aspect of the rigid support panel 60 is that it forms a rigid barrier, separating an enclosed treatment area T from a work area, and has a centrally located access aperture 66 formed therein which rotatably and pivotably supports a spherical orb 68, and a further description concerning function and purpose of the access aperture 66 and the spherical orb 68 will follow below.

A bottom surface of the rigid support panel 60 may be directly supported by a floor or some other support surface F or the rigid support panel 60 may be supported by either conventional staging, a fixed panel framework, an adjustable framework and/or a movable framework 70. In the event that the rigid support panel 60 is not directly supported by the floor F, then a portion of the outwardly facing surface 64 of the rigid support panel 60, remote from the access aperture 66, is coupled or connected to the framework 70 in a conventional manner, e.g., by an adhesive, mating nuts and bolts, welding, screws, etc., such that the framework 70 supports and retains the rigid support panel 60 in a desired orientation or position, e.g., substantially vertical, during use. It is to be appreciated that the framework 70 is connected to the rigid support panel 60 such that the framework 70 does not interfere with operation of the blasting equipment by the operator, e.g., the framework 70 is clear of the work area.

In the embodiment shown, the rigid support panel 60 is supported by conventional adjustable framework 70 which facilitates raising and lowering a vertical height of the rigid support panel 60 to adjust a relative height of the access aperture 66 and the spherical orb 68. A lower portion of most, if not all, of each frame members 72 carries at least one lockable wheel or roller 73, for example, which facilitates moving or rolling the framework 70, supporting the rigid support panel 60, to and fro along the floor or some other support surface F and reposition the rigid support panel 60 and the spherical orb 68 in a desired orientation, as necessary, by locking the wheels or rollers 73. Preferably at least each frame member 72 of the framework 70 comprises a conventional telescoping arrangement which facilitates a quick locking adjustment of the length of the frame member 72 to facilitate adjustment of the position and/or orientation of the rigid support panel 60 and the spherical orb 68. The frame members 72 are interconnected with one another in a conventional manner to provide a secure framework 70' for supporting the flexible barrier 76. For applications where movement or adjustment of the position and/or the orientation of the rigid support panel 60 and the spherical orb 68 is not required or desired, the rigid support panel 60 may be supported by a fixed framework 70 or conventional staging.

It is be appreciated that although the rigid support panel 60 is shown in the drawings as being in a substantially vertical orientation, the framework 70 may also support the rigid support panel 60 in a horizontal orientation or in tilted orientation, somewhere in between a vertical orientation and a horizontal orientation. Further, for applications where the object to be treated O is relatively small and easy and convenient to rotate or turn, the object to be treated O may be completely enclosed within a rigid structure 74 in which the rigid support panel 60 comprises one or more of the exterior panels which form the rigid structure 74 that completely encloses the object to be treated O (see FIG. 4E). An access door or panel 75 provides access to the interior of the rigid structure 74 to permit insertion and retrieval of the object to be treated O within the rigid structure 74 as well as turning and rotation of the object to be treated O, as necessary.

In a number of different application, the rigid support panel 60 does not comprise or form any part of a rigid structure 74. For those applications typically a flexible barrier 76 is secured or coupled about the entire perimeter edge 78 of the rigid support panel 60, in an overlapped or sealing manner, to prevent any blasting media, contaminants and/or debris 14 from escaping through the interface between the flexible barrier 76 and the perimeter edge 78 of the rigid support panel 60. The flexible barrier 76 may be sealingly secured to the entire perimeter edge 78 of the rigid support panel 60 by adhesive or clamping mechanism, for example. Alternatively, the flexible barrier 76 may be attached to the perimeter edge 78 of the rigid support panel 60 by a variety of other conventional fastening methods such as, mating hook and loop fasteners, mating zippers, buttons, snaps or any other well known fastening devices. For applications where the object to be treated O is relatively small such that a portion of the flexible barrier 76 can readily completely surround and/or encompass the object to be treated O, then the flexible barrier 76 together with the first inwardly facing surface 62 of the rigid support panel 60 and the floor or other support surface F all combine with one another to define an enclosed treatment area T for treating the object to be treated O. In applications where the object to be treated O is sufficiently large such that the flexible barrier 76 can not readily or completely surround and/or encompass the object to be treated O, the flexible barrier 76 together with the first inwardly facing surface 62 of the rigid support panel 60 and generally a surface S of the object to be treated O all combine with one another to define an enclosed treatment area T for treating the object to be treated O.

Figure 5B:
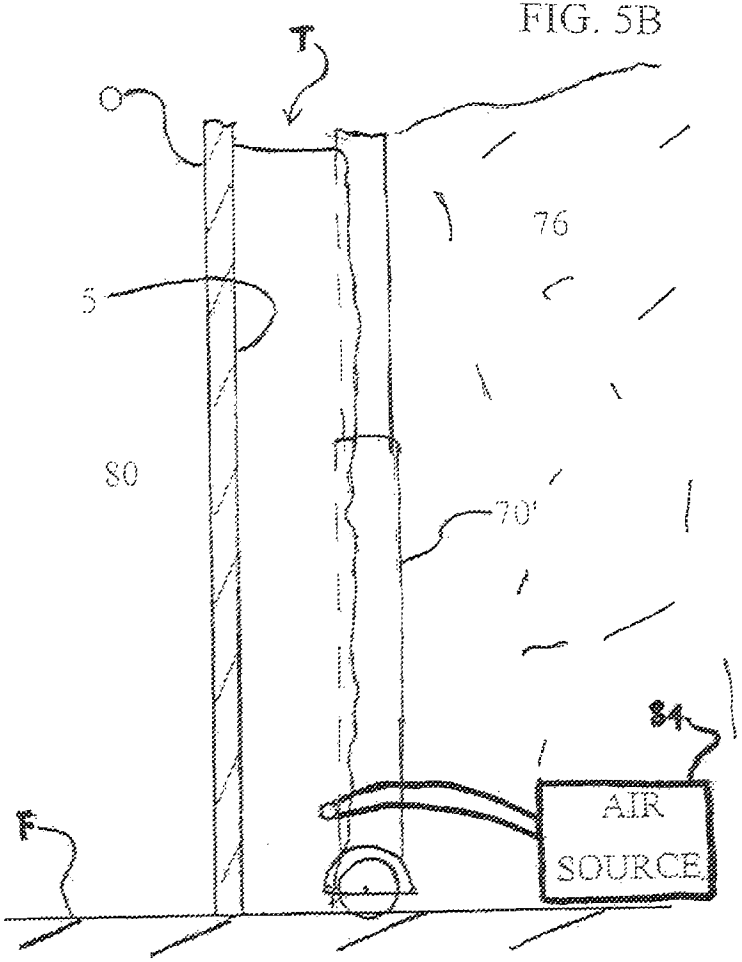
FIG. 5B is a diagrammatic view of an inflatable interface seal, formed integral with the flexible barrier, for sealing an interface between the flexible barrier and a surface of the object to be treated.
Figure 5A:
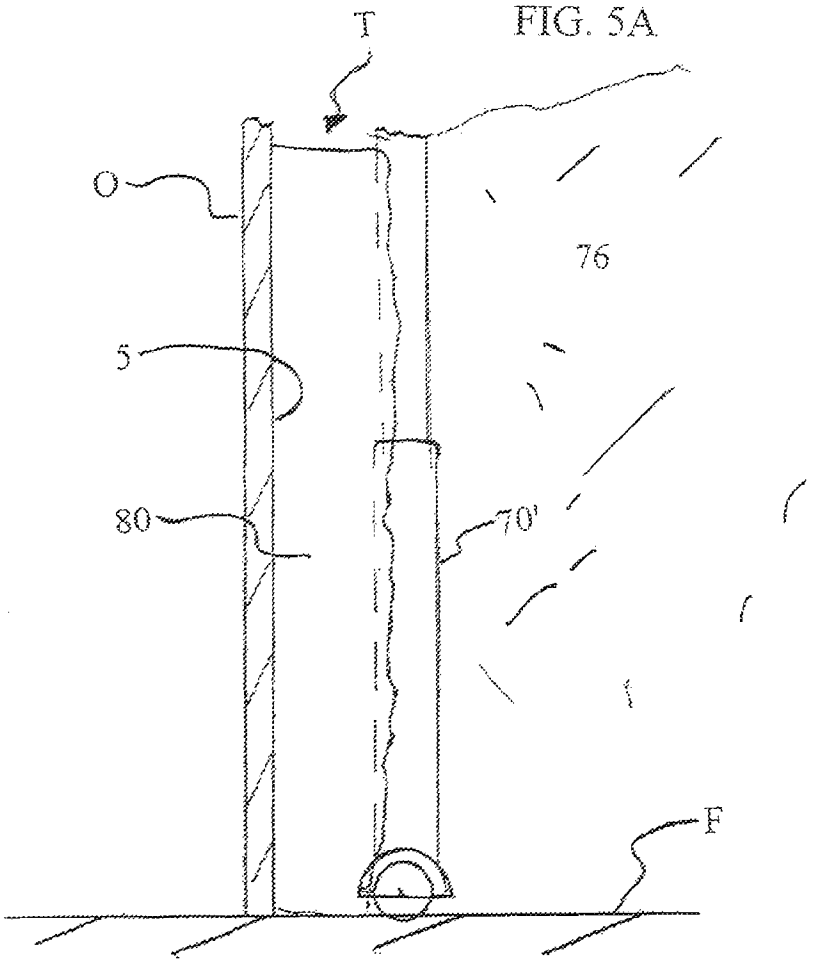
FIG. 5A is a diagrammatic view of a resilient sealing element for sealing an interface between the flexible barrier and a surface of the object to be treated.
Figure 6A:
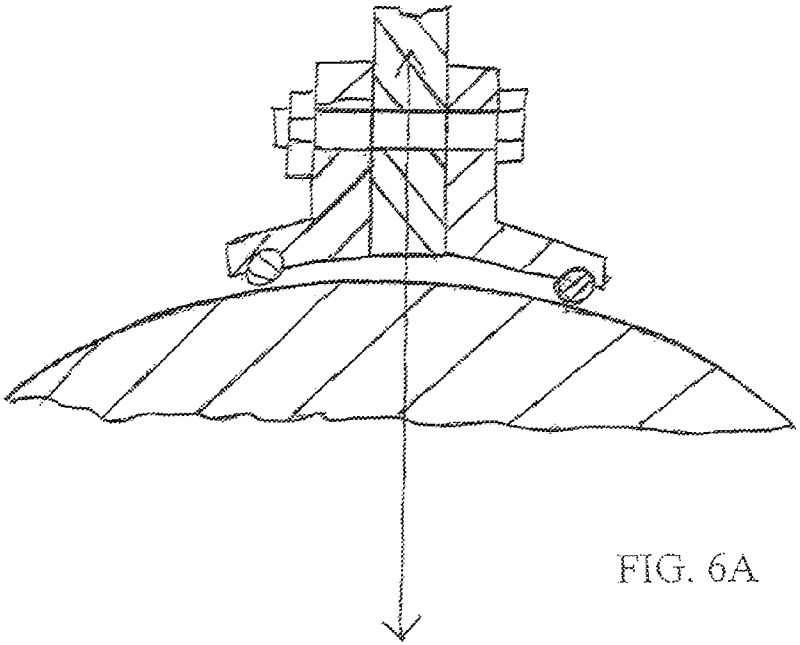
FIG. 6A is a diagrammatic cross sectional view of the support assembly supporting the bearings for retaining the spherical orb within the access aperture.
Figure 5C:
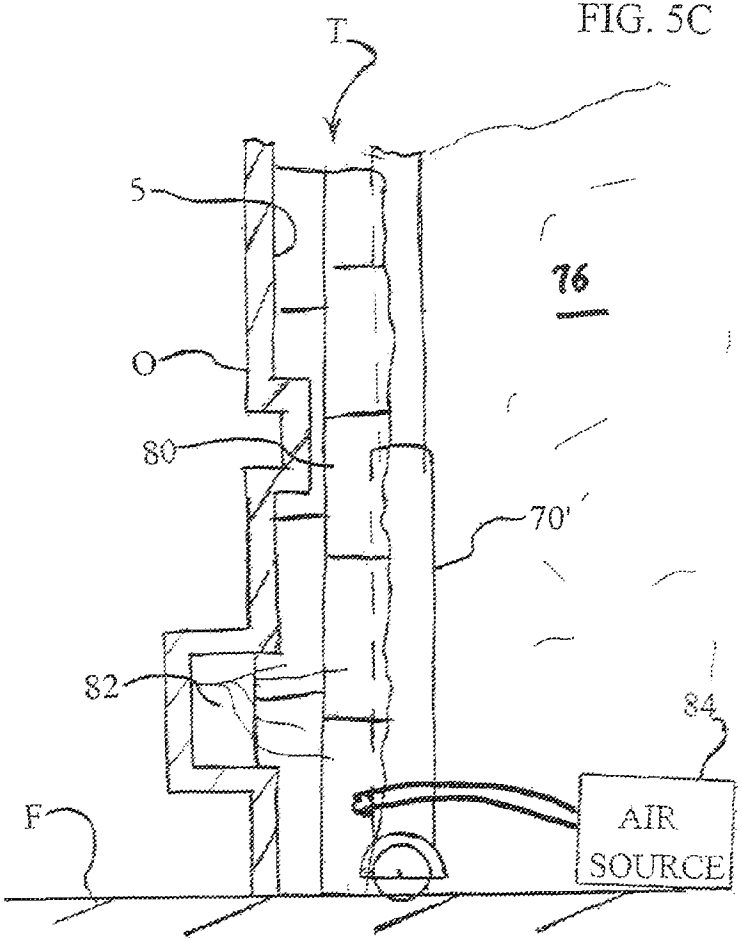
FIG. 5C is a diagrammatic view of an inflatable interface seal comprising a number of inflatable seal units for sealing an irregular interface between the flexible barrier and a surface of the object to be treated.

For applications where the surface S of the object to be treated O, along with the flexible barrier 76 and the first inwardly facing surface 62 of the rigid support panel 60, is utilized to define the enclosed treatment area T, an adequate seal must be achieved at an interface I between the perimeter of the surface S of the object to be treated O and the perimeter of the flexible barrier 76 located closely adjacent the surface to be treated O (see FIGS. 5A-5C). Where the flexible barrier 76 rests on the floor or other support surface F, an adequate seal is generally achieved between the flexible barrier 76 and the floor due to gravity and thus a further seal is not generally required.

A flexible barrier framework 70 is provided for supporting the remote ends of the flexible barrier 76 closely adjacent the surface to be treated O. The flexible barrier 76 is attached to the flexible barrier framework 70', at spaced intervals, by a conventional fastener such as mating hook and loop fasteners, ties, buttons, snaps or any other known fastening devices. As shown in FIGS. 5A-5C, an inflatable interface seal, or some other resilient sealing element 80, is positioned between the remote perimeter end of the flexible barrier 76 and the perimeter of the surface S of the object to be treated O and, once inflated, forms an adequate seal which seals that perimeter interface I. It is important to note that the interface seal 80 must completely fill the interface I, e.g., the gap or the space, between the perimeter of the surface of the object to be treated O and the perimeter of the flexible barrier 76 located closely adjacent the surface to be treated O. The entire perimeter of the flexible barrier 76 may have a perimeter inflatable interface seal 80 integrally formed therein so that, once the flexible barrier framework 70' is suitably positioned along and adjacent the surface to be treated O such that the remote perimeter end of the flexible barrier 76 is positioned closely adjacent the surface to be treated O, e.g., spaced therefrom by a only few inches or so by the flexible barrier framework 70, pressurized air can be supplied to the integral inflatable seal, from a pressurized air source 84, to inflate the inflatable interface seal 80 and form an airtight seal about the entire perimeter interface I of the surface S of the object to be treated O.

Once that portion of the object or surface to be treated O is treated, the supply of pressurized air to the inflatable seal may be interrupted or discontinued so that the inflatable interface seal 80 at least partially deflates. The operator then releases the locking wheels of the framework 70, 70' and moves and repositions the rigid support panel 60 to another desired section of the object or the surface to be treated O. The flexible barrier framework 70' is also suitable repositioned along with the flexible barrier 76 to the other desired section of the object or the surface to be treated O and the inflatable interface seal 80 is then reinflated to form a desired perimeter seal prior to commencing further treatment of the object or surface to be treated O. This process is repeated until either the entire object is treated or the entire desired surface area of the object or surface is adequately treated.

As noted above, regardless of whether or not the interface seal 80 is inflatable, the important aspect of the interface seal 80 is that it completely seals the interface I, e.g., the gap or the space, between the perimeter of the surface of the object to be treated O and the perimeter of the flexible barrier 76 located closely adjacent the surface to be treated O so as to prevent the escape of any blasting media, dust, contaminants and/or debris 14 between those components during the treatment process.

The enclosed treatment area T forms a completely closed chamber, for the surface or the object being treated O, so that as the surface S or the object being treated O with blasting media, all of the discharged blasting media and removed debris 14 and/or other contaminates, such as paint, oil, grease, rust, oxidation, corrosion, etc., removed from the surface or the object being treated are totally confined within the enclosed treatment area T and thus are prevented from rebounding and/or escaping into the surrounding environment. By completely enclosing either the entire object to be treated O, or at least the surface of the object to be treated O, within the enclosed treatment area T, this facilitates collection of all of the utilized blasting media as well as collection of all of the removed substance(s), material(s), contaminant(s), hazardous material(s), debris 14, etc., within a relatively confined area by a collection device, such as a vacuum. As is known in the art, the collected blasting media, contaminates and/or debris 14 can then be conveyed to a recycling system or mechanism where the recyclable blasting media is removed and separated from the contaminates and/or debris 14 so that the recyclable blasting media can then be subsequent recycled and regenerated for subsequent reuse while the contaminates and/or debris 14 can be properly disposed of in a conventional manner.

The flexible barrier 76 may be a tarp, a cloth or a plastic sheet. Preferably at least a portion of the flexible barrier 76, if not the entire flexible barrier 76, is transparent or translucent so as to at least permit light, located outside the enclosed treatment area T, to pass through the flexible barrier and illuminate the object to be treated O as well as facilitate viewing of the surface treatment process by an operator or some other personnel. By utilizing a transparent or translucent flexible barrier 76, this minimizes the illumination requirements inside the enclosed treatment area T.

It is to be appreciated that the inflatable interface seal 80 may be a single inflatable structure or a plurality of separately inflatable seal units 82 (see FIG. 5C). By utilizing a number of inflatable seal units 82 which are separate form one another and/or interconnected with one another, a variety of barrier configurations are possible and such inflatable seal units 82 can accommodate uneven or irregular surfaces of the object to be treated O. The inflatable seal units 82 may be attached to the flexible barrier framework 70 or incorporated into perimeter of the flexible barrier 76 and inflated by a pressurized air source 84. As the inflatable seal units 82 inflated and expand, they mold or conform to the exterior shape and/or contour of surface of the object to be treated O and form a fairly tight seal therewith thereby sealing the enclosed treatment area T. The inflatable seal units 82 may be manufacture from rubber, vinyl, plastic, urethane, PVC, or any other conventional air-tight expandable material.

The inflatable seal units 82 may be manufactured in a number of different sizes and shapes to accommodate a variety of different profiles and configurations of the objects to be treated O. As seen in FIG. 5C, when inflated, the inflatable seal units 82 can have an elongate tubular shape and may be curved or straight. Barrier units 82 can be virtually any shape so long as they form an adequate seal between the flexible barrier 76 and the surface of the object to be treated O.

The access aperture 66 is typically circular in shape and has a diameter of between a few inches to about fifty inches or so and more preferably has a diameter of between about three inches and 12 about inches. The spherical orb 68, having a diameter that is slightly less than the diameter of the access aperture 66, is accommodated within the access aperture 66 in a pivotable/rotatable fashion. The diameter of the spherical orb 68 is typically between about a half an inch or to about a few inches or so smaller than the diameter of the access aperture 66 so that the spherical orb 68 substantially fills the access aperture 66. The small difference in the diameters, between the access aperture 66 and the spherical orb 68, result in a peripheral gap of between about 1/32 and about 1/2 inches between those two components which permits free movement of the spherical orb 68 relative to the access aperture 66 of the rigid support panel 60.

A plurality of spaced apart bearings 86 are provided to facilitate permanent retention of the spherical orb 68, within the access aperture 66, while still permitting the desired free movement of the spherical orb 68. Generally at least three or more pairs of spaced apart bearings 86 are provided for retaining the spherical orb 68 within the access aperture 66. As a result of this arrangement, the largest diameter portion D of the spherical orb 68 is positioned between each pair of spaced apart bearings 86 so that each pair of bearings 86 sandwiches the spherical orb 68 therebetween and permanently retains the spherical orb 68 within the access aperture 66 while still permitting the desired movement, e.g., pivoting and rotation, of the spherical orb 68 relative to the rigid support panel 60. That is, the at least three pairs of bearings 86 generally maintain the spherical orb 68 centered within the access aperture 66 while facilitating the desired motion.

Each bearing a secured to a support assembly 88, as shown in FIGS. 4A, 4B, 4C and 6A, and each support assembly 88 generally comprises an angled member having a first limb 89 affixed to a surface of the rigid support panel 60, by a conventional fastener such as an adhesive, screws, rivets, welding, etc., while a second limb 90 thereof extends radially inward along the exterior surface of the spherical orb 68 a short distance. At least one bearing member 91 and preferably two or more bearing members 91 are supported by an inwardly facing surface of the second limb 90. Each bearing member 91 is secured so as to contact and facilitate rolling against the exterior surface of the spherical orb 68 and facilitate rolling movement of the spherical orb 68. The bearing members 91 are normally conventional roller bearings, however, a castor or some other type of bearing or, alternatively, a low friction bearing surface may be supported by the inwardly facing surface of the second limb 90. The important feature of the bearing members 91 is that they facilitate retention and centering of the spherical orb 68, within the access aperture 66 between the inwardly and the outwardly facing surfaces 62, 64 of the rigid support panel 60, while, at the same time, allowing the spherical orb 68 to pivot and/or rotate relative to the rigid support panel 60, e.g., the spherical orb 68 has substantially a 180 degree range of motion in a first direction, e.g., horizontal, and also has a 180 degree range of motion in a second direction normal to the first direction, e.g., vertical, and well as having a range of motion for all locations therebetween.

The plurality of bearings 86 captively retain the spherical orb 68 within the access aperture 66 while permitting the spherical orb 68 to pivot up and down, pivot left and right as well as rotate relative to the rigid support panel 60 to allow adequate of discharge of the blasting media when treating a surface to be treated O. A perimeter bearing seal 92, e.g., an air impermeable seal, is secured to the inwardly facing surface 62 of the rigid support panel 60 and this seal extends radially inward and over each of the plurality of spaced apart bearings 86 and overlaps a portion of the spherical orb 68 located adjacent the access aperture 66. This perimeter bearing seal 92 completely covers and seal all of the bearings 86 as well as the entire peripheral gap formed between the access aperture 66 and the spherical orb 68. This perimeter bearing seal 92 prevents the passage of any discharged blasting media, contaminants and/or other debris 14 from escaping the enclosed treatment area T, during surface treatment, between peripheral gap formed between the rigid support panel 60 and the spherical orb 68 and/or ensures that operation of the bearings 86 are not fouled or disrupted by the discharged blasting media, contaminants and/or other debris 14.

The perimeter bearing seal 92 can be manufactured from a variety of materials that permits rotation of the spherical orb 68 relative to the rigid support panel 60 while, at the same time, also provides and maintains an adequate seal between the rigid support panel 60 and an exterior surface of the spherical orb 68. As shown in FIGS. 4, 4A and 4B, the perimeter bearing seal 92 comprises a plurality of sealing members which form a brush seal. The bristles of the brush seal are slightly longer than the dimensions of the peripheral gap, e.g., have a length of between about 1/32 and about 1/2 inches or so to form a suitable seal.

Figure 6B:
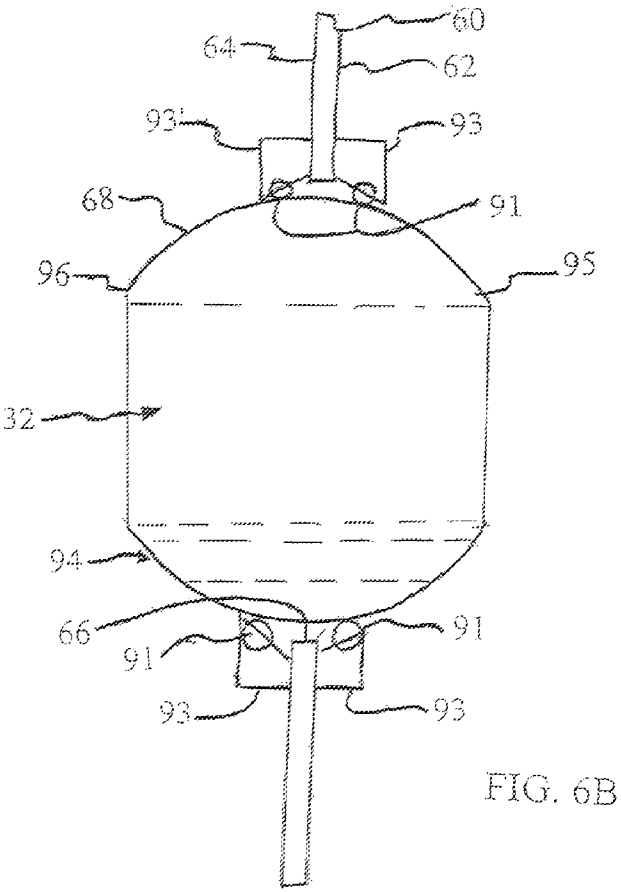
FIG. 6B is a diagrammatic cross sectional view of a pair of retaining rings for retaining the spherical orb within the access aperture.

According to an alternative embodiment shown in FIG. 6B, the spherical orb 68 could be supported by first and second retaining rings 93, 93' which each have a diameter slightly larger than the diameter of the access aperture 66. The first retaining ring 93 is secured to the inwardly facing surface 62 of the rigid support panel 60 closely adjacent and surrounding the access aperture 66 while the second retaining ring 93' is secured to the outwardly facing surface 64 of the rigid support panel 60 closely adjacent and surrounding the access aperture 66. The inwardly facing surface of each of the first and second retaining rings 93, 93 each support either a low friction bearing surface or a plurality of spaced apart bearing members 91 which engage with the exterior surface of the spherical orb 68. The first and second retaining rings sandwich the largest diameter section of the spherical orb 68 therebetween so as to retain the spherical orb 68 within the access aperture 66 while still permitting the desired pivoting and/or rotational movement of the spherical orb 68.

As can be seen in FIGS. 4A-4C for example, the spherical orb 68 has a port 94 that extends completely therethrough from the from the inwardly facing surface 95 of the spherical orb 68 to the outwardly facing surface 96 of the spherical orb 68. This port 94 is sized to accommodate a conventional blasting nozzle, or some other surface treatment equipment B, which passes therethrough and extends into the enclosed treatment area T thus enabling blasting media to be conveyed through the spherical orb 68 and discharged within the enclosed treatment area T for treating the object or the surface the object to be treated O from outside the enclosed treatment area T. The port 94 may have has a diameter of between about 1 inch and about 4 inches.

The port 94 is adequately sized such that the blasting nozzle B can be inserted into and withdrawn from the port 94 while, at the same time, the exterior surface of the blasting nozzle B and the inwardly facing surface of the port 94 prevent the escape of discharged and airborne blasting media, dust, contaminates and/or debris 14 from exiting through the port 94 to the surrounding environment. In order to seal such interface, a perimeter seal 97 may be provided around the opening of the port 94 formed in the inwardly facing surface 95 of the spherical orb 68 to facilitate sealing of the blasting nozzle B as the blasting nozzle B passes through the port 94 and enters the enclosed treatment area T. Such seal 97 would also permit the operator to insert and move the blasting nozzle B to and fro, along the port 94, for controlling the spacing of a tip of the blasting nozzle B from the surface or the object to be treated O while also permitting removal of the blasting nozzle B.

As can be seen in FIGS. 4A, 48 and 4C for example, the outwardly facing surface 96 of the spherical orb 68 may be provided with a knob, a steering wheel or some other control and/or manipulation device 98 which facilitates control and/or manipulation of the spherical orb 68 by the operator. The control and/or manipulation device permits the operator to pivot up, down, left and/or right and/or rotate or turn the spherical orb 68, relative to the rigid support panel 60, so that the spherical orb 68 has a substantially 180 degree range of motion in a first direction as well as substantially 180 degree range of motion in a second direction which is normal to the first direction. Alternatively, the control and/or manipulation device 98 may be eliminated and the operator may merely manipulate the blasting nozzle B to facilitate control of the pivoting movement or motion of the spherical orb 68.

The spherical orb 68 may be either a hollow orb (see FIG. 4B) or a solid orb (see FIG. 4A). An important aspect of the spherical orb 68 is that it is sufficient easy to manipulate by the operator once the spherical orb 68 is captively retained within the access aperture 66 of the rigid support panel 60. As shown in FIGS. 4A and 4B, for example, the spherical orb 68 is provided with a viewing aperture 32 which extends completely through the spherical orb 68 from the inwardly facing surface 62 to the outwardly facing surface, e.g., extends through a central section of the spherical orb 68 generally along a diameter thereof. The viewing aperture 32 provides a vision or a line of sight through the spherical orb 68 which enables the operator, of the surface treatment equipment, to view the object or the surface being treated which is located inside the enclosed treatment area T. If the spherical orb 68 is solid, a through hole is formed therein to from the view aperture while if the spherical orb 68 is hollow, a cylindrical tube extends therethrough to from the view aperture.

The viewing aperture 32 may be circular in shape and have a diameter of between about 4 inches and about 60 inches. A transparent window 99, e.g., glass or plexiglass, is accommodated within and seals the viewing aperture 32 to separate the enclosed treatment area T from the surrounding environment. The transparent window 99 is normally located within the viewing aperture 32 and may be adjacent to, but spaced from, the inwardly facing surface 95 of the spherical orb 68, e.g., the transparent window 99 is typically recessed within the viewing aperture 32 by at least a few inches or so away from the inwardly facing surface 95 of the spherical orb 68.

A replaceable outer transparent cover 100 covers the inwardly facing surface opening of the viewing aperture 32 to protect the transparent window 99 from becoming scraped and scratched by the rebounding media and removed contaminants and/or debris 14. This transparent cover 100, once its exterior surface becomes sufficiently scratched and/or scraped, such that the line of sight of the operator through the spherical orb 68 is sufficiently blurred, can be replaced with a new transparent cover 100. To extend the operational life of the transparent cover and minimize the amount of scratching and/or scraping of the transparent cover, the transparent cover 100 is resilient retained, by a resilient element, within the opening of the viewing aperture 32 substantially flush with the inwardly facing surface 95 of the spherical orb 68 (see FIG. 7A). Such resilient retention allows the transparent cover 100 to flex inward somewhat and absorb some of the impact force, from the rebounding blasting media, removed contaminants and/or debris 14 while also preventing any rebounding blasting media, removed contaminants and/or debris 14 from entering the view aperture 32. This inwardly flexing and absorption of the transparent cover 100 renders the transparent cover 100 somewhat less susceptible to being scratched and/or scraped by the blasting media, contaminants and/or debris 14 during the surface treatment process. Even by using a resilient retention of the transparent cover, the transparent cover still must be removed and replaced with a new transparent cover 100 once it becomes sufficiently scratched and/or scraped but the transparent cover is generally less expensive than the transparent window and is easier and more cost effective to replace peroidically.

Figure 7B:
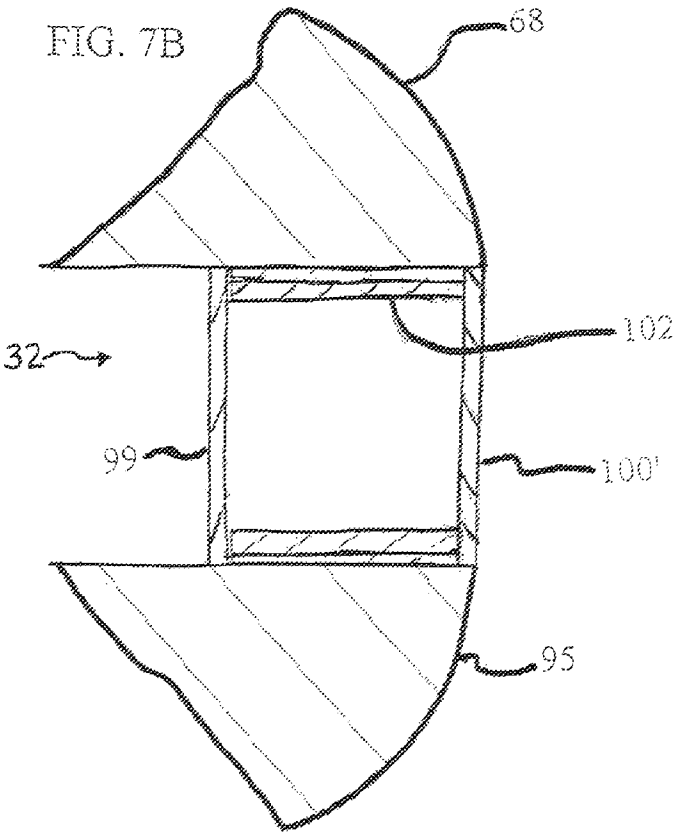
FIG. 7B is an exploded partial diagrammatic cross sectional view showing a resilient element which retains a flexible transparent cover within the viewing aperture.
Figure 7A:
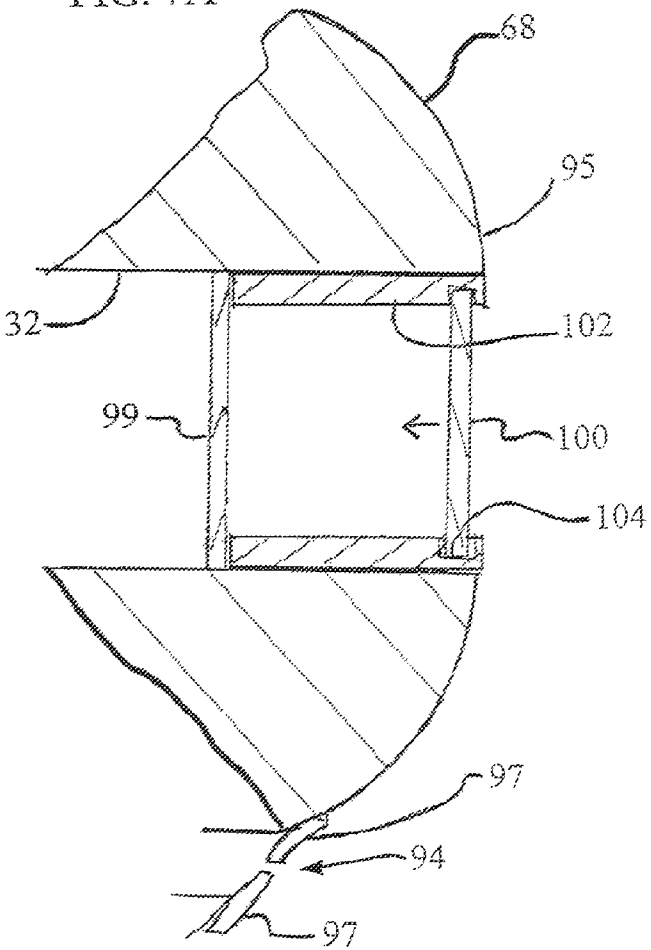
FIG. 7A is an exploded partial diagrammatic cross sectional view showing a resilient element with an annular groove which retains a rigid transparent cover within the viewing aperture.

As can been seen in FIG. 7A, the resilient element 102 may comprise a washer or a ring which is size to be received within the viewing aperture 32, between the transparent window and the transparent cover and provide a shocking absorbing effect to the transparent cover during treatment. That is, the resilient element 102 has a slightly large diameter than the diameter of the viewing aperture 32 such that the resilient element 102 is releasbly retained within the viewing aperture 32. A leading end of the resilient element 102 has an annular groove 104 therein which releasably retains a rigid transparent cover 100 therein to facilitate retention of the transparent cover during treatment. The resilient element 102 may abut against the transparent window 99 while still permitting the transparent cover 100 to flex inward and absorb some of the impact during treatment. Once the transparent cover 100 becomes sufficiently pitted, nicked, scratched, scraped or otherwise damaged, both the resilient element 102 and the transparent cover 100 are removed for the viewing aperture 32 and then the scratched and/or scraped transparent cover 100 is removed from the annular groove 104 of the resilient element 102 and a new transparent cover 100 is accommodated therein and then the resilient element 102 and the new transparent cover 100 are insert into the viewing aperture 32.

Alternatively, as shown in FIG. 7B, the transparent cover 100' may be flexible and be sandwiched between a radially outwardly facing surface of the resilient element 102 and an inwardly facing surface of the viewing aperture 32 such that the flexibility of the transparent cover 100' and/or the resilient element 102 provide the shocking absorbing effect to the transparent cover 100', during surface treatment. As with the previous embodiment, the resilient element 102 may abut against the transparent window 99. Once the transparent cover 100 becomes sufficiently pitted, nicked, scratched, scraped or otherwise damaged, both the resilient element 102 and the transparent cover 100' are removed for the viewing aperture 32 and then the scratched and/or scraped transparent cover 100' is removed and replaced with a new transparent cover 100' and the resilient element 102 and the new transparent cover 100' are then insert into the viewing aperture 32.

The resilient element 102 may be made from rubber or some other rubberized material and comprise an O-ring or a gasket, for example. An important aspect is that the resilient element 102 be sufficiently soft and/or resilient so it can at least partially absorb the impact forces placed thereon by the rebounding blasting media, removed contaminants and/or debris 14. The resilient element 102 generally has a fairly thin profile so as not to obstruct the line of sight through the viewing openings in the spherical orb 68.

Figure 8B:
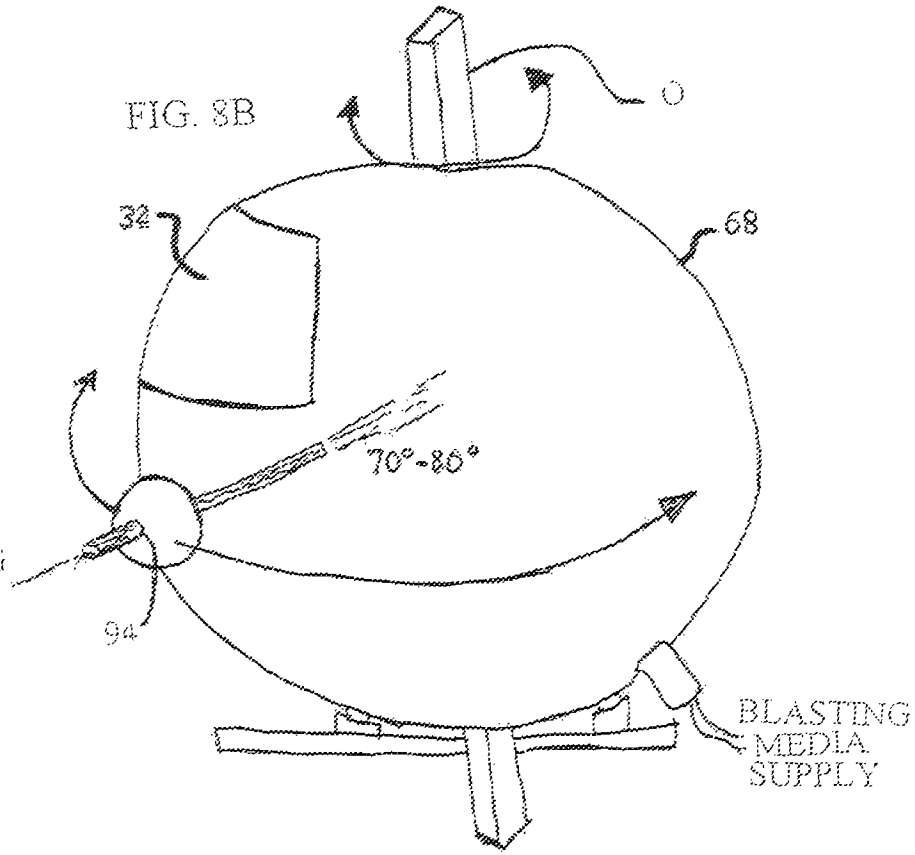
FIG. 8B diagrammatically shows a variation of the embodiment of FIG. 8A.
Figure 8A:
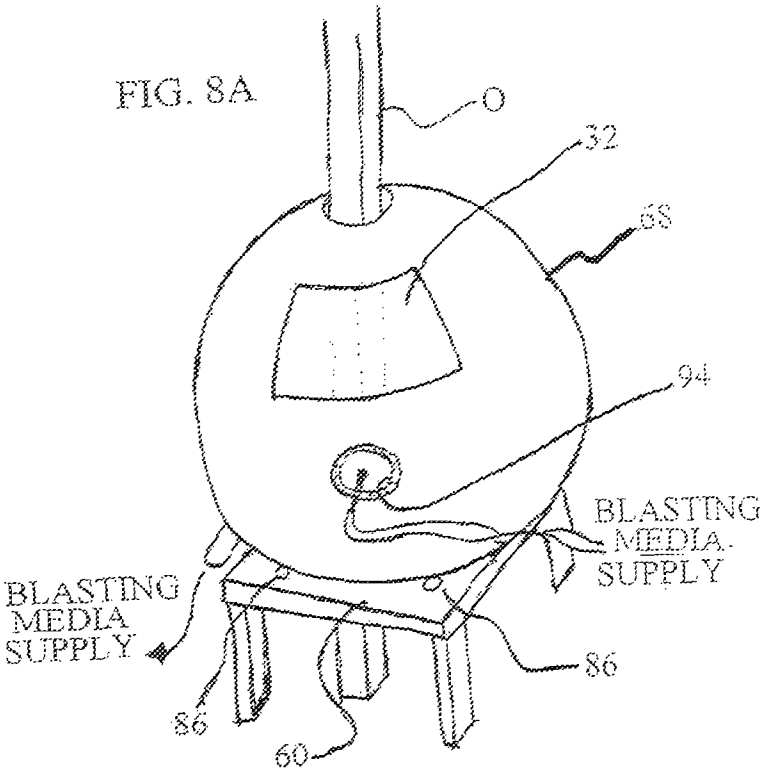
FIG. 8A diagrammatically shows an embodiment having a spherical orb 68 supported by a base.

The transparent cover 100, 100' can be made from a variety of different materials such as PVC, glass, plexiglass, a flexible plastic film, or any other currently available transparent material. As noted above, since the transparent cover 100, 100' will be replaced fairly frequently, the transparent cover 100, 100' is preferably inexpensive Yet another embodiment is shown in FIGS. 8A and 8B. According to this embodiment, the containment barrier 2 comprises a spherical orb 68 that is supported by a base to be rotated around an object to be treated O. This embodiment is particularly effective on treating vertically extending objects such as posts, pipes, poles, columns and beams with a blasting media. The spherical orb 68 completely isolates an enclosed treatment area T from the exterior working area such that used blasting media and/or contamination particulate is contained within the orb.

The spherical orb 68 is made of two or more spherical shell portions 104, 104'. When the edges of the spherical shell portions 104, 104' are coupled and fixed together, they form the spherical orb 68. The orb is typically spherical, however any other three dimensional shape can be utilized in a manner similar to this embodiment. The spherical orb 68 could be for example, an ellipsoid, a cube, a cylinder or a prism. As with the previous embodiments, the spherical orb 68 is equipped with a viewing aperture 32, a port 94 adequately sized such that the B can be inserted into and withdrawn therefrom, and a plurality of bearings 86 permitting the spherical orb 68 to rotate relative to the support panel 60.

Figure 9:
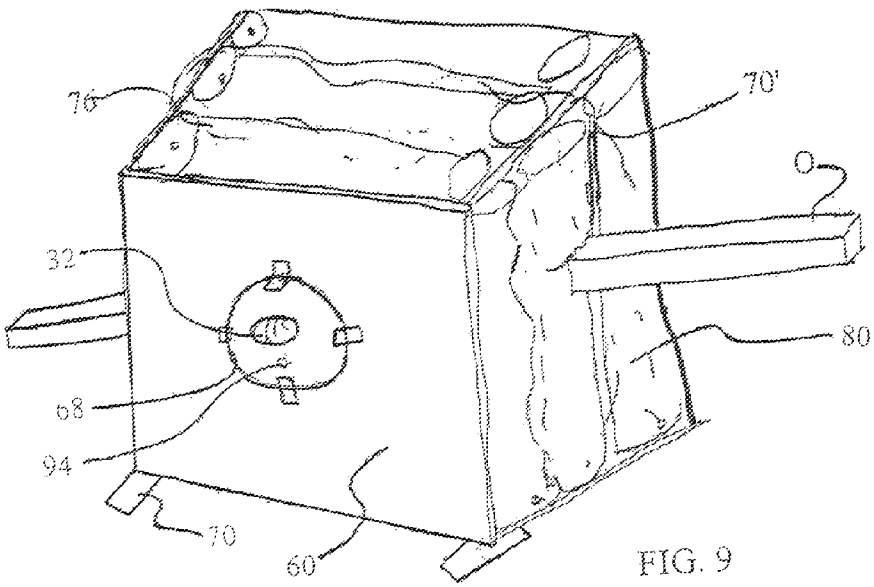
FIG. 9 is a diagrammatic view showing use of the containment barrier to treat an elongate object.

As seen in FIG. 9, elongate objects, such as I beams, elongate shafts or poles, support structures, etc., can also be treated by the present invention. For example, a first section of an elongate beam is treated by arranging the rigid support panel 60 and the flexible barrier framework 70' along a first section of the beam and the draping the flexible barrier 76 over the framework 70' and around the beam to completely enclose that first section of the beam. An interface seal 80 is then provided at each opposed end of the first section to form a seal between the perimeter of the beam to be treated O and the perimeter of the flexible barrier 76 located closely adjacent the beam to prevent the escape of blasting media, dust, contaminants and/or debris 14 between those components during the treatment process. Once that first section of the beam is adequately treated, the rigid support panel 60 and the flexible barrier framework 70' are then moved along to a second section of the beam and the flexible barrier 76 is draped over the framework 70' and around the second section of the beam to completely enclose that second section of the beam. An interface seal 80 is then provided at each opposed end of the second section to form a seal between the perimeter of the beam to be treated O and the perimeter of the flexible barrier 76 located closely adjacent the beam. That section is then adequately treated and this process is repeated until the entire beam is treated.

A further embodiment is shown in FIGS. 10-14. According to this embodiment, the containment barrier comprises upper and lower horizontal cross bars 106, 108 and opposed right and left vertically extending support bars 110, 112. The horizontal cross bars 106, 108 and the vertically extending support bars 110, 112 are fixedly secured to one another at respective ends to form a generally rectangular or square framework 114. Exterior sides of the framework 114 comprise a conventional attachment arrangement or feature, which facilitates attachment of a barrier to the framework 114 of the containment barrier. The portion of the barrier supporting the framework 114 is normally rigid so as to support the framework 114 in a fixed position. The framework 114 could also be supported some other support stand or staging or a frame 109. In a manner like those described above, when the containment barrier and the flexible barrier are fixed or coupled together they enclosed and define a treatment area in which the workpiece or the surface to be treated is placed. When the workpiece or the surface to be treated is located within the enclosed treatment area, the framework 114 and the containment barrier and possibly the workpiece or the surface to be treated form a barrier which facilitate containing airborne debris, corrosion, contaminates, oxidation, other undesired matter, or rebounding debris or treatment media within the confined and enclosed treatment area.

The attachment mechanism is provided adjacent the exterior perimeter of the framework 114, or any rigid support structure supporting the framework 114, and may comprise, for example, clips, snaps, buttons, touch fasteners or the like. The basic requirement of the attachment mechanism is that it releaseably secures or couples a flexible barrier to the framework 114 without allowing airborne debris, corrosion, contaminates, oxidation, other undesired matter, or rebounding debris or treatment media to pass through the interface between the flexible barrier and the framework 114 or the rigid support structure.

The flexible barrier, which is to be fixed or coupled to the framework 114 or the rigid support structure, may comprise a tarp, a cloth or a plastic sheet, for example. The flexible barrier is generally impermeable to air so as to prevent airborne debris, corrosion, contaminates, oxidation, other undesired matter, or rebounding debris or treatment media from passing through the flexible barrier. It is, however, preferable if at least a portion of the flexible barrier, if not the entire flexible barrier, be transparent or translucent so as to permit a sufficient amount of light, from outside the enclosed treatment area, to pass through the flexible barrier and illuminate the workpiece or the surface to be treated as this facilitates viewing of the object or the surface to be treated by an operator. By utilizing an at least partially transparent or translucent flexible barrier, the illumination requirements for the workpiece or the surface to be treated inside the treatment area T can be minimized or possible eliminated.

The upper and lower horizontal cross bars 106, 108 of the framework 114 include a pair of opposed pivot members 116, 118, e.g., a shaft or aperture, which are aligned with one another so as to form a vertical pivot axis or pivotable support for a vertical pivotable housing 120, which will be discussed below in further detail. The pivot members 116, 118 are located on the inwardly facing surfaces of the upper and the lower horizontal cross bars 106, 108, midway between the right and left vertical support bars 110, 112. Locating the pivot points centrally between the right and left vertical support bars 110, 112 facilitates pivoting of the vertical pivotable housing 120 relative to the framework 114. The vertical pivotable housing 120 has a radius of curvature which is slightly less, e.g., about 1/16 to 3/4 of an inch or so, than one have of the length of the upper or the lower horizontal cross bar 106, 108 so that the exterior curved side surfaces 122 of the vertical pivotable housing 120 will remain closely adjacent to the inwardly facing surfaces of the right and the left vertical support bars 110, 112, during rotational or pivoting movement of the vertical pivotable housing 120. Such arrangement minimizes the passage of any airborne debris, corrosion, contaminates, rust, oxidation, other undesired matter, rebounding debris or treatment media therebetween.

Figure 11:
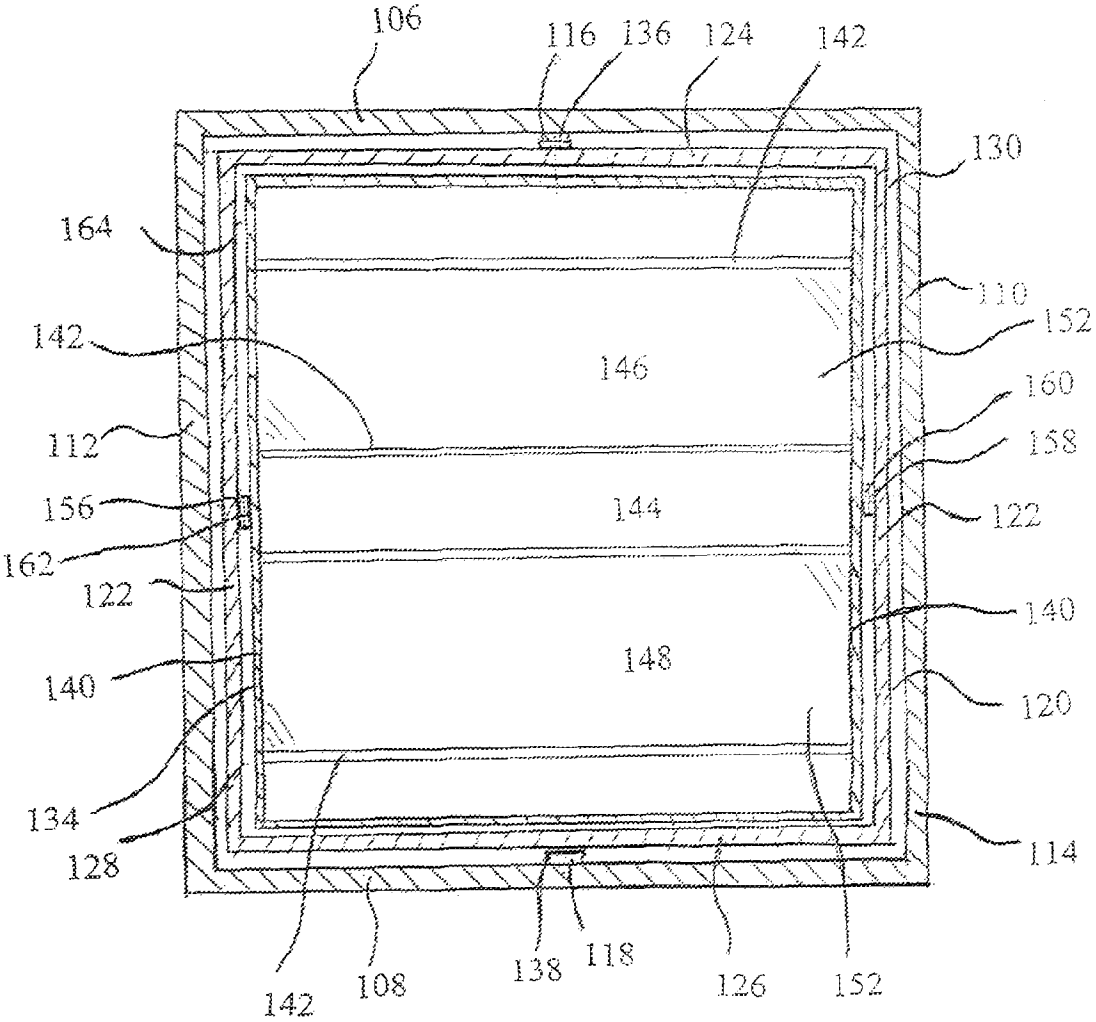
FIG. 11 is a diagrammatic sectional view of the containment barrier according to FIG. 10 along section line XI-XI.
Figure 12:
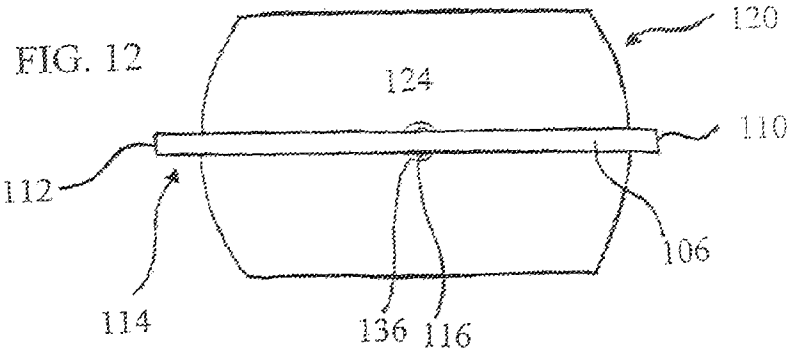
FIG. 12 is a top view of the vertical pivotable housing of the containment barrier according to FIG. 10.
Figure 13A:
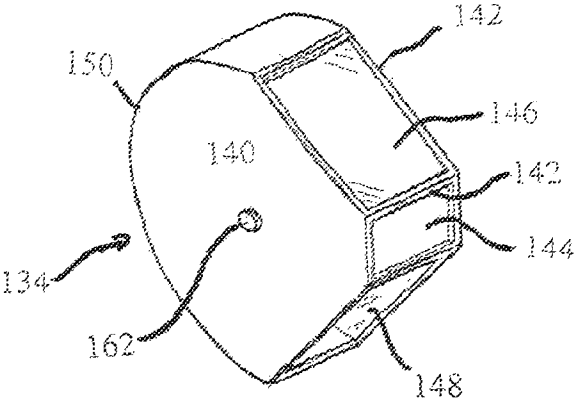
FIG. 13A is a diagrammatic rear perspective view of the horizontal pivotable housing of the containment barrier according to FIG. 10.
Figure 13B:
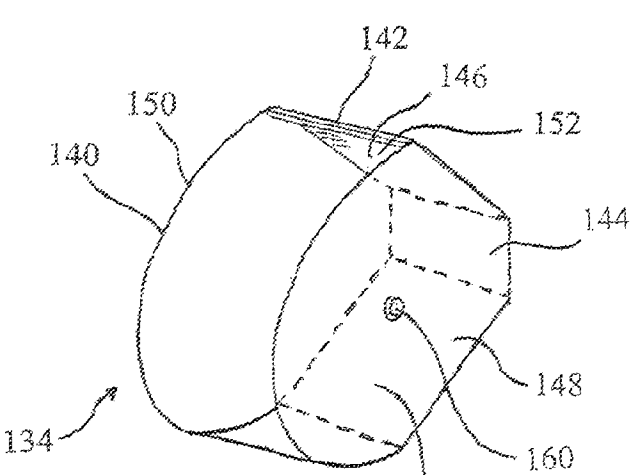
FIG. 13B is a diagrammatic front perspective view of the horizontal pivotable housing of the containment barrier according to FIG. 10.
Figure 13C:
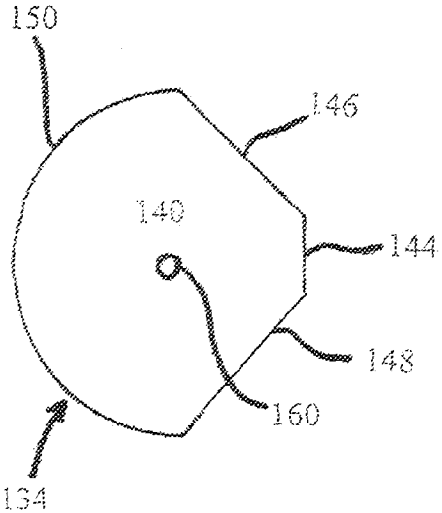
FIG. 13C is a diagrammatic right side view of the horizontal pivotable housing of the containment barrier according to FIG. 10.

With reference to FIGS. 11 and 12, the vertical pivotable housing 120 of the containment barrier will now be discussed detail. The vertical pivotable housing 120 comprises top and bottom parallel planar surfaces 124, 126 and a pair of arcuate or curved side surfaces 122. The top and the bottom surfaces 124, 126 are both generally planar surfaces having substantially identical shapes and configuration. That is, they are both generally O-shaped with arcuate end surfaces and opposed linear edges that extend parallel to one another between the arcuate end surfaces.

The edges of the arcuate end surfaces are respectively welded or otherwise permanently secured or coupled to opposite curved ends of two exterior curved side surfaces 122 thereby forming the vertical pivotable housing 120 which is closely accommodated within the framework 114. The exterior curved side surfaces 122 have the same radius of curvature as the arcuate edges and are generally only secured to the top and bottom surfaces 124, 126 along the arcuate edges. The interior space 128 of the vertical pivotable housing 120 is completely open and this facilitates accommodating a horizontal pivotable housing 134 therein which will be discussed below in further detail. Basically, the vertical pivotable housing 120 somewhat resembles a cylinder which is closed at its top and bottom ends and has opposed portions of its side wall removed therefrom.

As briefly described above, the height of the vertical pivotable housing 120 is slightly less than the spacing between the upper and lower horizontal cross bars 106, 108 of the framework 114. Similarly, the radius of curvature of the exterior curved side surfaces 122 of the vertical pivotable housing 120 is slightly less than the spacing between the right and the left vertical support bars 110, 112 of the framework 114. Due to such a slightly undersized arrangement, when the vertical pivotable housing 120 is accommodated and pivotally secured within the framework 114, a small perimeter gap is formed around the entire interface between the vertical pivotable housing 120 and the framework 114. This small gap 130, between the respective surfaces, can be easily covered and/or sealed by a perimeter seal such a brush seal or some other seal 132 describe above which is conventional in the art. This perimeter seal 132 inhibits the escape of any airborne debris, corrosion, contaminates, rust, oxidation, other undesired matter, rebounding debris or treatment media through the interface between the vertical pivotal structure and the framework 114.

The size of the framework 114 and the vertical pivotal housing 120 can vary depending on the intended use and/or particular application. The preferable spacing between the upper and lower horizontal cross bars 106, 108 is between about 12 inches and 50 inches. The preferable distance between the right and the left vertical support bars 110, 112 of the framework 114 is between about 12 inches and 36 inches.

The vertical pivotable housing 120 is pivotably secured in the framework 114 by a pivot connection such as a fixed pin joint, a ball and socket joint, a shaft and bearing arrangement or some other conventional pivotable or rotatable coupling which facilitates relative rotation. Mating pivot member 136, 138 are centrally supported on the exterior surfaces of each of the top and the bottom surfaces 124, 126 of the vertical pivotable housing 120. When, the mating pivot members 116, 118 of the framework 114 and the pivot member 136, 138 the top and the bottom surfaces 124, 126 of the vertical pivotable housing 120 respectively engage with one another, this facilitates rotation of the vertical pivotable housing 120 relative to the framework 114. The pivotable connection, between the top and the bottom surfaces 126, 128 of the vertical pivotable housing 120 and the inwardly facing surfaces of the framework 114 can be in any conventional manner so long at the vertical pivotable housing 120 is securely retained within the framework 114, but is free to pivot or partially rotate about the vertical pivot axis.

Once pivotally secured within the framework 114, the vertical pivotable housing 120 can pivot preferably in either rotational direction up to a maximum of about 70 degrees with respect to the framework 114. The vertical pivotable housing 120 may be provided with opposed stops (not shown) which limit the degree of pivoting motion of the vertical pivotable housing 120 relative to the framework 114.

A horizontal pivotable housing 134 is pivotably supported within the interior space 128 of the vertical pivotable housing 120. While the vertical pivotable housing 120 provides a horizontal range of pivoting motion, the horizontal pivotable housing 134 provides a vertical range of motion. The horizontal pivotable housing 134 comprises two substantially planar side surfaces 140 which are coupled with one another by a frame structure 142. The frame structure 142 defines a centrally located elongate access port 144 and an upper viewing port 146 and a lower viewing port 148, each of which will be described below in further detail. A blasting nozzle, or some other surface treatment device, typically passes through the access port 144 in the horizontal pivotable housing 134 and facilitates treating the workpiece or the surface to be treated while the upper and the lower viewing ports 146, 148 facilitate viewing of the treatment process by the operator. When the vertical and the horizontal pivotable housings 120, 134 and the framework 114 are assembled with one another and coupled with a containment barrier, the horizontal pivotable housing 134 provides access to as well as viewing of the treatment area T.

A detailed discussion concerning the horizontal pivotable housing 134 will now be provided. The horizontal pivotable housing 134 generally comprises a pair of opposed planar side surfaces 140 which are sized and shaped substantially identical to one another. Each side surface 140, in a plane view, comprises a generally semicircular section and a generally flat bottom V-shaped section such that a plan view of the side wall generally resembles a baseball field. That is, the flat bottom of the base of the V-shaped section partially defines the elongate access port 144 while the two sides of the V-shaped section respectively partially define the upper and lower viewing ports 146, 148.

The two planar side surfaces 140 are attached to the frame structure 142 such that the side surfaces 140 are located parallel to one another. The area along the semicircular section 150 between the side surfaces 140 is free from any frame or other component which may obstruct or hinder the vision or mobility of an operator. The frame structure 142 fixedly secures and separates the two planar side surfaces 140 from one another while also defining the elongate access port 144 and both of the upper and the lower viewing ports 146, 148.

Figure 14:
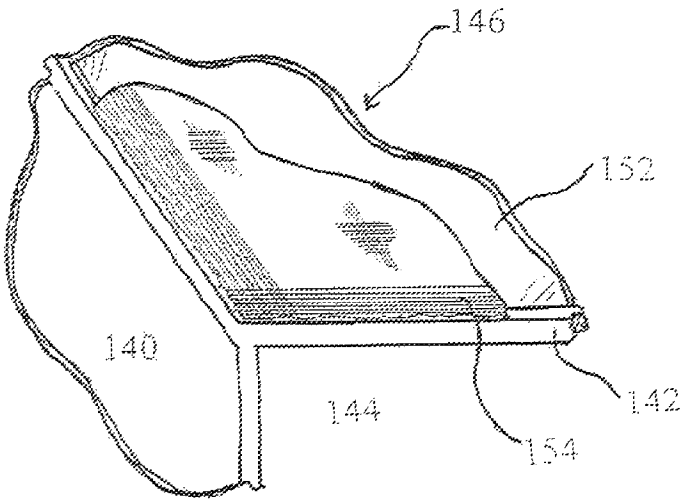
FIG. 14 is a diagrammatic perspective view of a portion of a frame structure of the horizontal pivotable housing of the containment barrier according to FIG. 10.
Figure 10:
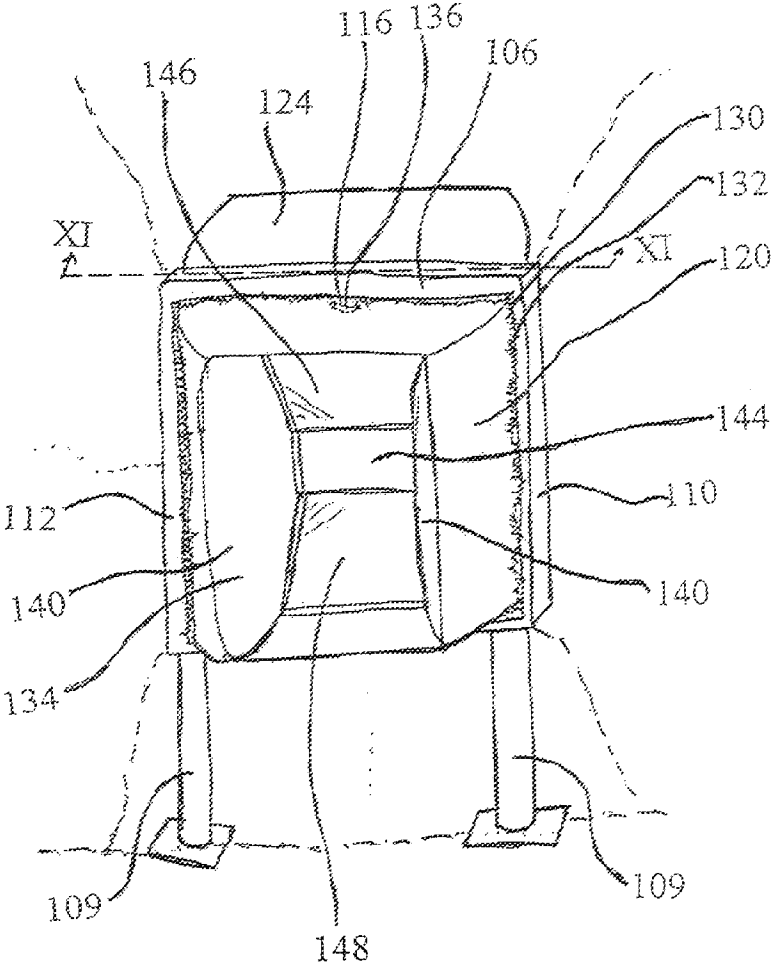
FIG. 10 is a diagrammatic perspective view of a further embodiment of a containment barrier having horizontal and vertical pivotable housings.

As best seen in FIG. 14, a piece of plexiglass, a shatter resistant glass, a transparent plastic or some other transparent but durable material 152, in provided on the inwardly facing surface of the frame structure 142 so as to completely cover each of the viewing ports 146, 148 and each of the transparent but durable material 152 is sealed with respect to the frame structure 142, in a conventional manner, prevent any airborne debris, corrosion, contaminates, rust, oxidation, other undesired matter, rebounding debris or treatment media from passing between the transparent but durable material 152 and the frame structure 142. A protective shield 154 is located between the transparent but durable material 152 and the treatment area. The protective shield 154 could be made from any number of materials as long as the protective shield 154 adequately protects the transparent but durable material 152 of the viewing ports 146, 148 from normal wear, e.g., scratches, dents, etc., caused by rebounding blasting media, contaminants and/or debris. It is important though that the protective shield 154 being sufficiently transparent or at least semi-transparent so as not to inhibit significantly the operator's ability to view the workpiece or the surface to be treated. Such a protective shield 154 may be a mesh screen, a transparent plastic sheet or some other similar material. If a fine mesh screen is utilized, the screen typically has a mesh size of between 150 mesh and 20 mesh. The protective shield 154 extends the useful life of the transparent but durable material 152 before the same must be periodically replaced. Typically the protective shield 154 is spaced by a small distance, e.g., about less that an inch, from the transparent but durable material 152.

The horizontal pivotable housing 134 is secured and pivotably supported within the vertical pivotable housing 120 in a manner similar to the pivotable support for the vertical pivotable housing 120. The opposed interior faces of the curved side surfaces 122 of the vertical pivotable housing 120 have pivot members 156, 158 centrally located thereon. The opposed exterior faces of the side surfaces 140 of the horizontal pivotable housing 134 also have mating pivot members 160, 162 that are centrally located in the side walls. When, the mating pivot members 156, 158, 160, 162 of the vertical pivotable housing 120 and the horizontal pivotable housing 134 respectively engage with one another, this facilitates rotation of the horizontal pivotable housing 134 relative to the vertical pivotable housing 120. The pivotable connection, between the outwardly facing side surfaces 140 of the horizontal pivotable housing 134 and the inwardly facing curved side surfaces 122 of the vertical pivotable housing 120 can be in any conventional manner so long at the horizontal pivotable housing 134 is securely retained within the vertical pivotable housing 120, but is free to pivot or partially rotate about the vertical pivot axis.

The height and width of the horizontal pivotable housing 134 is slightly smaller than the interior space 128 defined by the vertical pivotable housing 120. Due to such slightly undersized arrangement, when the horizontal pivotable housing 134 is accommodated and pivotally secured within the vertical pivotable housing 120, a small perimeter gap 164 is formed around the entire interface between the horizontal pivotable housing 134 and the vertical pivotable housing 120. This small gap 164, between the respective surfaces, can be easily covered and/or sealed by a perimeter seal 166 such a brush seal or some other seal describe above which is conventional in the art. This perimeter seal 166 inhibits the escape of any airborne debris, corrosion, contaminates, rust, oxidation, other undesired matter, rebounding debris or treatment media through the interface between the horizontal pivotal structure and the vertical pivotable housing 120.

The actual sizes of the horizontal pivotable housing 134 and the vertical pivotable housing 120 may be varied depending on the intended use of the containment barrier however, a preferable height of the horizontal pivotable housing 134 is about 5-60 inches or so.

The horizontal pivotable housing 134 is secured pivotably to the vertical pivotable housing 120 by a pivot connection such as a fixed pin joint, a ball and socket joint, a shaft and bearing configuration or the like. Again the connection between the curved side surfaces 122 of the vertical pivotable housing 120 and the side surfaces 140 of the horizontal pivotable housing 134 can be any manner of appropriate pivotal connection as long as the horizontal pivotable housing 134 is securely retained within the vertical pivotable housing 120, but can freely pivot about the horizontal pivot axis.

Once pivotally secured within the vertical pivotable housing 120, the horizontal pivotable housing 134 can pivot preferably either upwardly or downwardly up to a maximum of about 70 degrees or so with respect to the vertical pivotable housing 120. The horizontal pivotable housing 134 may be provided with opposed stops (not shown) which limit the degree of pivoting motion of the horizontal pivotable housing 134 relative to the vertical pivotable housing 120.

The access port 144 of the horizontal pivotable housing 134 is sealed via a seal, such as a brush seal, an inflatable seal, a rubber seal, etc., (not shown) which extends along the length of the access port 144 but allows the blasting nozzle to extend therethrough and slide or move to and fro laterally along the access port 144 while still providing an adequate seal so as to minimize the escape of any airborne debris, corrosion, contaminates, rust, oxidation, other undesired matter, rebounding debris or treatment media during the surface treatment process.

As is conventional, an operator sprays the blasting media under high pressure at the treatment surface such that the blasting media impacts the surface thereby removing any corrosion, contaminates, rust, oxidation or other undesired matter from the surface. During such treatment, the corrosion, contaminates, rust, other and undesired matter are removed from the surface together with the rebounding blasting media which normally ricochets off the surface and thus becomes airborne. Such airborne debris, corrosion, contaminates, rust, oxidation, other undesired matter, rebounding debris or treatment media may produce a possibly very dangerous, toxic and/or hazardous atmosphere.

To assist with control of a potentially dangerous, toxic and/or hazardous atmosphere, a vacuum system 170 is typically employed with containment system so as to withdraw air as well as any airborne debris, corrosion, contamination, oxidation, other particulate matter from the treatment area T by creating a negative pressure within the treatment area T. This withdrawn air is then passed through a suitable filtration system 172 to remove the air borne debris, corrosion, contamination, oxidation, other particulate matter. Once the air is adequately filtered, it can then be discharged directly into the atmosphere. As the air is withdrawn from the treatment area, a negative pressure is typically developed or created within the treatment area T. Such a negative pressure atmosphere is beneficial in that it further assists with preventing any airborne debris, corrosion, contaminates, rust, oxidation, other undesired matter, rebounding debris or treatment from escaping from the treatment area through the peripheral gaps or any breach or opening(s) in the containment barrier.

Figure 15:
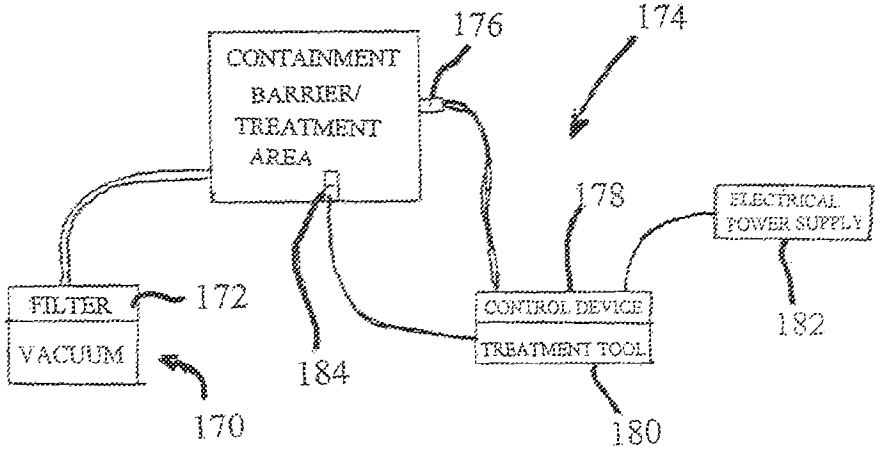
FIG. 15 is diagrammatic view of an automatic safety shut-off feature and a vacuum system of the containment barrier.

As diagrammatically shown in FIG. 15, the containment barrier may also include an automatic safety shutoff feature 174. This automatic safety shutoff feature generally includes a pressure sensor 176 which is located within the treatment area T. The pressure sensor 176 can be supported by any of the containment barrier components or merely located within the treatment area. The pressure sensor 176 is coupled to a control device 178 which controls the supply of electrical power to the various surface treatment equipment and/or tools 180 such as a blasting device 184. The pressure sensor 176 continually monitors the atmospheric pressure within the treatment area and provides and input signal, indicative of the atmospheric pressure of the treatment area T, to the control device 178.

As alluded to above, the pressure sensor 176 can be attached to any of the containment barrier components that are exposed to the treatment area T so as to continually monitor the atmospheric pressure within the treatment area. In some instances, although the vacuum system may appear to be operating as normal, if for some reason, such as an overfull filter, the vacuum fails to pass a sufficient amount air through the filtration system, the pressure sensor 176 will detect a pressure increase in the treatment area T.

When the atmospheric pressure within the treatment area is not maintained at or below or above a desired pressure, e.g., a negative pressure of a few inches of water, for example, the pressure sensor 176 will transmit a signal to the control device 178 which interrupts the supply of electrical power 182 to the desired blasting equipment. This notifies the operator that there is a problem with the system, e.g., the filter must be serviced, a breached has occurred in the containment barrier, etc. The operator will the survey the situation and undertake suitable corrective action so that a desired (negative) pressure is again achievable within the treatment area T. Thereafter, the vacuum system 170 can then develop a desired pressure in the treatment area and the pressure sensor 176 can then detect the same so that the control device 178 can again permit the supply of electrical power to the desired blasting equipment.

Figure 16:
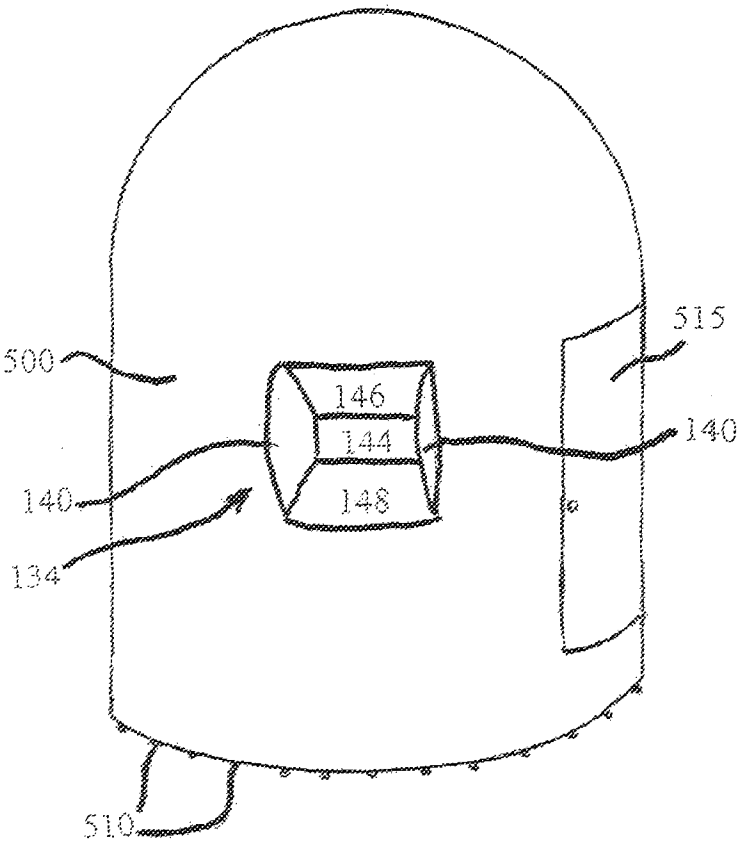
FIG. 16 is a diagrammatic perspective view of a containment barrier enclosure.

It is to be appreciated that the relative size of the containment barrier depends on the application. It is conceivable that the containment barrier is large enough to completely enclose an operator within its confines. The embodiment show in FIG. 16 could be used to treat the interior walls, floors and ceiling of an entire room, compartment or other such enclosure by merely rotating the equipment. In this case, the containment barrier would have an overall structure of a domed housing 500, which would be supported on a rotatable planar surface which is pivotable about a vertical axis. The rotatable support for the rotatable planar surface supporting the domed housing 500 could be, for example, roller bearings 510 or bearing pins or the like. The domed housing 500 would include a door or a removable panel 515 so as to allow an operator exit and enter the interior of the domed housing 500 before and after blasting.

As this embodiment is similar to the above embodiment, only the differences between the two embodiments will be discussed. The horizontal pivotable housing 134 would be pivotably supported by the domed housing 500 instead of the vertical pivotable housing 120. In this manner, the operator has a vertical range of motion by means of the horizontal pivotable housing 134. As indicated above, the domed housing 500 is rotatable around a vertical axis, via a motor or some other conventional drive or possibly by hand, thereby providing the operator with a 360 degrees of horizontal motion.

Of course certain modifications would have to be made to the vacuum system and treatment tools when employing the containment barrier with the domed housing 500. Such modifications would include a supply of fresh air to the interior of the domed housing 500 so that as contaminated air is withdrawn from the treatment area T, fresh air is drawn into the domed housing 500 to replace the withdrawn air. A further consideration would include the supply of power and surface treatment equipment to the domed housing 500 so as to permit an operator to treat the desired surfaces and operate the various surface treatment equipment and/or tools.

Figure 17:
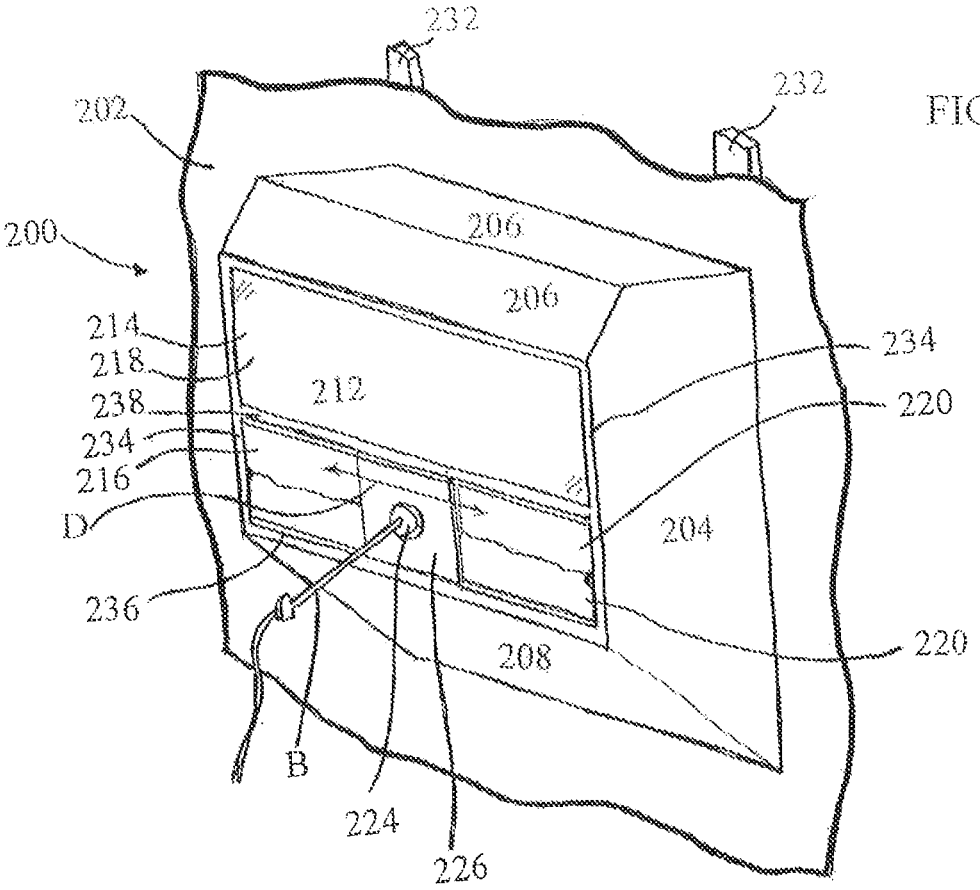
FIG. 17 is a pictorial view of the front of another embodiment of containment barrier enclosure according to the present invention.

A further embodiment is generally shown in FIGS. 17-26. FIG. 17 is a front right side diagrammatic view of a containment assembly according to the invention The containment assembly 200 is secured to a sealing element 202 which encloses and contains an object or surface to be treated O. In a manner similar to the embodiments described above, the containment assembly 200 can be utilized with the flexible barrier, which has been sufficiently described above and for the sake of brevity will not be discussed here.

Figure 18:
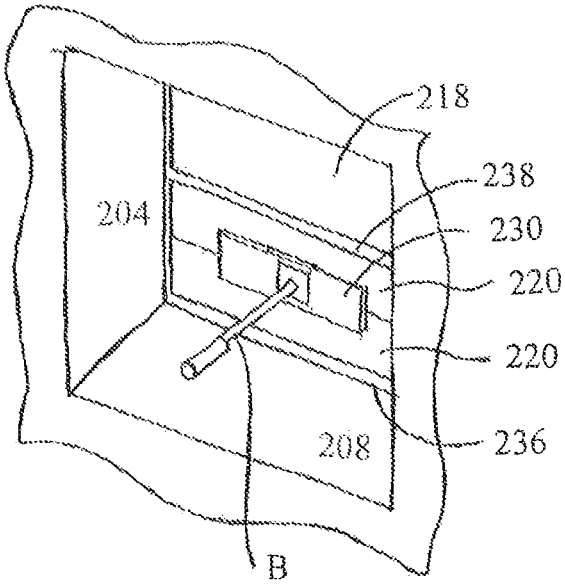
FIG. 18 is a pictorial view of the rear of the containment barrier according to FIG. 17.

The containment assembly 200 as shown in FIGS. 17 and 18 is formed with a number of rigid panels, such as side panels 204, top panels 206, and an angled bottom panel 208. The size, shape and configuration of the side panels 204, top panels 206, and bottom panel 208 are not vital to this embodiment. These various panels are rigidly supported by a frame 210, which also supports a front access panel 212. This access panel 212 generally comprises both a viewing aperture 214 and an access aperture 216. The access aperture 216 enables an operator to access the treatment area T in which an object or surface is placed to be treated O while still enclosing the treatment area T so as to prevent the escape of any blasting media, contaminants, dust and/or debris from passing from the enclosed treatment area T to the exterior work area F as generally described above.

The viewing aperture 214 includes a transparent window 218 which facilitates a clear line of sight to the object or surface to be treated O while, at the same time, separating the enclosed treatment area T and the object or surface to be treated O from the exterior work area F. As this type of viewing aperture 214 and transparent window 218 have previously been discussed above with regard to prior embodiments the same will not be discussed below.

Figure 19:
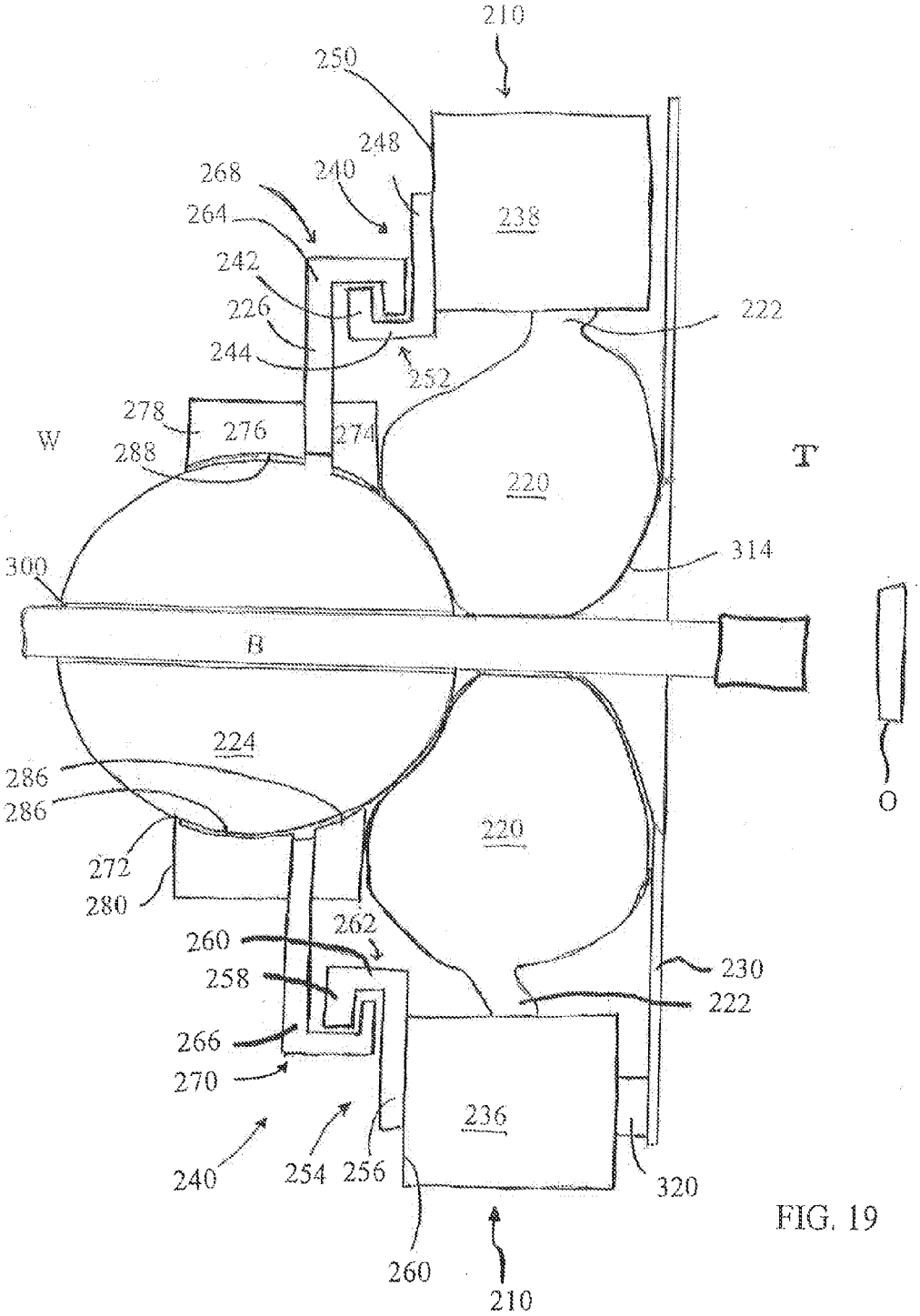
FIG. 19 is a sectional view of the containment barrier enclosure according to FIG. 17 as viewed along the section line 19-19 in FIG. 22.
Figure 20:
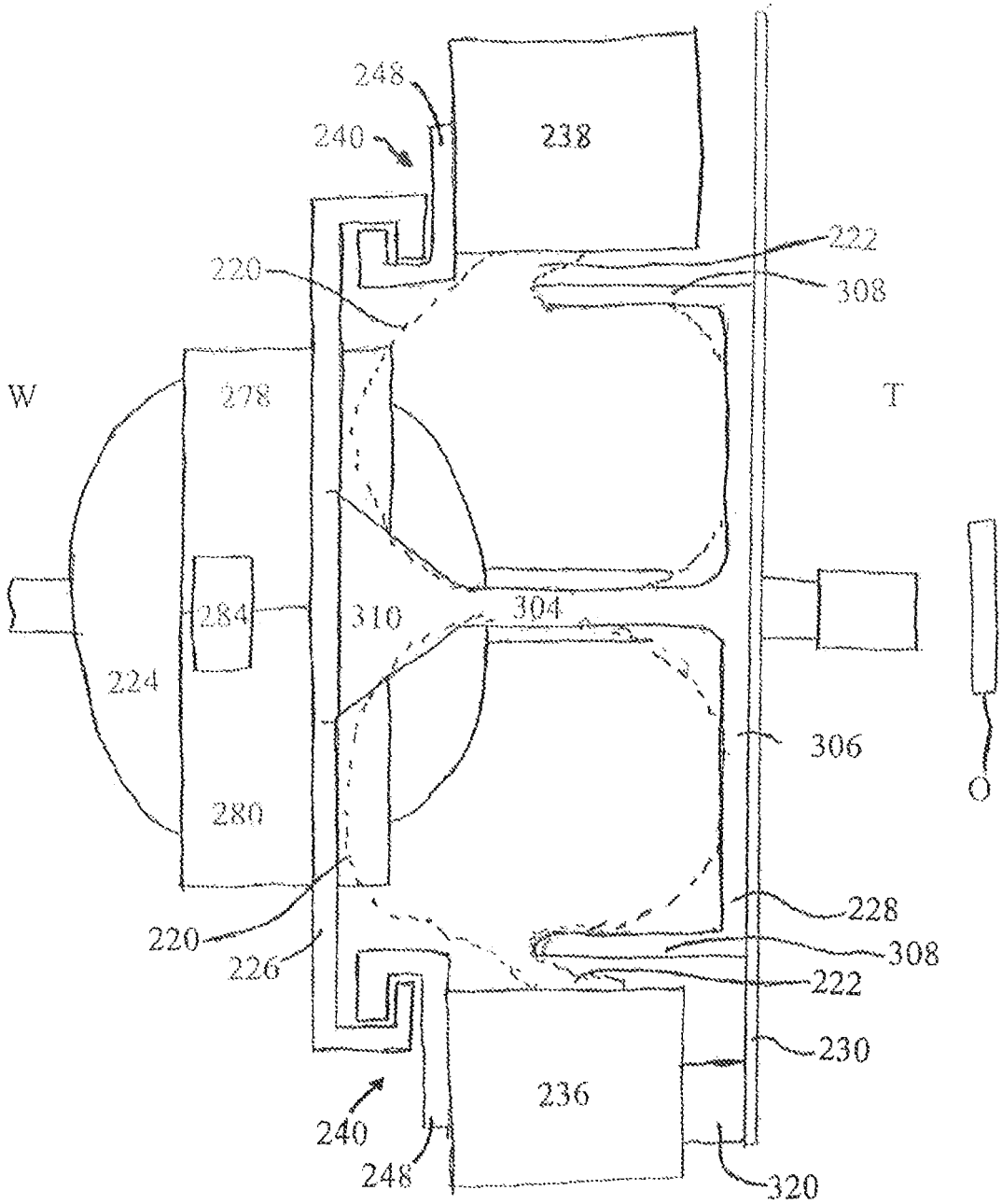
FIG. 20 is a sectional view of the containment barrier enclosure according to FIG. 17 as viewed along the section line 20-20 in FIG. 22.

The access aperture 216 facilitates access to the enclosed treatment area T and includes a pair of elongate inflatable sealing elements 220 that can be inflated to at least partially close the access aperture 216 and prevent the passage of blasting media, contaminants, dust and/or debris therethrough. The two inflatable sealing elements 220 of this embodiment have a flap or projection 222 that extends along the length thereof. The flap or projection 222, as shown in FIGS. 19 and 20 are secured in a conventional manner to the frame 210 of the access panel 212 such that the two inflatable sealing elements 220 laterally span the access aperture 216. The inflatable sealing elements 220 are arranged and aligned to be parallel and spaced apart from one another such that, when inflated, they inflate, close and seal the access aperture 216 and generally prevent the passage of any blasting media, contaminants, dust and/or debris therethrough. A supporting/sealing panel 226 is also secured slidably movable relative to the access aperture 216 and the supporting/sealing panel 226 supports a spherical orb 224 (e.g., a diameter of about 3.5 to about 6 inches, more preferably about 4 inches or so) as well as a pair of T-shaped baffles 228 which retain an interior sealing panel 230 which will be discussed below in further detail.

The containment assembly 200 and the access panel 212 may be supported by either conventional staging, a fixed panel framework, an adjustable framework and/or a movable framework 232. In the event that the containment assembly 200 and/or the access panel 212 are not directly supported by the floor F, then a portion of the containment assembly 200 and/or access panel 212 is coupled to the framework 232 in a conventional manner, e.g., by an adhesive, mating nuts and bolts, welding, screws, etc., such that the framework 232 supports and retains the containment assembly 200 and access panel 212 during use.

The access aperture 216, the inflatable sealing elements 220 and the supporting/sealing panel 226 are shown in FIGS. 19 and 20. The access aperture 216 is formed by the frame 210 which comprises two parallel cross frame members 236, 238 and two side frame members 234. The top cross frame member 238 supports a bottom of the transparent window 218 of the viewing aperture 214 and the two side frame members 234 retain opposed sides of the transparent window 218 of the viewing aperture 214. The top cross frame member 238 has a support element 240 with two sides 242, 248 and a base 244 which together form a J-shape. The longer side 248 of the J-shaped support element 240 is fixed to the exterior side 250 of the top cross frame member 238 such that the hooked portion 252 of the J-shaped support element 240 is adjacent the access aperture 216 and faces away from the access panel 212. Fixing the J-shaped support element 240 to the top cross frame member 238 can be accomplished in any known conventional manner, e.g., by an adhesive, mating nuts and bolts, welding, screws, etc.

In a like manner, the bottom cross frame member 236 has a retainment element 254 with two sides 256, 258 and a base 260 which together form a J-shape. The longer side 256 of the J-shaped retainment element 254 is fixed to the exterior side 260 of the bottom cross frame member 236 such that the hooked portion 262 of the J-shaped retainment element 254 is adjacent the access aperture 216 and faces away from the access panel 212. In this configuration, the bases 244, 260 of the J-shaped support element 252 and the J-shaped retainment element 262 face each other and the interior of the access aperture 216.

The top and bottom edges 264, 266 of the exterior supporting/sealing panel 226 are J-shaped with the hooked portion 268, 270 of the J-shaped edges 264, 266 facing toward the access panel 212. The height of the exterior supporting/sealing panel 226 is similar to the distance between the top and bottom cross frame members 236, 238 such that the J-shaped support element 252 of the top cross frame member 238 mates with the J-shaped top edge 264 of the exterior supporting/sealing panel 226. The J-shaped retainment element 262 of the bottom cross frame member 236 mates with the J-shaped bottom edge 266 of the exterior supporting/sealing panel 226. Due to the interlocking of the respective J-shaped elements 252, 262 of the frame members 238, 236 and the edges 264, 266 of the exterior supporting/sealing panel 226, the exterior supporting/sealing panel 226 is securely supported in a position adjacent the union of the two inflatable sealing elements 220. Further the interlock between the 252, 262 of the frame members 238, 236 and the edges 264, 266, the exterior supporting/sealing panel 226 is able to be slid to and fro laterally across the width of the access aperture 216.

Figure 22:
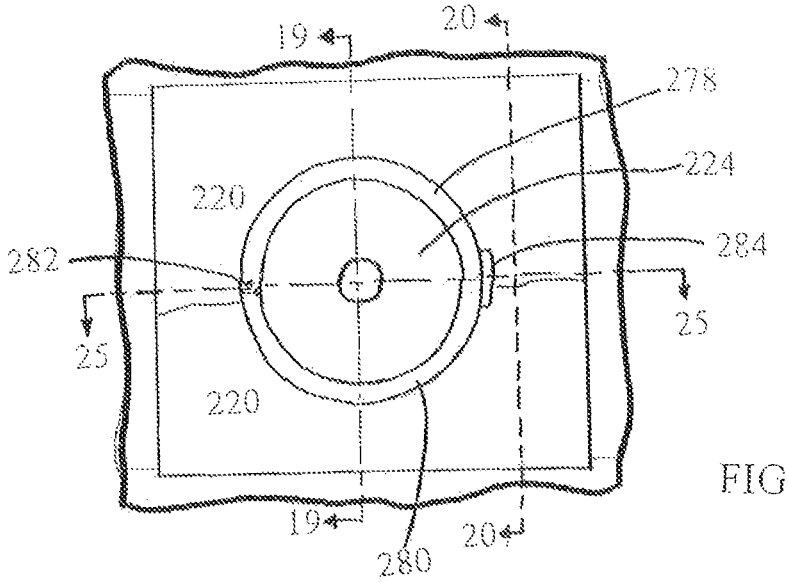
FIG. 22 is a front plan view of a supporting/sealing panel of the containment barrier enclosure according to FIG. 17.

The exterior supporting/sealing panel 226 has a circular opening 272 located essentially centrally therein and inner and outer retaining rings 274, 276. The inner retaining ring 274 is secured to the inner surface of the supporting/sealing panel 226 such that the inner retaining ring 274 and the circular opening 272 are concentric. The outer retaining ring 276 is formed by two half rings 278, 280 or portions of a ring which are shown in FIG. 22. The two half rings 278, 280 are coupled together at one end by a hinge 282 such that they are capable of pivoting toward and away from one another. The opposite end of the two half rings each support a component of a locking element 284 e.g., mating latches, a hook and loop fastener, etc. One of the two half rings 280 is fixed to the outer surface of the supporting/sealing panel 226, while the other of the two half rings 278 remains free to pivot with respect to the fixed half ring 280. The fixed half ring 280 is fixed to supporting/sealing panel 226 in such a manner that when the opposite end of the free half ring 278 is locked to the fixed half ring 280, the outer retaining ring 276, formed by the two half rings 278, 280, is concentric with the circular opening 272.

As shown in FIG. 19, the inner and outer retaining rings 274, 276 have inwardly facing surfaces 286 of that are arched and together form a surface 288 with cross sectional profile that is semi-circular in shape. The semi-circular surface 288 is utilized as a low friction bearing surface. The bearing surface 288 has a diameter that is slightly larger than the exterior surface of a spherical orb 224 such that the inner and outer retaining rings 274, 276 are capable of engaging with the exterior surface of the spherical orb 224. The inner and outer retaining rings 274, 276 sandwich the largest diameter section of the spherical orb 224 therebetween so as to retain the spherical orb 224 within the circular opening 272 while still permitting the desired pivoting and/or rotational movement of the spherical orb 224. To insert the spherical orb 224 between the inner and outer retaining rings 274, 276, the free half ring 278 is unlocked from the fixed half ring 280 and then pivoted away from the fixed half ring to an "open" position of the two half rings. The spherical orb 224 can then be inserted into the circular opening 272 in the supporting/sealing panel 226. Once properly positioned, the free half ring 278 is pivoted to its "closed" position and suitably locked. Because of the close relationship between the arched bearing surface 288 and the outer surface of the spherical orb 224, the spherical orb 224 is thus locked in position within the circular opening 272 of the supporting/sealing panel 226.

As shown in FIG. 19, for example, the spherical orb 224 has a port 300 that extends completely therethrough from the inwardly facing surface of the spherical orb 224 to the outwardly facing surface of the spherical orb 224. This port 300 is sized to accommodate a conventional blasting nozzle, or some other surface treatment equipment B, which passes therethrough and extends into the enclosed treatment area T thus enabling blasting media to be conveyed through the spherical orb 224 and discharged within the enclosed treatment area T for treating the object or the surface the object to be treated O from outside the enclosed treatment area T. The port 300 has a diameter of between about 1 to 3 inches and more preferably about 1.5 inches.

As illustrated in FIG. 19, the blasting nozzle B passes through the port 300 in the orb 224 and extends between the two inflatable sealing elements 220 and into the enclosed treatment area T. As the blasting nozzle B passes between the two inflatable sealing elements 220, the blasting nozzle B breaks the seal formed by the two inflatable sealing elements 220, see FIG. 23. That is, the two inflatable sealing elements 220 become spaced from one another at least over a substantially large distance and form a pair of triangular shaped openings 302 at the location where the blasting nozzle B passes through the two inflatable sealing elements 220. These triangular shaped openings 302 can be somewhat problematic because they from openings which tend to enable the airborne blasting media, contaminants, dust and/or debris to pass from the enclosed treatment area T to the exterior work area F thus possibly causing potentially unsafe working conditions for the operator of the blasting nozzle B.

Figure 24:
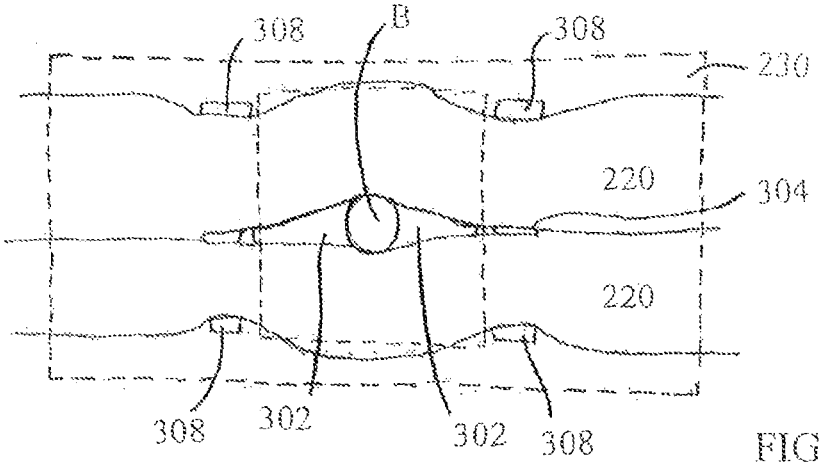
FIG. 24 is a view of the inflatable sealing elements being separated by the blasting nozzle with the T-shaped baffles fixed in the containment barrier enclosure according to FIG. 17.

To reduce the size of triangular shaped openings 302, formed by the blasting nozzle B as it passes between the two inflatable two inflatable sealing elements 220, a pair of T-shaped baffles 228 are supported by a rear side of the supporting/sealing panel 226. Due to the overall shape and location of these baffles 228, the two inflatable sealing elements 220 are "pinched" together toward one another, as shown in FIG. 24. By locating the blasting nozzle B adjacent and between the baffles 228, the baffles 228 facilitate resealing the two inflatable sealing elements 220 over a shorter distance thereby reducing the size of the triangular shaped openings 302 and minimizing the possibility that any the removed substance(s), material(s), contaminant(s), hazardous material(s), debris 14, etc., may escape through the triangular shaped openings 302.

Figure 21:
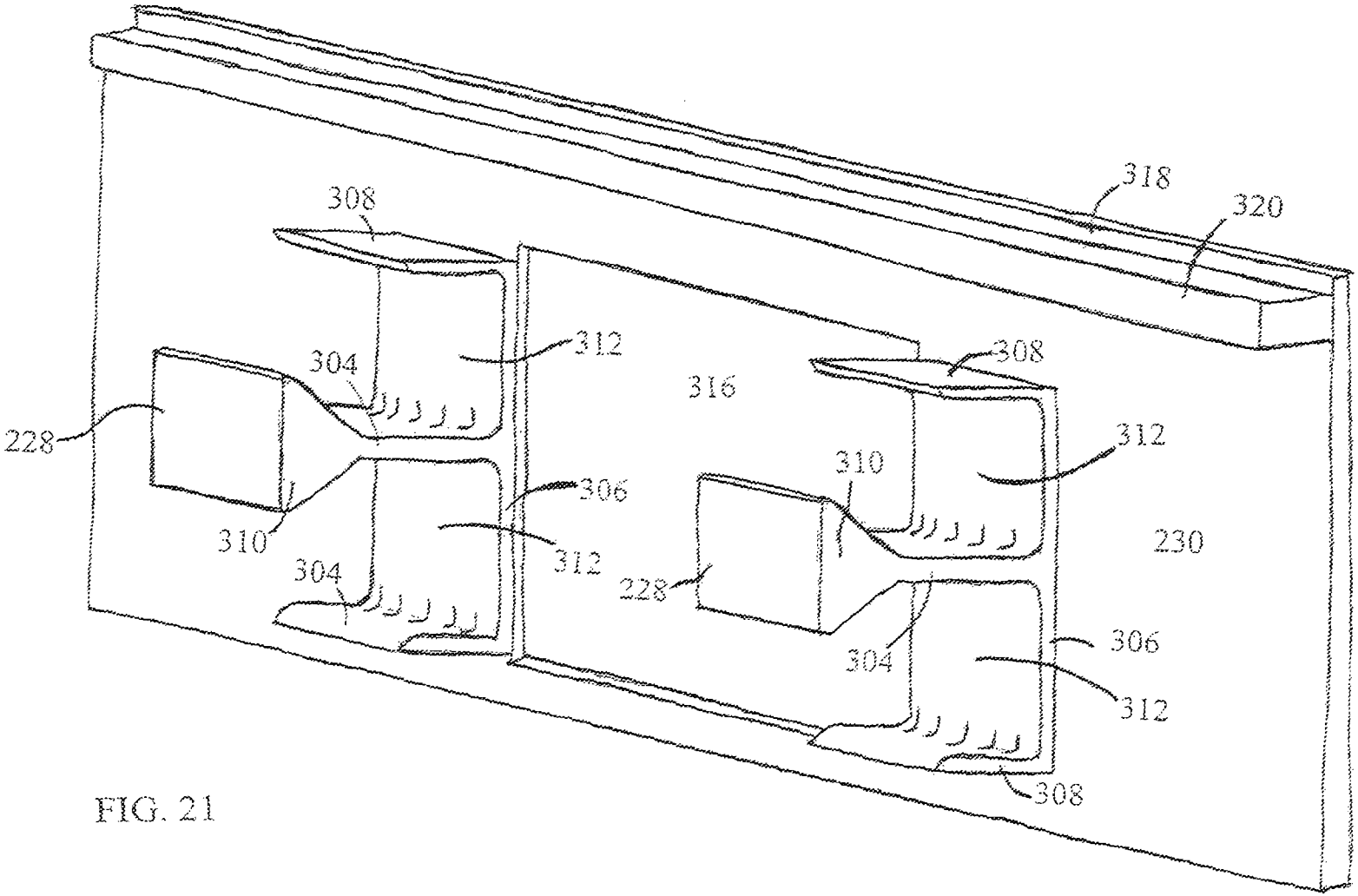
FIG. 21 is a pictorial view of the internal panel and T-shaped baffles of the containment barrier enclosure according to FIG. 17.
Figure 25:
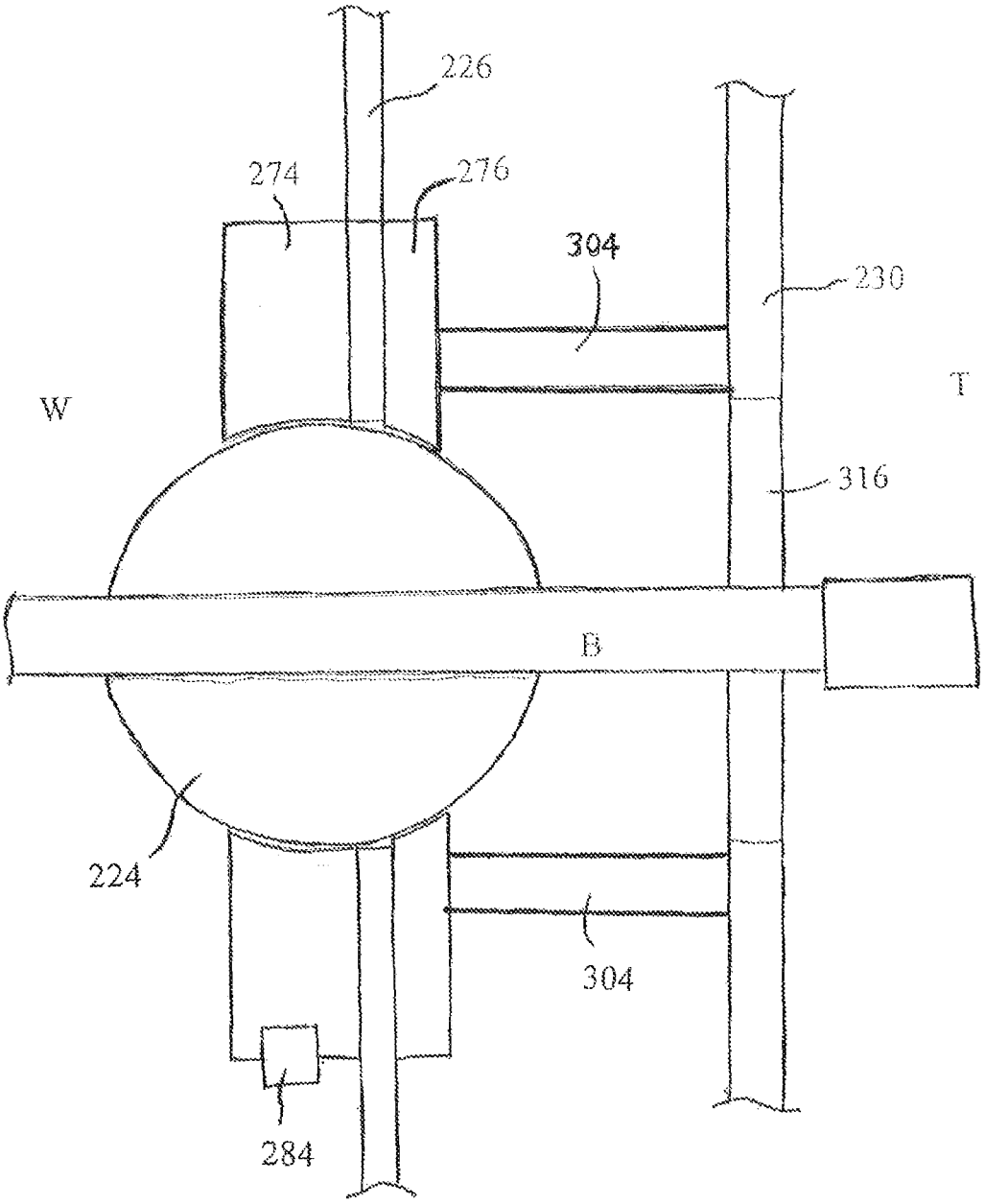
FIG. 25 is a sectional view of the containment barrier enclosure according to FIG. 17 as viewed along the section line 25-25 in FIG. 22.
Figure 26:
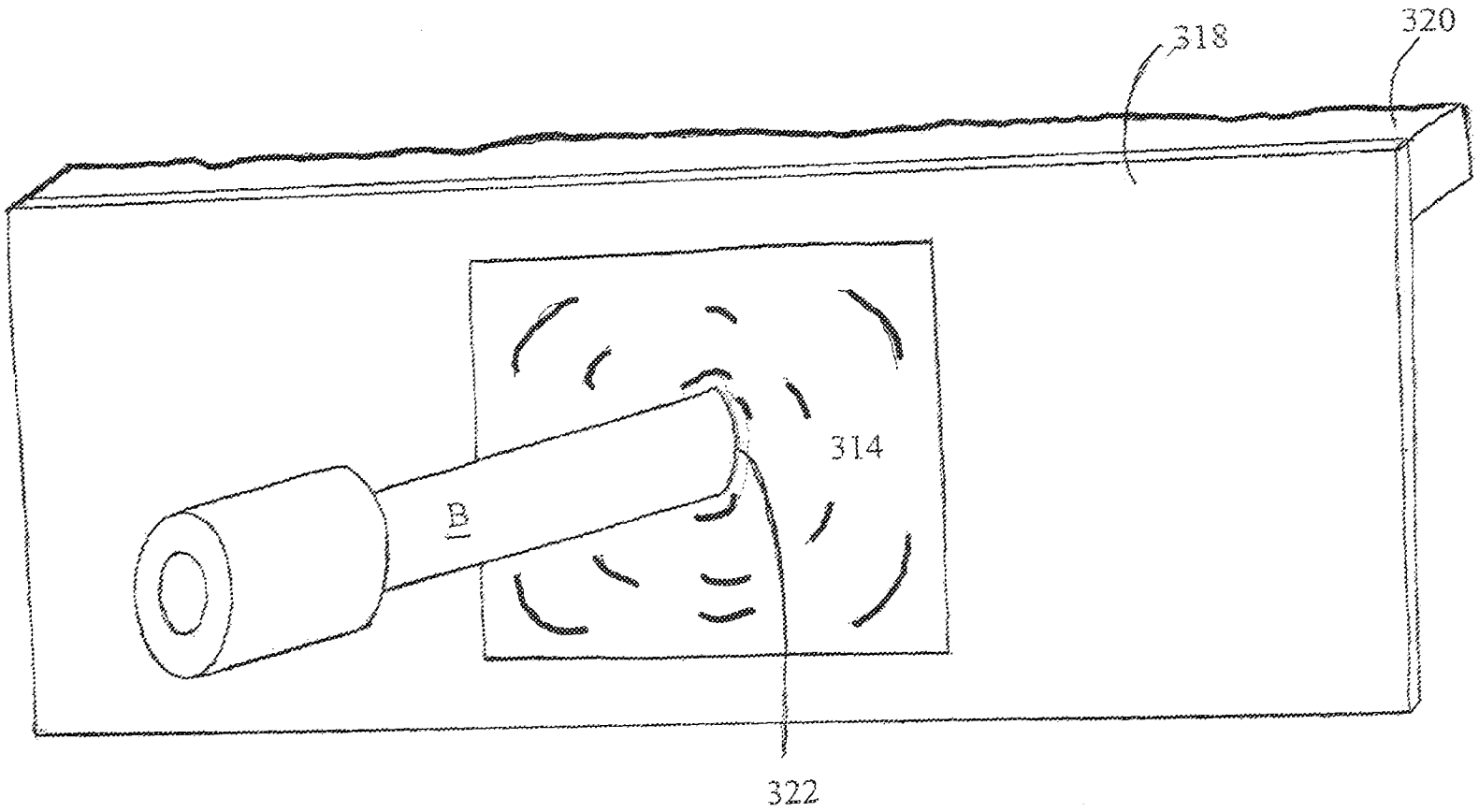
FIG. 26 is a pictorial view of an internal panel and a diaphragm of the containment barrier according to FIG. 17.
Figure 27:
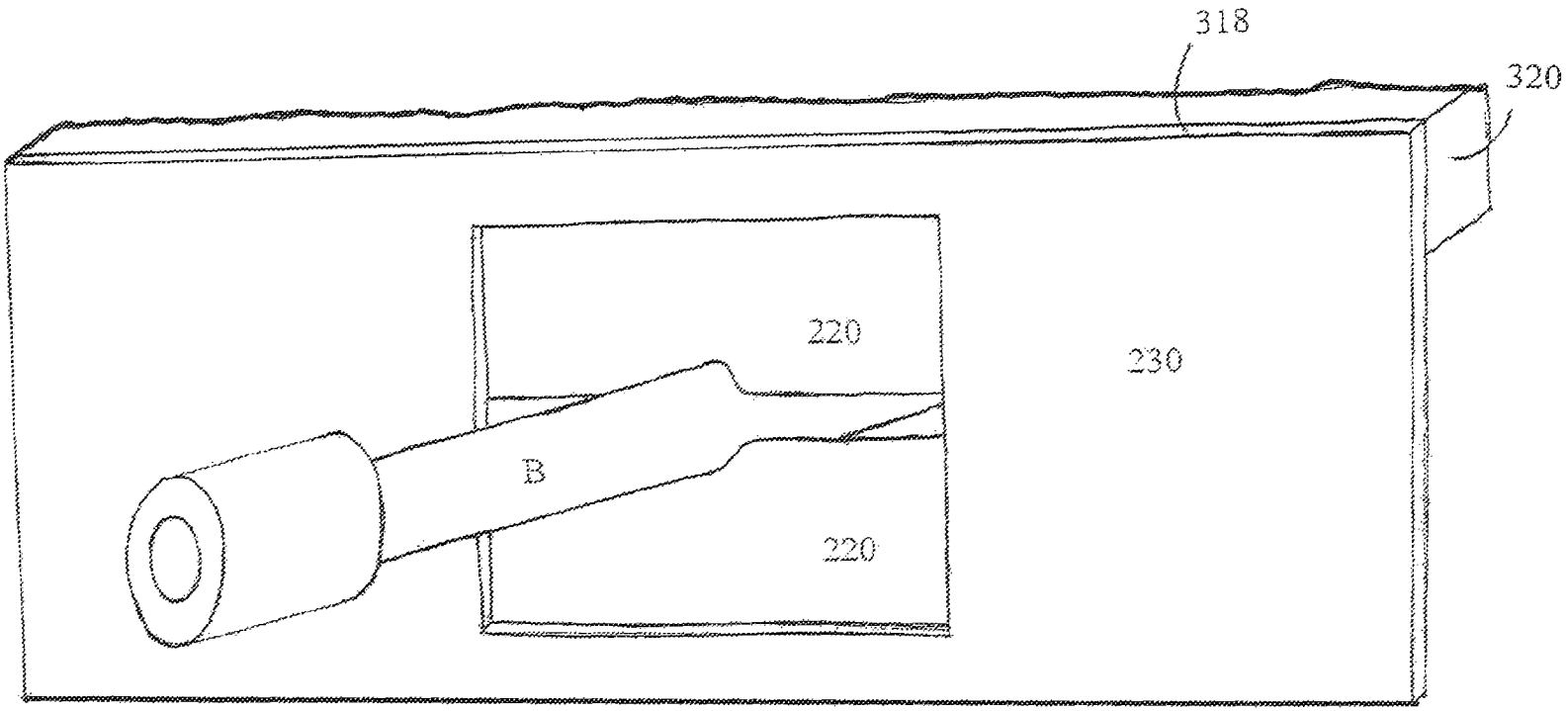
FIG. 27 is another pictorial view of then internal panel of the containment barrier according to FIG. 17.

Each of the pair of T-shaped baffles 228 comprises a leg 304, a top member 306 and two arms 308 which are arranged so as to form a T-shape component. A base 310 of each respective leg 304 of the T-shaped baffles 228 flare as they mate with the supporting/sealing panel 226 on laterally opposite sides of the inner retaining ring 274. The flare of the base 310 of the legs 304 provides a greater contact area, between the T-shaped baffles 228 and the supporting/sealing panel 226, thereby increasing the stability of the T-shaped baffles 228. The arms 308 of the T-shaped baffles 228 are located on opposite sides of the top member 306 of the T-shaped baffles 228 and extend normal therefrom and parallel to one another and to the central leg 304 with the central leg 304 located therebetween. The T-shaped arrangement of the leg 304, the top member 306 and two arms 308 forms two passages 312 that are spaced from each other by the central leg 304 of the T-shaped baffle 228, as shown in FIGS. 20 and 21.

Figure 23:
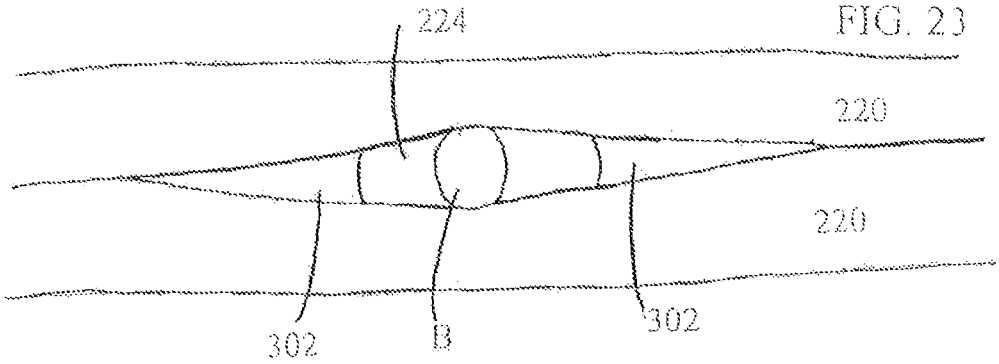
FIG. 23 is a view of inflatable sealing elements being separated by a blasting nozzle without the T-shaped baffles being assembled in the containment barrier enclosure according to FIG. 17.

As a result of such arrangement, as the supporting/sealing panel 226 slides in the lateral direction, as generally shown by arrow D in FIG. 17, each of the inflatable sealing elements 220 passes through a respective passage 312 in the T-shaped baffles 228 and resealing of the inflatable sealing elements 220, over a shorter distance than which normally occurs, is promoted by the T-shaped baffles 228. The diameter of the blasting nozzle B is greater than the distance between the passages 312 formed by the T-shaped baffles 228 so that the blasting nozzle B causes the triangular shaped openings 302 that extend laterally therefrom, as shown in FIG. 23. With their close lateral proximity to the blasting nozzle B, as viewed in FIG. 25, these T-shaped baffles 228 tend to "pinch" the inflatable sealing elements 220 back toward one another thus promoting resealing of the access aperture 216 over a much shorter distance than would be otherwise possible.

Although the T-shaped baffles 228 reseal the inflatable sealing elements 220 over a shorter distance, the blasting nozzle B still causes the inflatable sealing elements 220 to separate, as shown in FIG. 24. To further reduce the effects of the triangular shaped openings 302 between the inflatable sealing elements 220, an interior sealing panel 230 is affixed to the supporting/sealing panel 226 in such a position that the interior sealing panel 230 together with a flexible diaphragm 314 block access to the triangular shaped openings 302.

The top of the T-shaped baffles 228 are fixed to the inner surface of the interior sealing panel 230 such that the supporting/sealing panel 226 is parallel to the interior sealing panel 230. The interior sealing panel 230 has an opening 316 that is aligned with the port 300 of the spherical orb 224. Due to this arrangement, the blasting nozzle B passes through the spherical orb 224, between the inflatable sealing elements 220 and finally through the opening 316 in the interior sealing panel 230 and into the enclosed treatment area T.

The interior sealing panel 230 extends laterally over the inflatable sealing elements 220, specifically the seal therebetween, and minimizes the impact of any airborne blasting media, contaminants, dust and/or debris that may be directed toward the access aperture 216. The top edge 318 of the interior sealing panel 230 has an elastic type seal 320 that extends the length of the interior sealing panel 230 and is positioned and sized to contact the top frame cross member 238 and further seal the enclosed treatment area T.

The opening 316 in the interior sealing panel 230 is enclosed by a flexible diaphragm 314 whose entire perimeter is secured to the perimeter of the opening 316. The flexible diaphragm 314 has a centrally located hole 322 or a number of slits which enable the blasting nozzle B to pass through the flexible diaphragm 314 and substantially, completely enclose the leading end of the blasting nozzle B within the treatment area T. The flexible diaphragm 314 is beneficial when the treatment area T is to have a negative pressure, such as with the use of an air filtration system which includes a vacuum for removing air from the treatment area T.

The embodiments of the containment barrier, as shown in FIGS. 29-31 and 33-35 for example, generally correspond to the embodiments as that shown in FIGS. 4A, 4B, 4C and 4D ands as such, the elements that are common to both embodiments are given the same reference numerals and are not discussed in any further detail below. Accordingly, only the elements that are different from those of the previously discussed embodiments will be discussed in further detail below.

Figure 28:
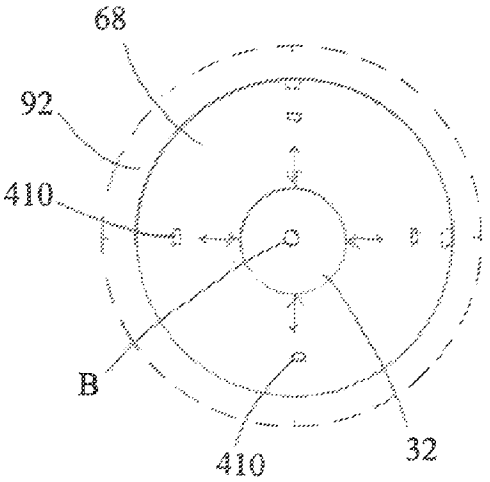
FIG. 28 is a diagrammatic front view showing stops supported by the spherical orb.
Figure 29:
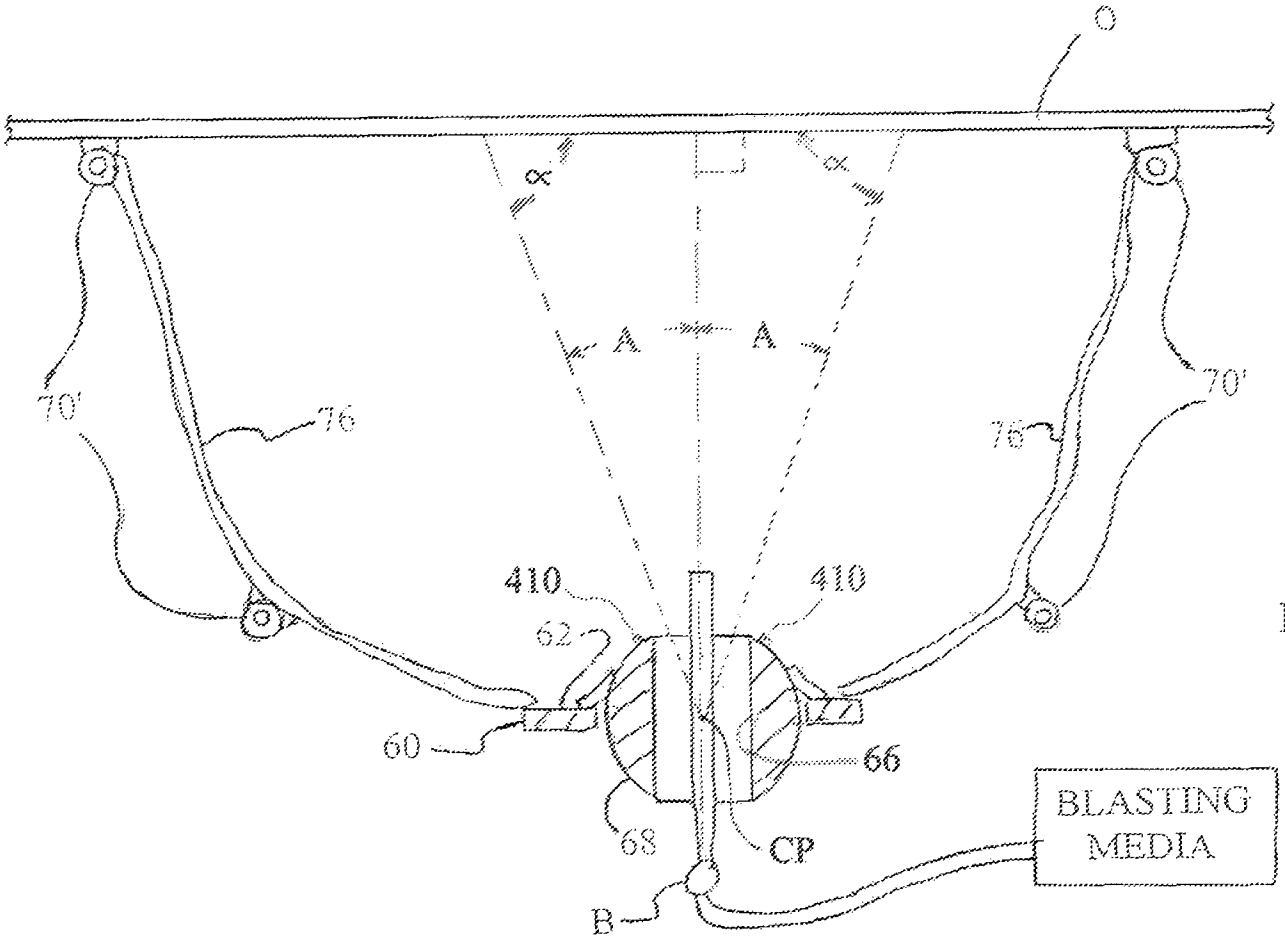
FIG. 29 is a diagrammatic partial cross sectional view of a containment barrier with a spherical orb showing the treatment angle of the surface treatment equipment with respect to a planar surface to be treated.
Figure 30:
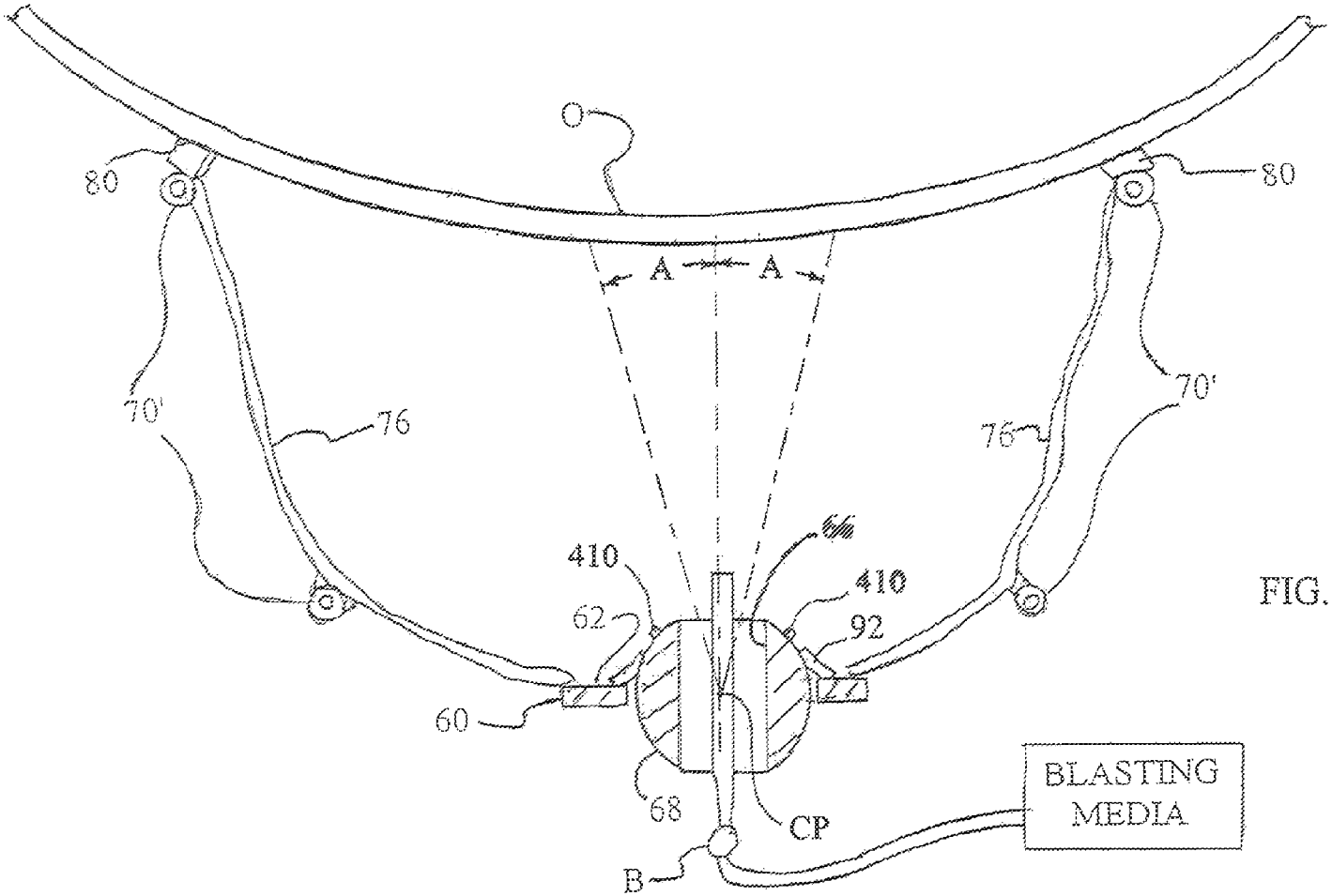
FIG. 30 is a diagrammatic partial cross sectional view of a containment barrier with a spherical orb showing the treatment angle of the surface treatment equipment with respect to a curved surface to be treated.

According to the embodiments illustrated in FIGS. 28-30, the spherical orb 68 that is rotatably supported by the rigid support panel 60 and comprises a plurality of stops 410. These stops 410 are secured to the exterior surface 95 of the orb 68 from which the blast nozzle B projects and extends, i.e., the surface 95 of the orb 68 that faces the object or the surface of the object to be treated O. If the orb 68 is sufficiently rotated, while treating the surface of the object O, one of these stops 410 may eventually come into contact and abut against the perimeter bearing seal 92 so as to prevent any further rotation of the orb 68 with respect to the surface the object to be treated O. Preferably, the position of the stops 410 are adjustable so as to alter the range of permissible movement of the orb 68 with respect to the rigid support panel 60.

As diagrammatically shown in FIGS. 29-32, the orb 68 is positioned such that a discharge path of the blast nozzle B is aligned so as to extend generally normal to, e.g., form an angle of 90 degrees with, with respect to both the support panel 60 and the surface of the object to be treated O. With the blast nozzle B so aligned, the blast media is discharged under pressure generally straight at the surface of the object O, such that the blast media impacts the surface of the object O with a maximum impact force. It is recognized that the impact force of the blast media, against the surface of the object O, is maximized when the blast media impacts the surface of the object O at an angle of 90 degrees±20°, for example (see FIGS. 29 and 30). It is to be appreciated that the impact force of the blast media, against the surface of the object O, decreases as the angle at which the blast media impacts the surface of the object to b treated O deviates from a perpendicular orientation with respect to the surface to be treated O.

In view of the above, it is beneficial to control the angle A of the blast nozzle or other surface treatment equipment B with respect to the surface to be treated O. The treatment angle A at which the blast nozzle or other surface treatment equipment B is directed at the surface to be treated O relates to the angle at which the blast media impacts the surface (FIGS. 29 and 30). The inventor has discovered that effective control of the treatment angle A, i.e., the impact angle, enhances the uniformity of the surface texture and/or anchor or surface profile so as to achieve a substantially uniform surface profile over the entire surface of the object to be treated O.

Typically, four or more stops 410 are placed about the surface 95 of the orb 68, at desired locations, in order to restrict how far the blast nozzle or other surface treatment equipment B is able to pivot and thereby deviate from a generally preferred 90 degree impact angle with respect to the surface to be treated O. The embodiment of the orb 68, as diagrammatically shown in FIG. 28, comprises four space the part stops 410 that are fixedly attached to the exterior surface 95 of the orb 68 on axes that pass through a central pivot point CP of the orb 68 and are generally located 90 degrees from one another. These stops 410 allow the orb 68 to rotate in generally any direction, e.g. up and down and/or right and left as represented in the figure by arrows.

In the event that the orb 68 rotates a sufficient amount such that one of the stops 410 abuts against the perimeter bearing seal 92, such abutment of the stop 410 with the bearing seal 92 prevents further rotation of the orb 68 (and also the blast nozzle or other surface treatment equipment B) in the pivoted direction with respect to the support panel 60. The locations of the stops 410 on the surface 95 of the orb 68 depend at least on the acceptable degree of variation of the treatment angle A from the desired included impact angle $\alpha$ of 90 degrees, as shown in FIGS. 29 and 30, and the desired uniformity of the surface texture and/or anchor or surface profile to be achieved over the surface of the object to be treated O. That is, if the operator desires to achieve a very uniform surface profile and the surface to be treated, then it very slight variation the treatment angle A may be permitted, i.e., the included impact angle $\alpha$ may range between 70 or 75 degrees and 90 degrees. Conversely, if the resulting surface profile of the surface to be treated can vary somewhat, greater variation in the treatment angle A is permissible, i.e., the included impact angle $\alpha$ may range from between 55 or 60 degrees and 90 degrees, for example.

FIG. 29 shows the stops 410 positioned such that the maximum permissible treatment angle A of the orb, with respect to an angle which extends perpendicular with respect to the surface being treated O and coincident with the central pivot point CP of the orb 68 is preferably about 40° or less, more preferably about 30° or less, and most preferably about 10-20° or less before one of the stops 410 abuts against the perimeter bearing seal 92. It has been found that any further deviation of the treatment angle A, from a desired impact discharge path which is substantially normal to the surface to be treated O, results in a gradual reduction or degradation in the force of impact of the blasting media or other surface treatment against the surface to be treated O. In the case of an object O that has a concave curved surface to be treated—such as shown in FIG. 30 the stops 410 may need to be adjusted so as to reduce the permissible treatment angle A in comparison to a planar surface to be treated O (FIG. 29). In this case, the object to be treated O has a surface that curves away from the support panel 60 and the orb 68 such that the maximum deviation of the treatment angle A, from substantially normal impact discharge path with the surface to be treated, is typically decreased in order for the blasting media to strike the surface with an effective impact force and thereby achieve the desired surface profile for the surface to be treated. With such a curved surface, the stops 410 generally tend to be adjusted to stop positions that are located closer to the perimeter bearing seal 92 so as to reduce the permissible movement of the orb 68 relative to the support panel 60, and thus the permissible treatment angle A. In the case illustrated in FIG. 30, the stops 410 enable the orb 68 and, thus, the blast nozzle or other surface treatment equipment B, to pivot up to a maximum deviation of the treatment angle A of preferably about 40°, more preferably about 30°, and most preferably about 10-20° before one of the stops 410 strikes against the perimeter bearing seal 92.

Figure 31:
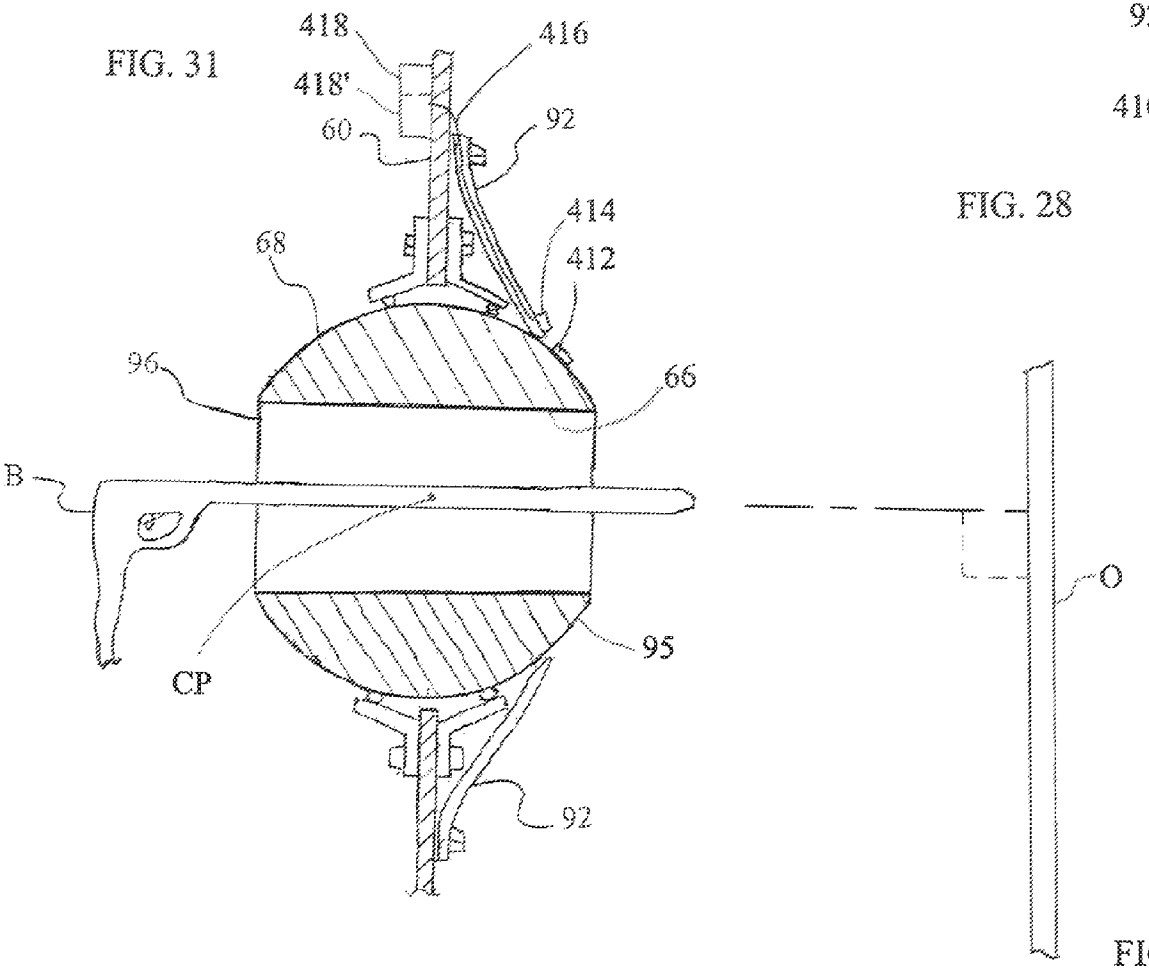
FIG. 31 is a diagrammatic cross sectional view of the spherical orb having a limited range of rotational motion.

In a further embodiment of the containment barrier, instead of the stops 410 abutting against the perimeter bearing seal, to prevent or limit further pivoting or rotational movement of the orb 68 and the blast nozzle or other surface treatment equipment B with respect to the rigid support panel 60 and, in turn, the surface to be treated O, the embodiment shown in FIG. 31 comprises at least one rotation or movement sensor 412 which is capable of detecting and measuring the relative movement between the orb 68 and the rigid support panel 60, and thus the blast nozzle or other surface treatment equipment B with respect to the surface to be treated O. The sensor 412 can be, for example, a Hall-effect sensor, a proximity sensor, etc. The sensor 412 can be fixed to the orb 68 while a detector 414 can be fixed to the perimeter bearing seal 92, or visa versa. The sensor 412 could be positioned to recognize a "home position" of the access aperture 66 (and generally the blast nozzle or other surface treatment equipment B), that is, when the access aperture 66 is precisely aligned and coincident with a line which extends through the center of the access aperture 66 and normal to the surface to be treated O. The detector 414 communicates, via a transmission line 416, with a signaling device 418 which, upon receiving signals from the detector 414, alerts the operator of any relative movement, between the access aperture 66 of the orb 68 and/or the blast nozzle or other surface treatment equipment B and the rigid support panel 60 or, in other words, relative movement of the blast nozzle or other surface treatment equipment B relative to the central home position of the orb.

Figure 32:
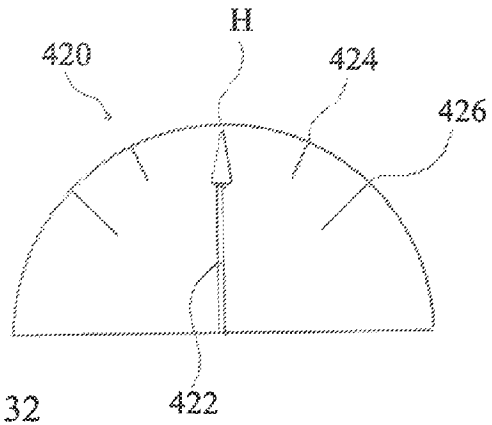
FIG. 32 is a diagrammatic view of a device for indicating rotational movement of the spherical orb with respect to the support panel.

It is to be appreciated that there are a number of way by which the signaling device 418 can alert the operator of relative movement of the blast nozzle or other surface treatment equipment B, e.g., either lateral left and right movement, or up and down movement, or a combination of both movements, from the home position. For example, the signaling device 418 may comprise a horizontal gauge and a vertical gauge 420 (only one of which is shown in FIG. 32) which has a needle or indicator 422 that correspondingly moves as the access aperture/blast nozzle or other surface treatment equipment B moves relative to the home position. The gauge 420 could be marked H to indicated the central home position of the blast nozzle or other surface treatment equipment B, as shown in FIG. 32, and have associated markings which signify varying ranges 424, 426 of deviation of the blast nozzle B from the home position.

It is to be recognized that there are a variety of signaling devices that could effectively be utilized to alert the operator of relative movement of the orb 68/access aperture/blast nozzle or other surface treatment equipment B and these may include, for example, conventional optical, haptic and/or auditory signaling devices and mechanisms. It is possible that separate first and second signaling devices 418, 418' may be employed, with the first signaling device 418 signaling vertical motion of the blast nozzle B and the second signaling device 418 signaling horizontal motion of the blast nozzle B.

Figure 33:
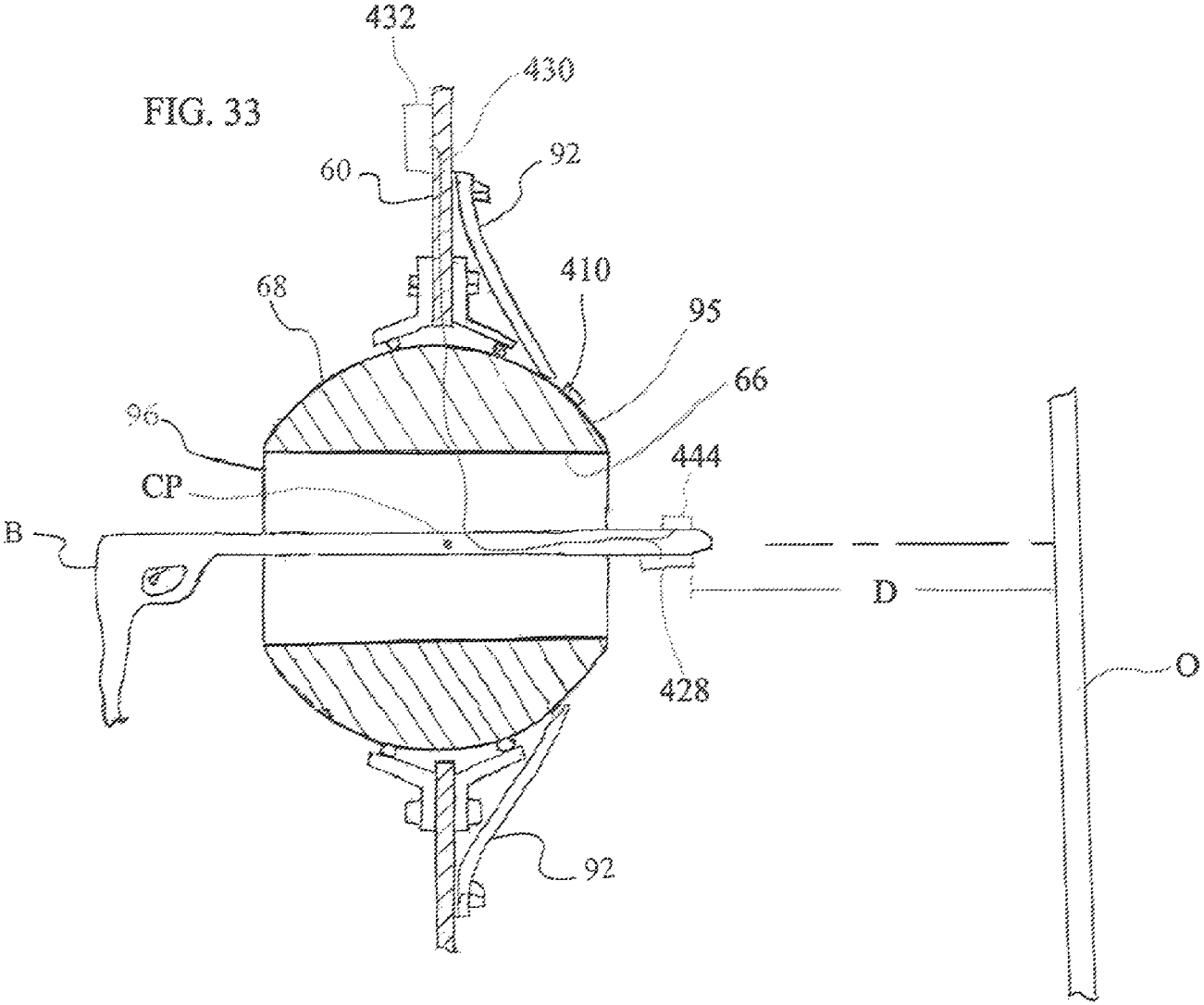
FIG. 33 is a diagrammatic cross sectional view of a spherical orb supporting surface treatment equipment having a position sensor which detects and monitors the spacing between the surface treatment equipment and the surface to be treated.

FIG. 33 illustrates an embodiment of the containment barrier that has the blast nozzle or other surface treatment equipment B with one or more monitoring elements for further controlling and monitoring operation of the surface treatment equipment and the progress of the treatment process. The blast nozzle or other surface treatment equipment B supports a position sensor 428, located adjacent a discharge end thereof, which detects and monitors the distance D between two objects, e.g., the distance D between a discharge end of the blast nozzle or other surface treatment equipment B and the surface to be treated O. The position sensor 428 communicates, via a communication line 430, with a signaling device 432. During the treatment of the surface, it is difficult to maintain a constant and uniform spacing between the discharge end of the blast nozzle or other surface treatment equipment B and the surface to be treated O. As noted above, the more the spacing between discharge end of the blast nozzle or other surface treatment equipment B and the surface to be treated O varies during surface treatment, the more this tends to vary the degree of penetration of the blasting media into the surface being treated and thereby tends to vary the surface texture and/or anchor or surface profile achieved by the blasting media.

The position sensor 428 detects spacing between the discharge end of the blast nozzle or other surface treatment equipment B and the surface to be treated O and any variation, from the desired home position, and communicates the same to the operator via the communication line 430 and signaling device 432. Like the signaling devices described above, the signaling device 432 can alert the operator of the relative distance D between discharge end of the blast nozzle or other surface treatment equipment B and the surface being treated O so that the operator can adjust the position of the discharge end of the blast nozzle or other surface treatment equipment B either toward or away from the surface being treated O to maintain the preferred spacing therebetween and thereby achieve a more uniform surface texture and/or anchor or surface profile for the surface being treated O.

The rate of removal of the material and/or matter from the surface of the object O depends on a number of factors such as, for example, the grit of the blasting media, the type of material from which the object to be treated is manufactured, the included impact angle a of the surface treatment media on the surface, the duration of surface treatment on a particular area, the impact force, e.g., the pressure and speed at which the surface treatment material is propelled by the blast nozzle or other surface treatment equipment B at the surface to be treated O. It is often desirable, and sometimes even required, to treat the surface to be treated such that the treated surface has a uniform and consistent surface texture and/or anchor or surface profile. By monitoring the distance D between the blast nozzle B and the surface being treated O, the position sensor 428 enables the operator to more precisely control treatment of the surface and therefore enhance the uniformity and consistency of the resulting surface texture and/or anchor or surface profile of the surface.

The blasting nozzle B can also include or support a laser 444 for emitting a laser beaming indicating the precise location at which the blast nozzle or other surface treatment equipment B is aimed. That is, the laser 444 is precisely aligned and generally coincident with the discharge path of the blast nozzle or other surface treatment equipment B so as to assist with precisely indicating the desired impact location of the surface treatment material at the surface to be treated O. The laser 444, in this case, is utilized to enhance positioning of the blast nozzle or other surface treatment equipment B and facilitates improved aiming of the surface treatment material, as such media is discharged from of the blast nozzle or other surface treatment equipment B, at the desired area of the surface to be treated O. In this manner, the efficiency of the treatment process, according to the present invention, is further maximized.

Figure 34:
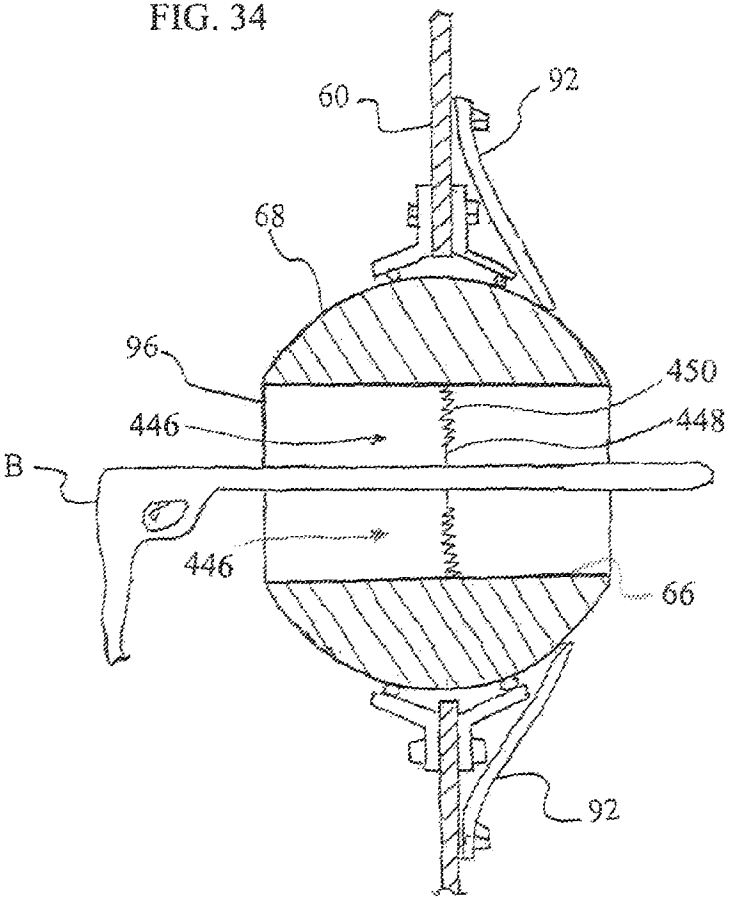
FIG. 34 is a diagrammatic sectional view of a spherical orb having shock absorbing devices which support the surface treatment equipment within the access aperture of the spherical orb.

The blast nozzle or other surface treatment equipment B, shown in FIG. 34, is supported within the access aperture 66 of the orb 68 by one or more shock adsorption members or elements 446. Each shock adsorption element 446 comprises a pin 448 that is fixed to the blast nozzle or other surface treatment equipment B and a resilient member 450, such as a spring, a gas piston/cylinder unit, etc. A first end of the resilient member 450 is releasably fixed to the pin 448 while an opposite end thereof is secured to an inwardly facing surface of the access aperture 66 of the orb 68. The shock adsorption elements 446 thereby resiliently supports of the blast nozzle or other surface treatment equipment B and thus facilitates absorbing some of the rearward directed energy, from the blast nozzle or other surface treatment equipment B, as the surface treatment material is ejected and discharged therefrom. A majority of the rearward directed energy from the blast nozzle or other surface treatment equipment B, as the surface treatment material is discharged therefrom, is absorbed by the shock adsorption elements 446 and transmitted to the orb 68 and the support panel 60 which thereby minimize the amount of energy which is transferred directly to the operator of the blast nozzle or other surface treatment equipment B. By minimizing this rearward directed energy toward the operator, this facilitates operation of larger blasting equipment at higher pressures and for longer durations of time without the operator becoming readily fatigued or tired.

Figure 35:
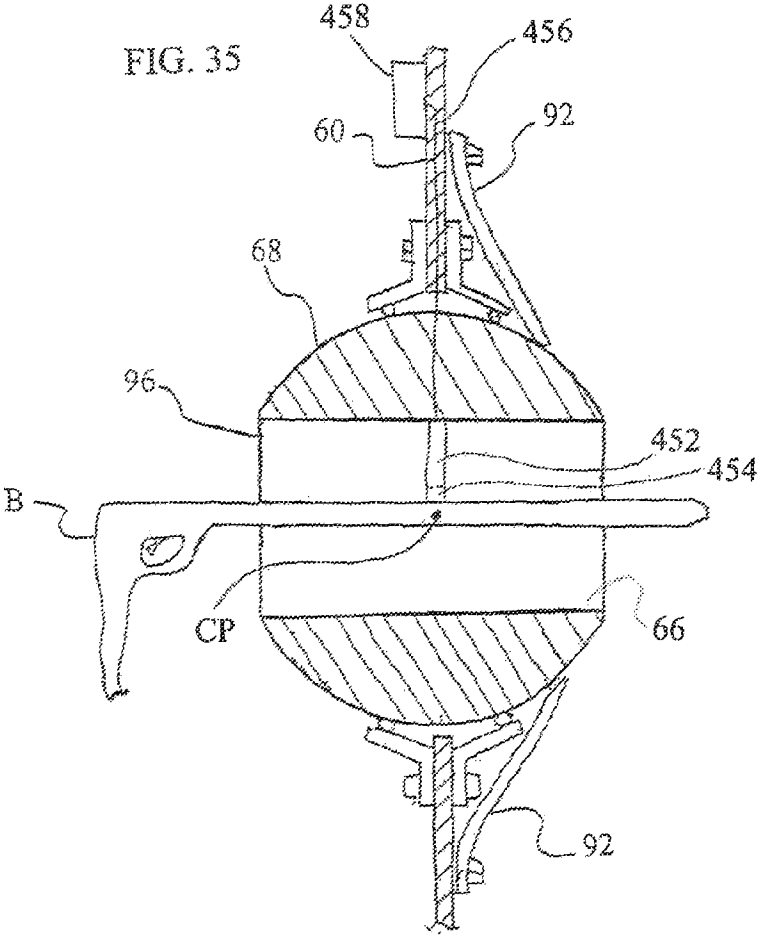
FIG. 35 is a diagrammatic sectional view of a spherical orb having a safety element that supports the surface treatment equipment within the access aperture of the spherical orb.
Figure 36:
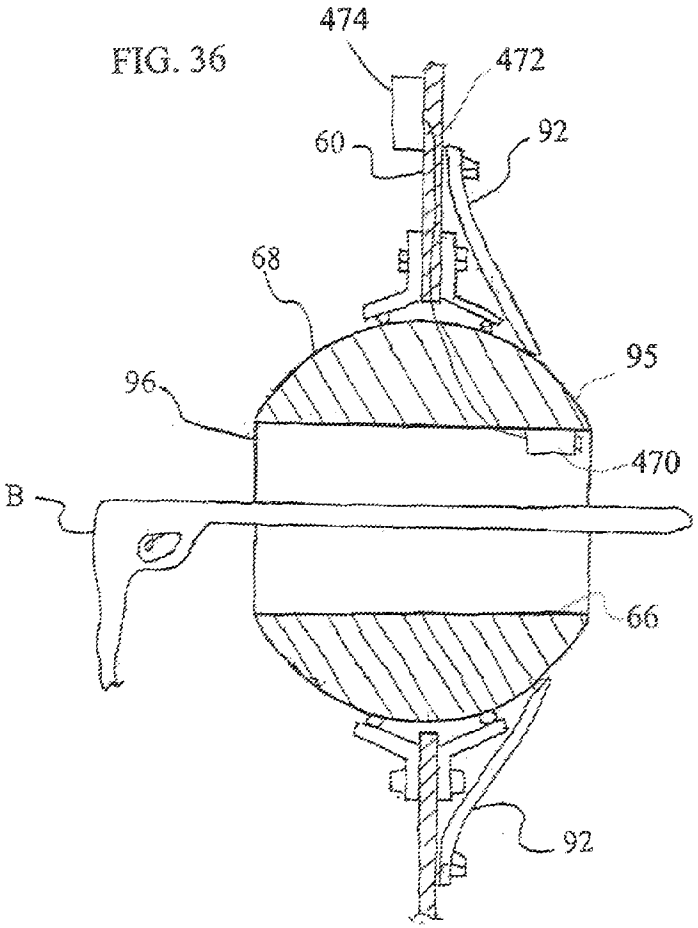
FIG. 36 is a diagrammatic cross sectional view of a spherical orb that supports the surface treatment equipment and has an optical monitoring device located within the access aperture of the spherical orb.

The blast nozzle or other surface treatment equipment B, as illustrated in diagrammatically FIG. 35, is supported within the access aperture 66 of the orb 68 by a safety element 452 which comprises a sensor 454. One end of the safety element 452 is fixed to the orb 68 and the opposite end is typically releasably coupled the blast nozzle or other surface treatment equipment B. The sensor 454 of the safety element 452 is located adjacent the blast nozzle or other surface treatment equipment B and detects proper attachment of the blast nozzle or other surface treatment equipment B within the orb 68. The safety element 452 communicates, via a communication line 456, with a shut off device 458 or a signaling device. The safety element 452 functions to restrict operation of the blast nozzle B, or associated blasting or other surface treatment tool or equipment, when the blast nozzle B or associated blasting or surface treatment tool, is not properly set up or supported within the access aperture 66 of the orb 68, The orb 68, as diagrammatically illustrated in FIG. 36, comprises a camera 470 or some other conventional fiber optic or other vision device which is secured to the orb 68, e.g., to an interior surface of the access aperture 66 and generally aligned parallel to the central axis of the access aperture 66 so as to provide viewing of the surface to be treated O during surface treatment. The camera 470 communicates, via a communication line 472, with a remote monitor 474 which can be viewed by an operator(s). With the camera 470 focused on the surface being treated O, the monitor 474 clearly displays, to the operator, the progress of the surface being treated. The camera 470 functions to enhance safe viewing of the point of impact of the surface treating material on the surface being treated O. In this manner, the operator is able to better view the surface being treated and control treatment thereof.

Figure 37:
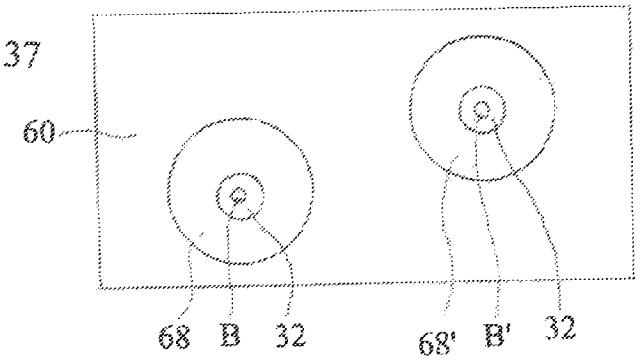
FIG. 37 is a diagrammatic front view of a support panel supporting a pair of spherical orbs which are spaced from one another and each supporting desired surface treatment equipment.
Figure 38:
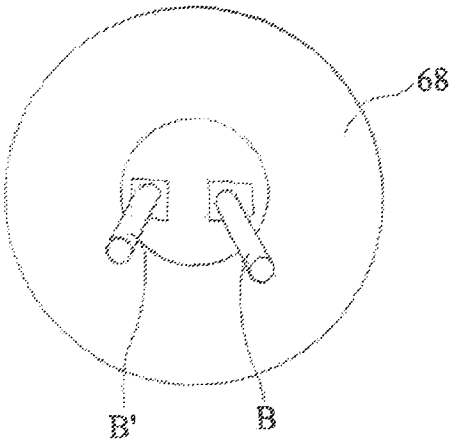
FIG. 38 is a diagrammatic front view of a spherical orb which supports a pair of surface treatment devices being accommodated within the same access aperture of the spherical orb.

It is recognized that the above described embodiments can be combined with each other in any desired manner so as to further enhance the process of treating the desired surface of an object. The containment barrier can, for example, support two or more orbs so as to decrease the overall surface treatment time, as generally shown in FIG. 37. Alternatively or in combination, each one of the access apertures 66 of the obs 68 may support a plurality of blast nozzles B and/or other surface treatment devices therein to facilitate more rapid surface treatment of the surface to be treated O, as generally shown in FIG. 38. Alternatively, the orb 68 may be provided with two or more access apertures 66 with each access aperture 66 supporting a separate blast nozzle B and/or some other surface treatment device or tool (not shown in detail). It is to be appreciated that a support panel 60 may support two or more separate orbs 68 or the containment barrier may include a plurality of separate support panels, with each support panel supporting one or more orbs. The increased number of orbs further increases access to the surface of the object to be treated O, thereby accelerating the surface treatment process. For example, the number of times that either the containment barrier or the surface to be treated has to be moved in order to treat the entire surface of the object is generally reduced.

The rigid support panel 60, diagrammatically shown in FIG. 37, supports a pair of spaced apart orbs 68, 68', with each orb 68, 68' supporting at least one blasting nozzle or other surface treatment device or tool B, B'. This too can simplify and accelerate the treatment process by eliminating the need to remove and replace the blast nozzle with either a tool of a different variety or a blast nozzle of a higher pressure or one that propels a different blasting media. According to the embodiment, diagrammatically shown in FIG. 38, the orb 68 can support first and second blasting nozzles B, B'. The first blasting nozzle B may be connected to the source of a coarse grit blasting media, which could be used for the rapid removal of material and/or matter from the surface to be treated, whereas the second blasting nozzle B' may be connected to the source of a fine grit blasting material which could be utilized for obtaining a desired surface texture and/or profile.

It is to be appreciated that the orb assembly can be supported on a variety of portable lifts and is not limited to being supported by a rigid support panel as generally illustrated in the figures. For example, the orb could be supported by an open frame to which the flexible barrier could be fixed and supported so as to enclose the surface to be treated and contain the blasting media and debris created by the treatment.

The orb assembly can also be utilized to support equipment that is often related to the art of treating surfaces but is different that the treatment equipment described above, e.g., blasting nozzles. It is foreseeable that the orb could support a variety of other type of equipment such as power tools, water jets, surface test equipment, etc., without departing from the spirit and scope of the present invention.

It is to be appreciated that a variety of different conventional seals, such as, for example, a lap seal, a brush seal, etc., can be utilized for sealing the access aperture from the surface treatment area and preventing any rebound blasting media, other surface treatment material and other debris from entering into the access aperture, past the seal formed with the surface treatment equipment. As such seals are conventional and well known in the art, a further detail description concerning the same is not provided.

Since certain changes may be made in the above described rotatable orb and portable containment system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. A treatment system for achieving a substantially uniform surface profile of a surface to be treated, the treatment system comprising:

a support panel supporting at least one rotatable orb, and the at least one rotatable orb being rotatable with respect to the support panel over a limited range of movement, the at least one rotatable orb having an access aperture extending therethrough which facilitates receiving a desired surface treatment equipment, and the access aperture being sized so as to permit the desired surface treatment equipment to pass therethrough and move relative to the access aperture, during surface treatment, for permitting an operator of the surface treatment equipment to adjust a position of the desired surface treatment equipment relative to the surface of the object to be treated during surface treatment, wherein the treatment system comprises a monitoring system for monitoring and communicating to the operator at least one of a spacing of a discharge end of the surface treatment equipment from the surface to be treated and a treatment angle of the surface treatment equipment with respect to the support panel so that the operator can control the surface treatment of the surface to be treated and achieve a substantially uniform surface profile, of the surface to be treated, following treatment thereof, based upon monitored information provided by the monitoring system.

2. The treatment system according to claim 1, wherein the monitoring system comprises a position sensor located adjacent the discharge end of the surface treatment equipment, and the position sensor is arranged to detect and monitor a spacing distance between the discharge end of the surface treatment equipment and the surface to be treated and thereby achieve the substantially uniform spacing and achieve the substantially uniform surface profile, of the surface to be treated, following treatment.

3. A treatment system for achieving a substantially uniform surface profile of a surface to be treated, the treatment system comprising:

a support panel supporting at least one rotatable orb, and the at least one rotatable orb being rotatable with respect to the support panel over a limited range of movement, the at least one rotatable orb having an access aperture extending therethrough which facilitates receiving a desired surface treatment equipment, and the access aperture being sized so as to permit the desired surface treatment equipment to pass therethrough and move relative to the access aperture, during surface treatment, for adjusting a position of the desired surface treatment equipment relative to the surface of the object to be treated, wherein the treatment system comprises a monitoring system for monitoring at least one of a spacing of a discharge end of the surface treatment equipment from the surface to be treated and a treatment angle of the surface treatment equipment with respect to the support panel in order to control the surface treatment of the surface to be treated and achieve a substantially uniform surface profile, of the surface to be treated, following treatment; and the spherical orb is supported by a perimeter bearing seal and the orb supports a plurality of adjustable stops for abutment against the perimeter bearing seal and preventing further pivoting movement of the orb with respect to the support panel, and a location of the stops, with respect to the orb, is adjustable to facilitate altering permissible pivoting movement of the orb relative to the perimeter bearing seal and the support panel.

4. The treatment system according to claim 1, wherein the monitoring system comprises a sensor which detects relative movement of the access aperture of the orb, with respect the support panel, from a normal included impact angle which extends perpendicular with respect to the surface being treated and coincident with a central pivot point of the orb, for achieving the substantially uniform surface profile, of the surface to be treated, following treatment.

5. The treatment system according to claim 1, wherein the support panel comprises a bearing arrangement which rotatably supports the at least one rotatable orb, the at least one rotatable orb further comprises a viewing aperture, and the rotatable orb has a diameter of between 2 inches and 36 inches and facilitates manipulation of the surface treatment equipment, relative to the support panel, for controlling treatment of the surface to be treated.

6. The treatment system according to claim 1, wherein the at least one orb further comprises a viewing aperture to facilitate viewing of the surface to be treated during surface treatment.

7. The treatment system according to claim 1, wherein the at least one orb further comprises a camera to facilitate remote viewing of the surface to be treated during surface treatment.

8. The treatment system according to claim 1, wherein the support panel is coupled to a barrier, and the barrier has an elongate perimeter seal which facilitates forming an airtight seal with the surface to be treated.

9. The treatment system according to claim 8, wherein support panel, the barrier and the perimeter seal facilitate defining an enclosed treatment area, and the treatment system further includes a suction device which communicates with the enclosed treatment area for withdrawing air from an interior thereof to assist with removing airborne blasting media, dust, contaminant and debris from the enclosed treatment area and creating a negative pressure.

10. The containment system according to claim 1, wherein the access aperture is sized so as to permit the desired surface treatment equipment to slide into and out off the access aperture, during surface treatment, so as to permit movement of the desired surface treatment equipment, relative to the access port, and assist control a spacing of a discharge end of the surface treatment equipment relative to the surface to be treated.

11. The containment system according to claim 8, wherein at least a portion of the barrier comprises a flexible barrier, and the flexible barrier is at least translucent so as to permit light, from outside the enclosed treatment area, to pass through the flexible barrier and illuminate the surface to be treated during the surface treatment process.

12. The containment system according to claim 1, wherein an outwardly facing surface of the rotatable orb is provided with one of a knob, a steering wheel, a control device and a manipulation device which facilitates at least one of control and manipulation of the rotatable orb by the operator.

13. The portable containment system according to claim 1, wherein the support panel is supported by one of an adjustable and a movable framework, the framework supports and retains the support panel in a desired orientation during use, the framework facilitates raising and lowering a vertical height of the support panel for adjusting a relative height of the access aperture with respect to the object to be treated, and a lower portion of at least some of frame members have a lockable wheel or roller which facilitates moving the framework along a support surface and repositioning of the panel relative to the surface to be treated without compromising an airtight seal between the at least one seal and the surface of the object to be treated.

14. The treatment system according to claim 1, wherein at least one shock adsorption element facilitates releasably resiliently supporting the surface treatment equipment to the rotatable orb, and the at least one shock adsorption element facilitates absorbing rearward directed energy from the surface treatment equipment.

15. The treatment system according to claim 14, wherein the resilient member comprises a pin which secured to the surface treatment equipment while an opposite end of the resilient member is secured to an inwardly facing surface of the access aperture of the orb, and the shock adsorption elements resiliently supports of the surface treatment equipment and facilitates absorbing some of the rearward directed energy, from the surface treatment equipment and thereby minimizes the energy which is transferred directly to an operator during surface treatment.

16. The treatment system according to claim 1, wherein a safety element is secured to the rotatable orb for releasably coupling the surface treatment equipment to the rotatable orb, and the safety element facilitates detecting proper attachment of the surface treatment equipment to the orb.

17. The treatment system according to claim 16, wherein the safety element comprises a sensor which communicates, via a communication line, with one of a shut off device and signaling device for one of shutting off and restricting operation of the blast surface treatment equipment when the surface treatment equipment is either not properly set up or supported within the access aperture of the orb.

18. A method of achieving a substantially uniform surface profile of a surface to be treated, the method system comprising the steps of:

supporting at least one rotatable orb via a support panel with the at least one rotatable orb being rotatable with respect to the support panel over a limited range of movement, providing an access aperture in the at least one rotatable orb which extends therethrough and facilitates receiving a desired surface treatment equipment, and the access aperture being sized so as to permit the desired surface treatment equipment to pass freely therethrough and move relative to the access aperture, during surface treatment, so as to permit an operator of the surface treatment equipment to control a position of the desired surface treatment equipment relative to the surface or the object to be treated, and monitoring and communicating to the operator at least one of a spacing of a discharge end of the surface treatment equipment from the surface to be treated and a treatment angle of the surface treatment equipment relative to the support panel so that the operator can control the surface treatment of the surface to be treated and achieve a substantially uniform surface profile, of the surface to be treated, following treatment thereof, based upon monitored information.

19. The treatment system according to claim 1, wherein the monitoring system enables the operator to precisely control treatment of the surface and thereby enhance a uniformity and consistency surface profile of the surface to be treated.

20. The treatment system according to claim 1, wherein the monitoring system provides an alert to the operator so that the operator can adjust the position of the discharge end of the surface treatment equipment either toward or away from the surface being treated to maintain the preferred spacing therebetween.

* * * * *